US006663230B2

(12) United States Patent
Asakawa et al.

(10) Patent No.: US 6,663,230 B2
(45) Date of Patent: Dec. 16, 2003

(54) LIQUID EJECTION HEAD, APPARATUS AND RECOVERY METHOD FOR THEM

(75) Inventors: Yoshie Asakawa, Nagano-ken (JP); Toshio Kashino, Chigasaki (JP); Takeshi Okazaki, Sagamihara (JP); Aya Yoshihira, Yokohama (JP); Kiyomitsu Kudo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/291,565

(22) Filed: Nov. 12, 2002

(65) Prior Publication Data

US 2003/0085963 A1 May 8, 2003

Related U.S. Application Data

(62) Division of application No. 08/717,162, filed on Sep. 20, 1996, now Pat. No. 6,505,915.

(30) Foreign Application Priority Data

Sep. 22, 1995 (JP) ..... 7-244987
Jun. 7, 1996 (JP) ..... 8-145276

(51) Int. Cl.[7] ..... B41J 2/05
(52) U.S. Cl. ..... 347/65; 347/20; 347/84
(58) Field of Search ..... 347/20, 22, 58, 347/30, 65, 84, 85, 99; 216/27

(56) References Cited

U.S. PATENT DOCUMENTS

| | | | | |
|---|---|---|---|---|
| 4,162,997 | A | 7/1979 | Walsh | 260/27 R |
| 4,480,259 | A | 10/1984 | Kruger et al. | 346/140 R |
| 4,496,960 | A | 1/1985 | Fischbeck | 346/140 R |
| 4,723,129 | A | 2/1988 | Endo et al. | 346/1.1 |
| 5,278,585 | A | 1/1994 | Karz et al. | 346/140 R |
| 5,485,186 | A | 1/1996 | Ishinaga et al. | 347/65 |
| 5,638,101 | A | 6/1997 | Keefe et al. | 347/65 |
| 5,644,346 | A | 7/1997 | Schwiebert et al. | 347/33 |
| 5,701,146 | A | 12/1997 | Akiyama et al. | 347/30 |
| 5,821,962 | A | 10/1998 | Kudo et al. | 347/65 |
| 5,897,789 | A | 4/1999 | Weber | 347/85 |
| 6,062,680 | A | 5/2000 | Yoshihira et al. | 347/65 |
| 6,102,529 | A | 8/2000 | Okazaki et al. | 347/65 |
| 6,293,656 | B1 | 9/2001 | Okazaki et al. | 347/65 |

FOREIGN PATENT DOCUMENTS

| | | |
|---|---|---|
| EP | 0 259 193 | 3/1988 |
| EP | 0 436 047 | 7/1991 |
| EP | 0 561 406 | 9/1993 |
| EP | 0 585 901 | 3/1994 |
| EP | 721841 | 7/1996 |
| JP | 55-081172 | 6/1980 |
| JP | 61-069467 | 4/1986 |
| JP | 61-110557 | 5/1986 |
| JP | 62-156969 | 7/1987 |
| JP | 63-5947 | 1/1988 |
| JP | 63-197652 | 8/1988 |
| JP | 63-199972 | 8/1988 |
| JP | 3-081155 | 4/1991 |
| JP | 5-124189 | 5/1993 |
| JP | 6-087214 | 3/1994 |

OTHER PUBLICATIONS

U.S. Application Ser. No. 08/717,072, filed Sep. 20, 1996.

*Primary Examiner*—Andrew H. Hirshfeld
*Assistant Examiner*—Minh Chau
(74) *Attorney, Agent, or Firm*—Fitzpatrick, Cella, Harper & Scinto

(57) ABSTRACT

A liquid ejection head includes an ejection outlet for ejecting liquid; a bubble generating region for generating a bubble; a movable member disposed faced to the bubble generating region and movable between a first position and a second position which is farther form the bubble generating region than the first position; a liquid supply passage for supplying the liquid to the bubble generating region from upstream of the bubble generating region; an opening, in fluid communication with the supply passage, for discharging the liquid.

35 Claims, 38 Drawing Sheets

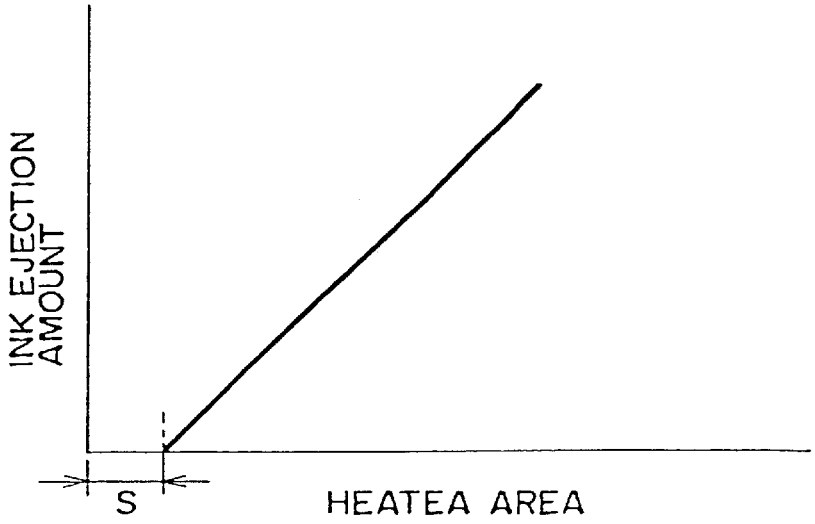
FIG. 16
Fig. 17(a)
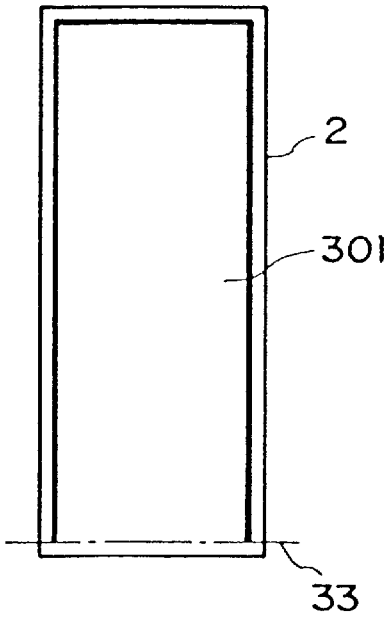
Fig. 17(b)
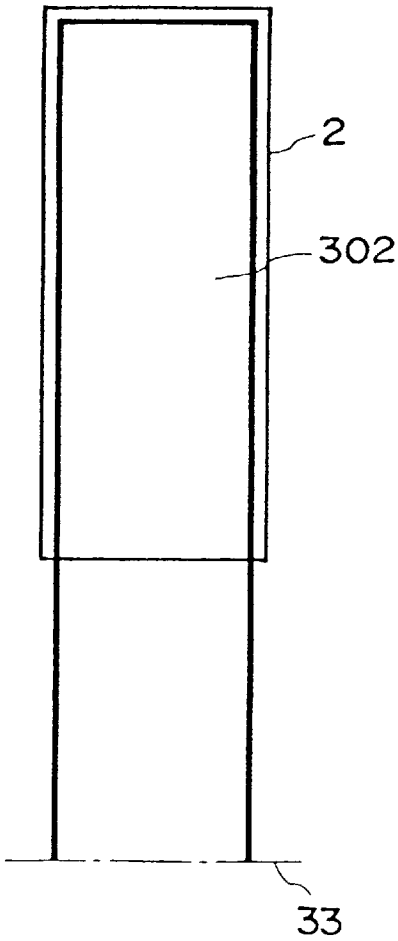

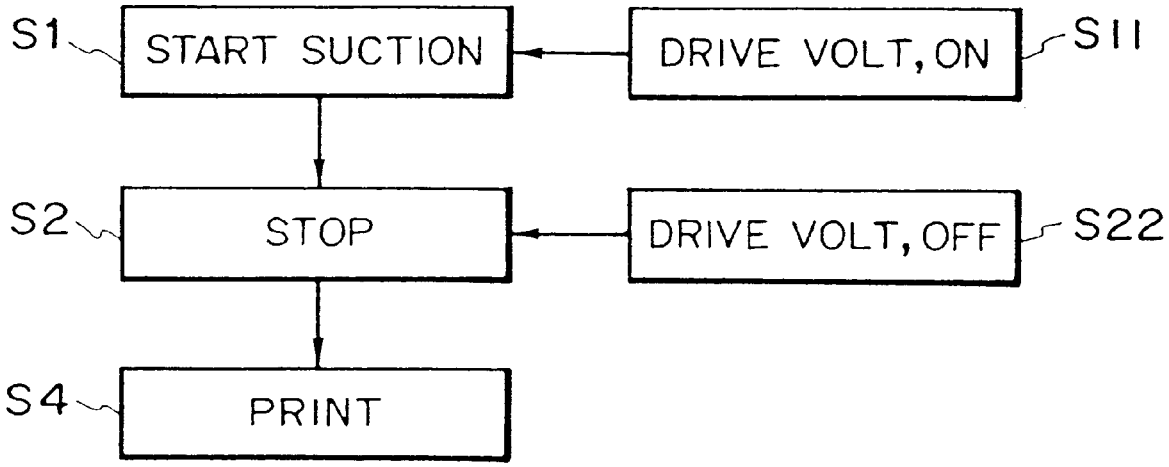
FIG. 33
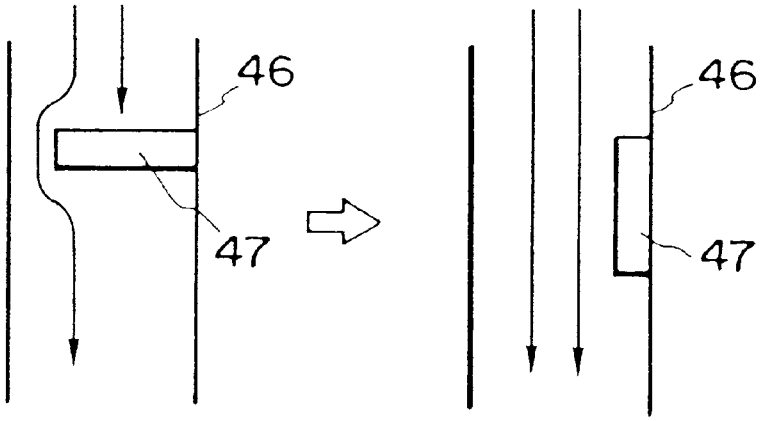
Fig. 34(a) NORMAL Fig. 34(b) SUCTION

LIQUID EJECTION HEAD, APPARATUS AND RECOVERY METHOD FOR THEM

This application is a divisional application of U.S. application Ser. No. 08/717,162, filed Sep. 20, 1996, now U.S. Pat. No. 6,505,915.

FIELD OF THE INVENTION AND RELATED ART

The present invention relates to a liquid ejecting head, a liquid ejecting apparatus, using the liquid ejecting head and a recovery method for the liquid ejecting apparatus, wherein desired liquid is ejected by generation of the bubble by applying thermal energy to the liquid.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 or the like discloses a flow passage structure as shown in FIG. 45, (a), (b). The invention of the flow passage structure and the head manufacturing method disclosed in the publication, is particularly directed to the backward liquid generated in accordance with generation of a bubble (the pressure propagated away from the ejection outlet namely toward the liquid chamber 12). The back wave is known as energy loss since it is not propagated toward the ejection direction.

FIG. 61, (a) and (b) disclose a valve 10 spaced from a generating region of the bubble generated by the heat generating element 2 in a direction away from the ejection outlet 11.

In FIG. 61, (b), this valve 10, is so manufactured from a plate that it has an initial position where it looks as if it stick on the ceiling of the flow path 3, and is deflected downward into the flow path 3 upon the generation of the bubble. Thus, the energy loss is suppressed by controlling a part of the backward wave by the valve 10.

However, with this structure, if the consideration is made as to the time when the bubble is generated in the flow path 3 having the liquid to be ejected, the suppression of a part of the backward wave by the valve 10 is not desirable.

The backward wave per se is not contributable to the ejection. At the time when the backward wave is generated inside the flow path 3, the pressure directly contributable to the ejection has already make the liquid ejectable from the flow path 3, as shown in FIG. 61, (a). Therefore, even if the backward wave is suppressed, the ejection is not significantly influenced, much less even if a part thereof is suppressed.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Even when it the liquid to be ejected is easily deteriorated by the heat, or is not sufficiently formed into a bubble, the liquid is desirably ejected without deterioration of the liquid.

From this standpoint, Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to quite a high degree. In addition, the deformation of the flexible film is not so large, and therefore, the energy use efficiency and the ejection force are deteriorated although the some effect is provided by the provision between the ejection liquid and the bubble generation liquid.

SUMMARY OF THE INVENTION

Accordingly, it is a principal object of the present invention to provide a liquid ejecting method and device provided with ejection power refreshing means, wherein an ejection efficiency, is high, and ejection power is large, and still satisfactory ejection is possible even after long term non-use condition.

It is another object of the present invention to provide a novel and effective liquid ejection.

It is a further object of the present invention to provide a liquid ejecting method, and liquid ejecting head or the like wherein the ejection efficiency, and the ejection power are high, and the heat accumulation of the liquid on the heat generating element can be significantly reduced, and the residual bubble on the heat generating element can be reduced.

It is a further object of the present invention to provide a liquid ejecting head or the like, wherein inertia force in the opposite direction from the liquid supply direction due to the backward wave is suppressed, and simultaneously, the meniscus retraction amount is reduced by the valve function of the movable member, by which the refilling frequency is increased, and the printing speed is improved.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

According to an aspect of the present invention, there is provided a liquid ejection head comprising: an ejection outlet for ejecting liquid; a bubble generating region for generating a bubble; a movable member disposed faced to the bubble generating region and movable between a first position and a second position which is farther form the bubble generating region than the first position; a liquid supply passage for supplying the liquid to the bubble generating region from upstream of the bubble generating region; an opening, in fluid communication with the supply passage, for discharging the liquid.

According to another aspect of the present invention, there is provided a liquid ejection head comprising: an ejection outlet for ejecting liquid; a liquid path having a heat generating element for generating a bubble in the liquid by application of heat to the liquid, and a supply passage for supplying the liquid to the heat generating element from upstream side thereof; a movable member, disposed faced to the heat generating element and having a free end adjacent the ejection outlet, for directing a pressure produced by generation of the bubble, toward the ejection outlet, on the basis of the pressure produced by the generation of the bubble; and an opening, in fluid communication with the supply passage, for discharging the liquid.

According to a further aspect of the present invention, there is provided a liquid ejection head comprising: an ejection outlet for ejecting liquid; a heat generating element for generating a bubble in the liquid by application of heat to the liquid; a movable member, disposed faced to the heat generating element and having a free end adjacent the ejection outlet, for directing a pressure produced by generation of the bubble, toward the ejection outlet; a supply passage for supplying the liquid to the heat generating element from an upstream thereof along a surface of the movable member adjacent the heat generating element; an opening, in fluid communication with the supply passage, for discharging the liquid.

According to a further aspect of the present invention, there is provided a liquid ejection head comprising: a first liquid flow path in fluid communication with an ejection outlet; a second liquid flow path having bubble generation region for generating the bubble in the liquid by applying heat to the liquid; a movable member, disposed between the first liquid flow path and the bubble generating region and having a free end adjacent the ejection outlet, for directing a pressure produced by generation of the bubble, toward the ejection outlet of the first liquid flow path, by movement of the free end into the first liquid flow path on the basis of pressure produced by generation of the bubble the bubble generating region; an opening, in fluid communication with the supply passage, for discharging the liquid.

According to a further aspect of the present invention, there is provided a liquid ejection head comprising: a plurality of ejection outlet for ejecting liquid; a plurality of grooves for constituting a plurality of first liquid flow paths in direct fluid communication with associated ones of the ejection outlets; a recess for constituting a first common liquid chamber for supplying the liquid to the first liquid flow paths; wherein the grooves and the recess are formed in a grooved member; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and an opening, in fluid communication with the supply passage, for discharging the liquid.

According to a further aspect of the present invention, there is provided a liquid ejection apparatus comprising: a liquid ejecting head for ejecting liquid by generation of bubble, including an ejection outlet for ejecting the liquid; a bubble generation region for generating the bubble in the liquid; a movable member disposed faced to the bubble generation region and displaceable between a first position and a second position further from the bubble generation region than the first position; wherein the movable member moves from the first position to the second position by pressure produced by the generation of the bubble to permit expansion of the bubble more in a downstream side closer to the ejection outlet than in an upstream side; and means for discharging the liquid through the ejection outlet.

According to a further aspect of the present invention, there is provided a liquid ejection apparatus comprising: a liquid ejection head including an ejection outlet for ejecting liquid; a liquid path having a heat generating element for generating a bubble in the liquid by application of heat to the liquid, and a supply passage for supplying the liquid to the heat generating element from upstream side thereof; a movable member, disposed faced-to the heat generating element and having a free end adjacent the ejection outlet, for directing a pressure produced by generation of the bubble, toward the ejection outlet, on the basis of the pressure produced by the generation of the bubble; and means for discharging the liquid through the ejection outlet.

According to a further aspect of the present invention, there is provided a liquid ejection apparatus comprising: a liquid ejection head including an ejection outlet for ejecting liquid; an ejection outlet for ejecting liquid; a heat generating element for generating a bubble in the liquid by application of heat to the liquid; a movable member, disposed faced to the heat generating element and having a free end adjacent the ejection outlet, for directing a pressure produced by generation of the bubble, toward the ejection outlet; and a supply passage for supplying the liquid to the heat generating element from an upstream thereof along a surface of the movable member adjacent the heat generating element; means for discharging the liquid through the ejection outlet.

According to a further aspect of the present invention, there is provided a liquid ejection apparatus comprising: a liquid ejection head including a first liquid flow path in fluid communication with an ejection outlet; a second liquid flow path having bubble generation region for generating the bubble in the liquid by applying heat to the liquid; and a movable member, disposed between the first liquid flow path and the bubble generating region and having a free end adjacent the ejection outlet, for directing a pressure produced by generation of the bubble, toward the ejection outlet of the first liquid flow path, by movement of the free end into the first liquid flow path on the basis of pressure produced by generation of the bubble the bubble generating region; and means for discharging the liquid through the ejection outlet.

According to a further aspect of the present invention, there is provided a liquid ejection apparatus comprising: a liquid ejection head including a plurality of ejection outlet for ejecting liquid; a plurality of grooves for constituting a plurality of first liquid flow paths in direct fluid communication with associated ones of the ejection outlets; a recess for constituting a first common liquid chamber for supplying the liquid to the first liquid flow paths; wherein the grooves and the recess are formed in a grooved member; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and means for discharging the liquid through the ejection outlet.

According to a further aspect of the present invention, there is provided a recovering method for a liquid ejection apparatus comprising: a liquid ejecting head for ejecting liquid by generation of bubble, including an ejection outlet for ejecting the liquid; a bubble generation region for generating the bubble in the liquid; a movable member disposed faced to the bubble generation region and displaceable between a first position and a second position further from the bubble generation region than the first position; wherein the movable member moves from the first position to the second position by pressure produced by the generation of the bubble to permit expansion of the bubble more in a downstream side closer to the ejection outlet than in an upstream side; the improvement residing in that the liquid is discharged through the ejection outlet to recover ejection power of the liquid ejecting head.

According to a further aspect of the present invention, there is provided a recovering method for a liquid ejection apparatus comprising: a liquid ejecting head for ejecting liquid by generation of bubble, including an ejection outlet for ejecting the liquid; a bubble generation region for generating the bubble in the liquid; a movable member disposed faced to the bubble generation region and displaceable between a first position and a second position further from the bubble generation region than the first position; wherein the movable member moves from the first position to the second position by pressure produced by the generation of the bubble to permit expansion of the bubble more in a downstream side closer to the ejection outlet than in an upstream side; and an opening, in fluid communication with the supply passage, for discharging the liquid; the improvement residing in that the liquid is discharged through the ejection outlet and/or the opening to recover ejection power of the liquid ejecting head.

According to a further aspect of the present invention, there is provided a recovering method for a liquid ejection apparatus comprising: a liquid ejection head including an ejection outlet for ejecting liquid; a liquid path having a heat generating element for generating a bubble in the liquid by application of heat to the liquid, and a supply passage for supplying the liquid to the heat generating element from upstream side thereof; a movable member, disposed faced to the heat generating element and having a free end adjacent the ejection outlet, for directing a pressure produced by generation of the bubble, toward the ejection outlet, on the basis of the pressure produced by the generation of the bubble; the improvement residing in that the liquid is discharged through the ejection outlet to recover ejection power of the liquid ejecting head.

According to a further aspect of the present invention, there is provided a recovering method for a liquid ejection apparatus comprising: a liquid ejection head including an ejection outlet for ejecting liquid; a liquid path having a heat generating element for generating a bubble in the liquid by application of heat to the liquid, and a supply passage for supplying the liquid to the heat generating element from upstream side thereof; a movable member, disposed faced to the heat generating element and having a free end adjacent the ejection outlet, for directing a pressure produced by generation of the bubble, toward the ejection outlet, on the basis of the pressure produced by the generation of the bubble; and an opening, in fluid communication with the supply passage, for discharging the liquid; the improvement residing in that the liquid is discharged through the ejection outlet and/or the opening to recover ejection power of the liquid ejecting head.

According to a further aspect of the present invention, there is provided a recovering method for a liquid ejection apparatus comprising: a liquid ejection head including an ejection outlet for ejecting liquid; an ejection outlet for ejecting liquid; a heat generating element for generating a bubble in the liquid by application of heat to the liquid; a movable member, disposed faced to the heat generating element and having a free end adjacent the ejection outlet, for directing a pressure produced by generation of the bubble, toward the ejection outlet; and a supply passage for supplying the liquid to the heat generating element from an upstream thereof along a surface of the movable member adjacent the heat generating element; the improvement residing in that the liquid is discharged through the ejection outlet to recover ejection power of the liquid ejecting head.

According to a further aspect of the present invention, there is provided a recovering method for a liquid ejection apparatus comprising: a liquid ejection head including an ejection outlet for ejecting liquid; an ejection outlet for ejecting liquid; a heat generating element for generating a bubble in the liquid by application of heat to the liquid; a movable member, disposed faced to the heat generating element and having a free end adjacent the ejection outlet, for directing a pressure produced by generation of the bubble, toward the ejection outlet; and a supply passage for supplying the liquid to the heat generating element from an upstream thereof along a surface of the movable member adjacent the heat generating element; and an opening, in fluid communication with the supply passage, for discharging the liquid; the improvement residing in that the liquid is discharged through the ejection outlet and/or the opening to recover ejection power of the liquid ejecting head.

According to a further aspect of the present invention, there is provided a recovery method for a liquid ejection apparatus comprising: a liquid ejection head including a first liquid flow path in fluid communication with an ejection outlet; a second liquid flow path having bubble generation region for generating the bubble in the liquid by applying heat to the liquid; and a movable member, disposed between the first liquid flow path and the bubble generating region and having a free end adjacent the ejection outlet, for directing a pressure produced by generation of the bubble, toward the ejection outlet of the first liquid flow path, by movement of the free end into the first liquid flow path on the basis of pressure produced by generation of the bubble the bubble generating region; the improvement residing in that the liquid is discharged through the ejection outlet to recover ejection power of the liquid ejecting head.

According to a further aspect of the present invention, there is provided a recovery method for a liquid ejection apparatus comprising: a liquid ejection head including a first liquid flow path in fluid communication with an ejection outlet; a second liquid flow path having bubble generation region for generating the bubble in the liquid by applying heat to the liquid; and a movable member, disposed between the first liquid flow path and the bubble generating region and having a free end adjacent the ejection outlet, for directing a pressure produced by generation of the bubble, toward the ejection outlet of the first liquid flow path, by movement of the free end into the first liquid flow path on the basis of pressure produced by generation of the bubble the bubble generating region; and an opening, in fluid communication with the supply passage, for discharging the liquid; the improvement residing in that the liquid is discharged through the ejection outlet and/or the opening to recover ejection power of the liquid ejecting head.

According to a further aspect of the present invention, there is provided a recovery method for a liquid ejection apparatus comprising: a liquid ejection head including a plurality of ejection outlet for ejecting liquid; a plurality of grooves for constituting a plurality of first liquid flow paths in direct fluid communication with associated ones of the ejection outlets; a recess for constituting a first common liquid chamber for supplying the liquid to the first liquid flow paths; wherein the grooves and the recess are formed in a grooved member; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; the improvement residing in that the liquid is discharged through the ejection outlet to recover ejection power of the liquid ejecting head.

According to a further aspect of the present invention, there is provided a recovering method for a liquid ejection apparatus comprising: a liquid ejection head including a plurality of ejection outlet for ejecting liquid; a plurality of grooves for constituting a plurality of first liquid flow paths in direct fluid communication with associated ones of the ejection outlets; a recess for constituting a first common liquid chamber for supplying the liquid to the first liquid flow paths; wherein the grooves and the recess are formed in a grooved member; an element substrate having a plurality of heat generating elements for generating the bubble in the liquid by applying heat to the liquid; and a partition wall disposed between the grooved member and the element substrate and forming a part of walls of second liquid flow paths corresponding to the heat generating elements, and a movable member movable into the first liquid flow paths by pressure produced by the generation of the bubble, the movable member being faced to the heat generating element; and an opening, in fluid communication with the supply passage, for discharging the liquid; the improvement residing in that the liquid is discharged through the ejection outlet and/or the opening to recover ejection power of the liquid ejecting head.

The liquid in the liquid path in single liquid flow path structure is sucked out, or the liquids in the paths in the two-flow-path structure are simultaneously sucked out, through the ejection outlets, or they are pressurized, so that the viscosity-increased ink, foreign matter or the like which is liable to be deposited at the ejection outlet portion after long non-use period, can be efficiently removed, and the precipitated bubble in the liquid in the first liquid flow path can be efficiently removed. According to the present invention, when the ejection liquid and bubble generation liquid are used, the mixture of the two liquids can be avoided even if the recording head or the like is kept intact for quite a long term.

With the structure of the bubble generating portion side liquid flow path having a path open to the outside, the liquids in the two paths isolated by the movable member are efficiently discharged by the suction means or pressing means. With this structure, the number, amount, order, and the timing of the discharge for the liquids in both of the flow paths are selectable.

In addition, by increasing the flow rate by opening the flow rate adjusting means upon the suction operation through the ejection outlet, the removal of the viscosity-increased ink or the like can be further efficient.

Adjustment of the suction amount of each liquid using the static head difference between the liquid, or suction under the condition that the flow resistances of the liquids are the same, are effective to increase the efficiency of the removal of the viscosity-increased ink or the like. Suction while the movable member takes the position in the first liquid flow path, is very effective.

When the liquid ejecting method, and the head using the movable member, the ejection efficiency can be increased. For example, in the most desirable type of the present invention, the ejection efficiency is increased even to twice the conventional one.

The ejection failure can be avoided even after long term non-use under low temperature and low humidity conditions, and even if the ejection failure occurs, the normal state is restored by small scale refreshing process such as preliminary ejection or suction recovery. The said refreshing process will be described in detail hereinafter.

According to the present invention, the time required for the recovery can be reduced, and the loss of the liquid by the recovery operation is reduced, so that the running cost can be reduced.

According to an aspect of the present invention wherein the refilling property is improved, the responsivity, stabilized growth of the bubble, and the stabilization of the droplet are accomplished under the condition of the continuous ejection, so that the high speed recording and high image quality recording are accomplished by the high speed liquid ejection.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 16 shows a relation between an area of a heat generating element and an ink ejection amount.

FIG. 17 shows a positional relation between a movable member and a heat generating element.

FIG. 33 is a flow chart showing suction recovery process in the embodiment shown in FIG. 32.

FIG. 34 is a top plan view illustrating operation of flow rate adjusting means, wherein (a) shows a state at the time of flow rate regulation of the flow rate adjusting means, and (b) shows a state at the time of a released flow rate regulation of the flow rate adjusting means.

DESCRIPTION OF THE PREFERRED EMBODIMENTS

The description will be made as to some terminologies used in this specification.

The "opening" for liquid is an opening having a so-called low-pass function, more particularly, having such a dimensions and location that the liquid is substantially prevented from passing therethrough by the pressure change of the liquid in the head resulted from a normal ejecting operation, but the liquid is permitted to pass therethrough by suction or pressurization for a recovery or refreshing operation.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

<Ejection Principle>

The description will be made as to example 1 of the liquid ejection principle.

In this ejection system, the ejection power and the ejection efficiency are improved by controlling the propagation direction of the pressure produced by the bubble for ejecting the liquid and the growth direction of the bubble.

Figure 1A:
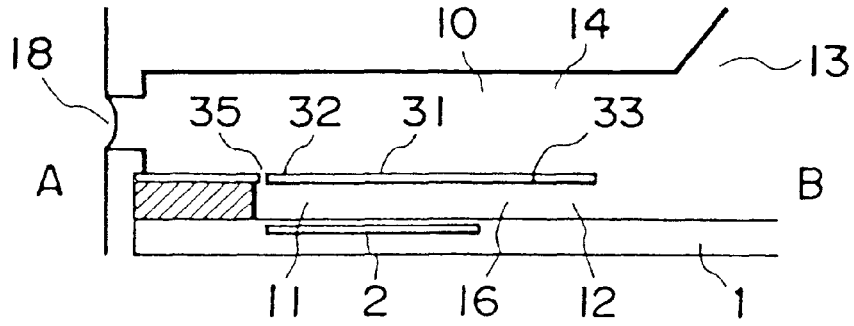
FIG. 1 is a schematic sectional view showing an example of a liquid ejecting head according to an embodiment of the present invention.
Figure 1B:
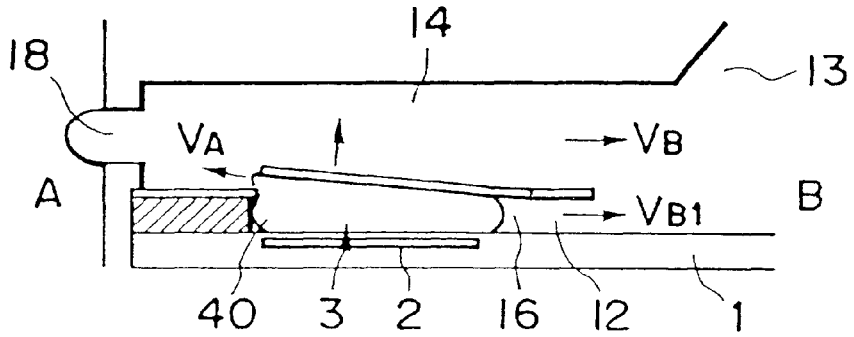
Figure 1C:
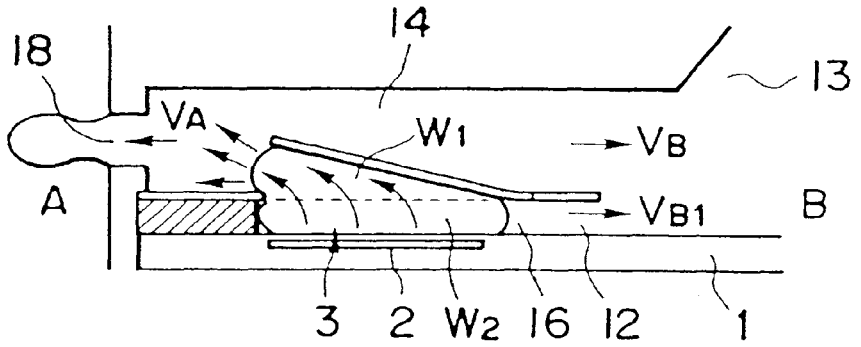
Figure 1D:
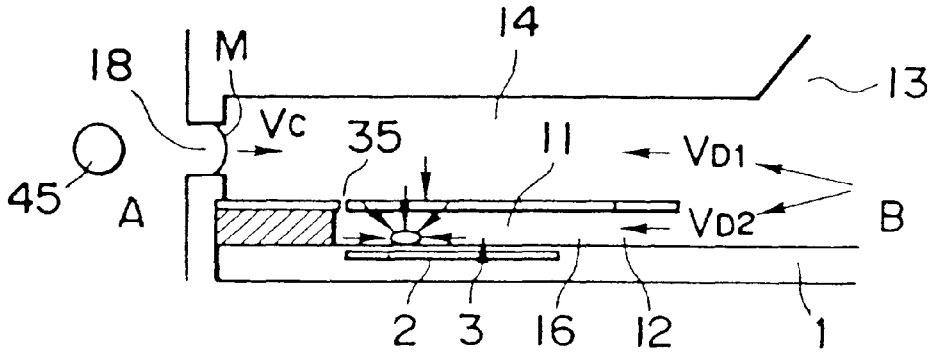
Figure 2:
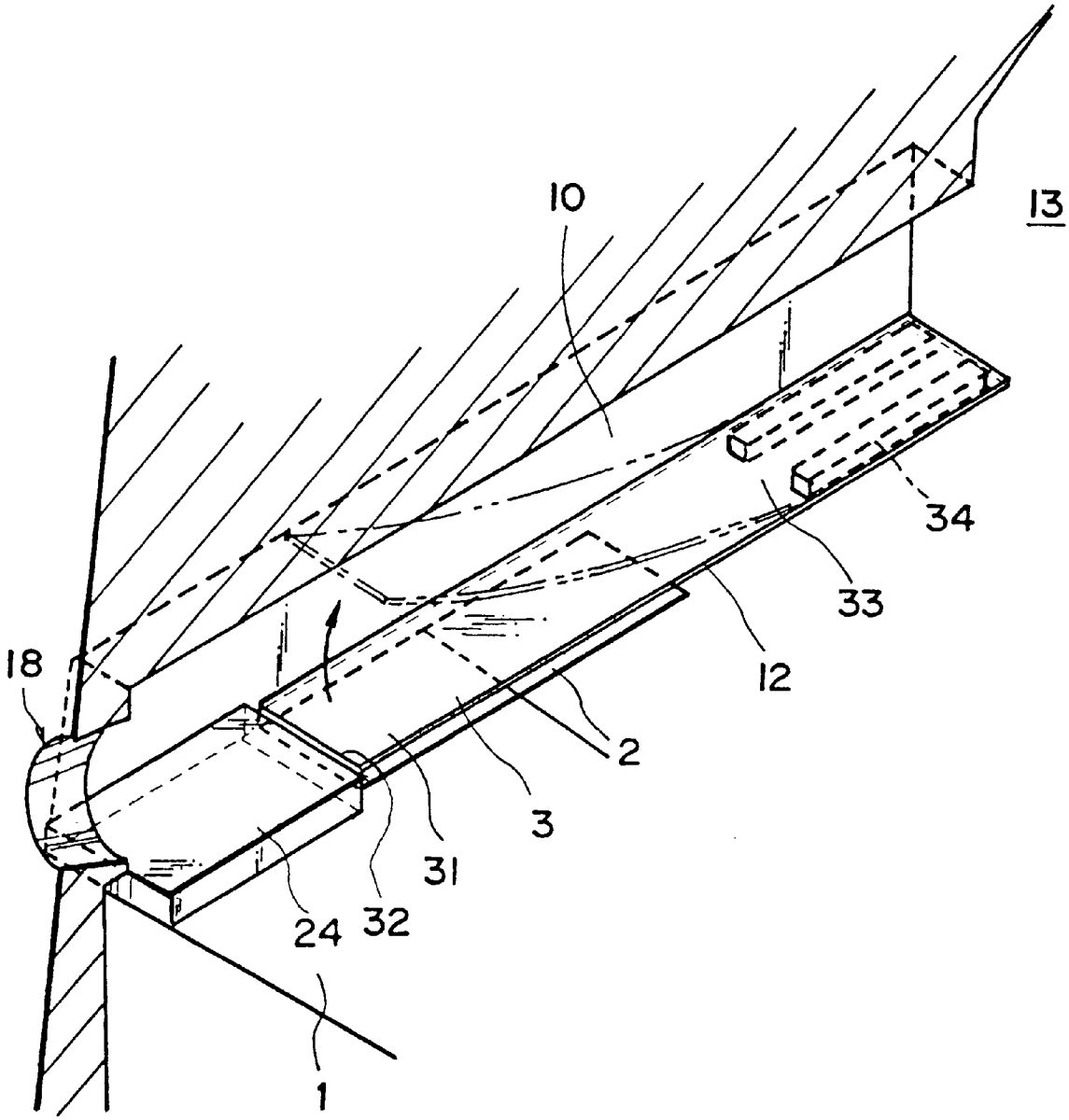
FIG. 2 is a partly broken perspective view of a liquid ejecting head according to an embodiment of the present invention.

FIG. 1 is a schematic sectional view of a liquid ejecting head taken along a liquid flow path according to this embodiment, and FIG. 2 is a partly broken perspective view of the liquid ejecting head.

The liquid ejecting head of this embodiment comprises a heat generating element 2 (a heat generating resistor of 40 $\mu$m×105 $\mu$m in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No.

4,723,129. The bubble and the pressure caused by the generation of the bubble act mainly on the movable member, so that the movable member 31 moves or displaces to widely open toward the ejection outlet side about the fulcrum 33, as shown in FIGS. 1, (b) and (c) or in FIG. 2. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 3:
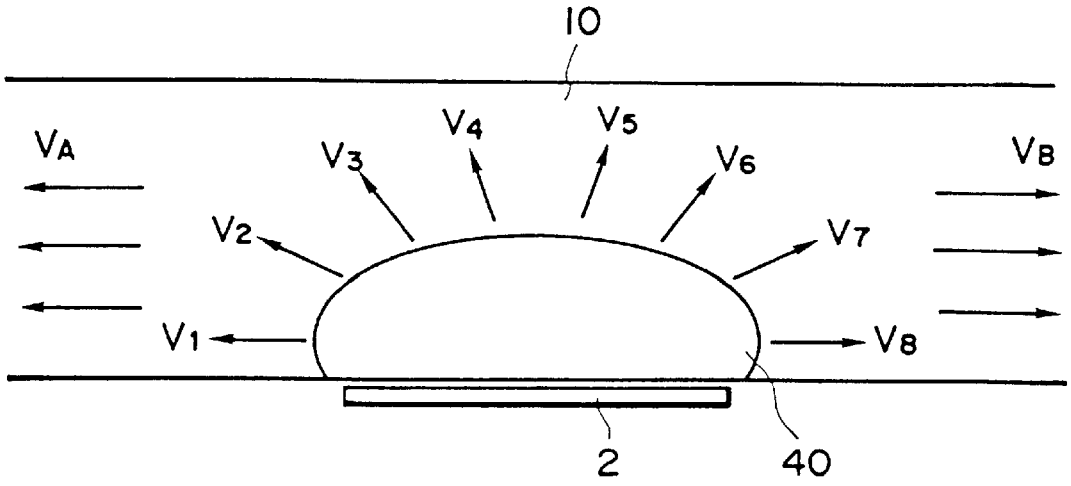
FIG. 3 is a schematic view showing pressure propagation from a bubble in a conventional head.
Figure 4:
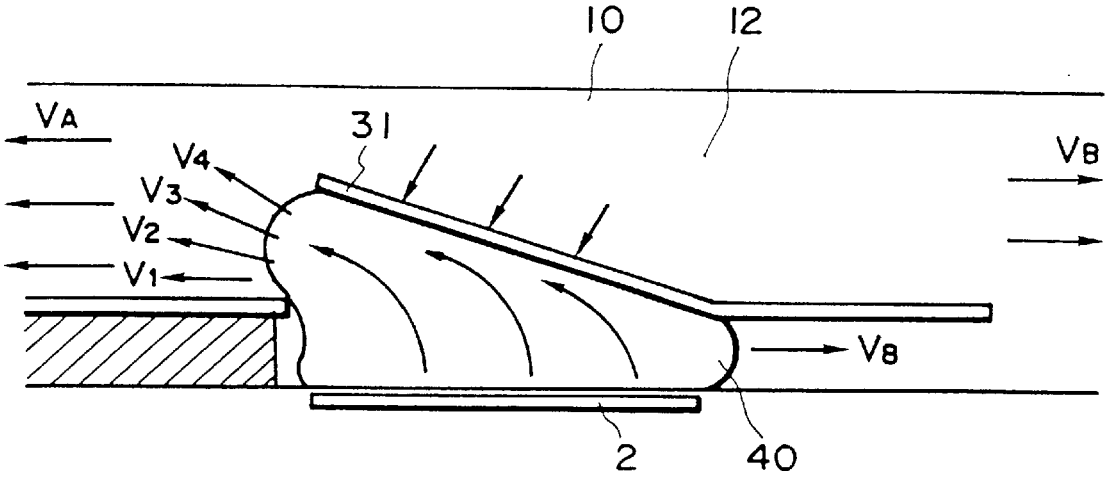
FIG. 4 is a schematic view showing pressure propagation from a bubble in a head according to an embodiment of the present invention.

More detailed description will be made with comparison between the conventional liquid flow passage structure not using the movable member (FIG. 3) and the present invention (FIG. 4). Here, the direction of propagation of the pressure toward the ejection outlet is indicated by $V_A$, and the direction of propagation of the pressure toward the upstream is indicated by $V_B$.

In a conventional head as shown in FIG. 3, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 1, the ejecting operation of the liquid ejecting head in this embodiment will be described in detail.

FIG. 1, (a) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 1, (b) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (c) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (c) shows a state in which the bubble 40 has further grown. by the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (d) shows the bubble 40 contracting and extinguishing by the decrease of the internal pressure of the bubble after the film boiling.

The movable member 31 having been displaced to the second position returns to the initial position (first position) of FIG. 2, (a) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_C$ so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid. now, the description will be made as to the refilling of the liquid in the liquid ejecting head of the present invention.

Referring to FIG. 1, liquid supply mechanism will be described.

When the bubble 40 enters the bubble collapsing process after the maximum volume thereof (Figure, (c)), a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 1. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 5:
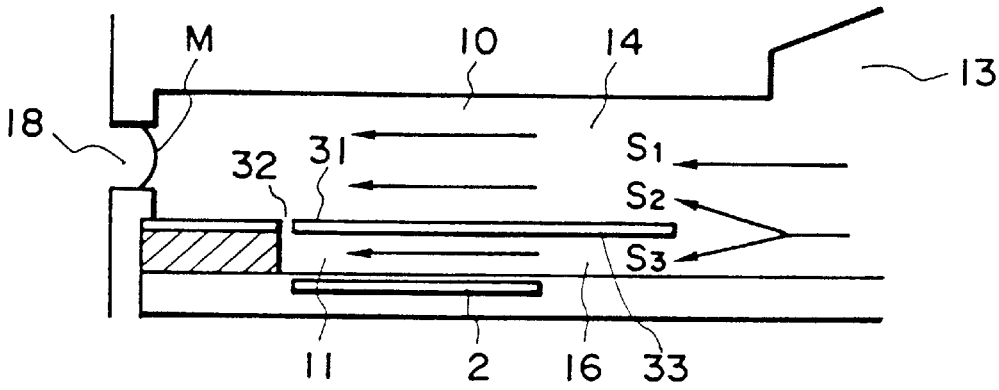
FIG. 5 is a schematic view illustrating flow of liquid in an embodiment of the present invention.

The positional relation between the free end 32 and the fulcrum 33 of the movable member 31 is such that the free end is at a downstream position of the fulcrum as shown in FIG. 5, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 5, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

<Embodiment 2>

Figure 6:
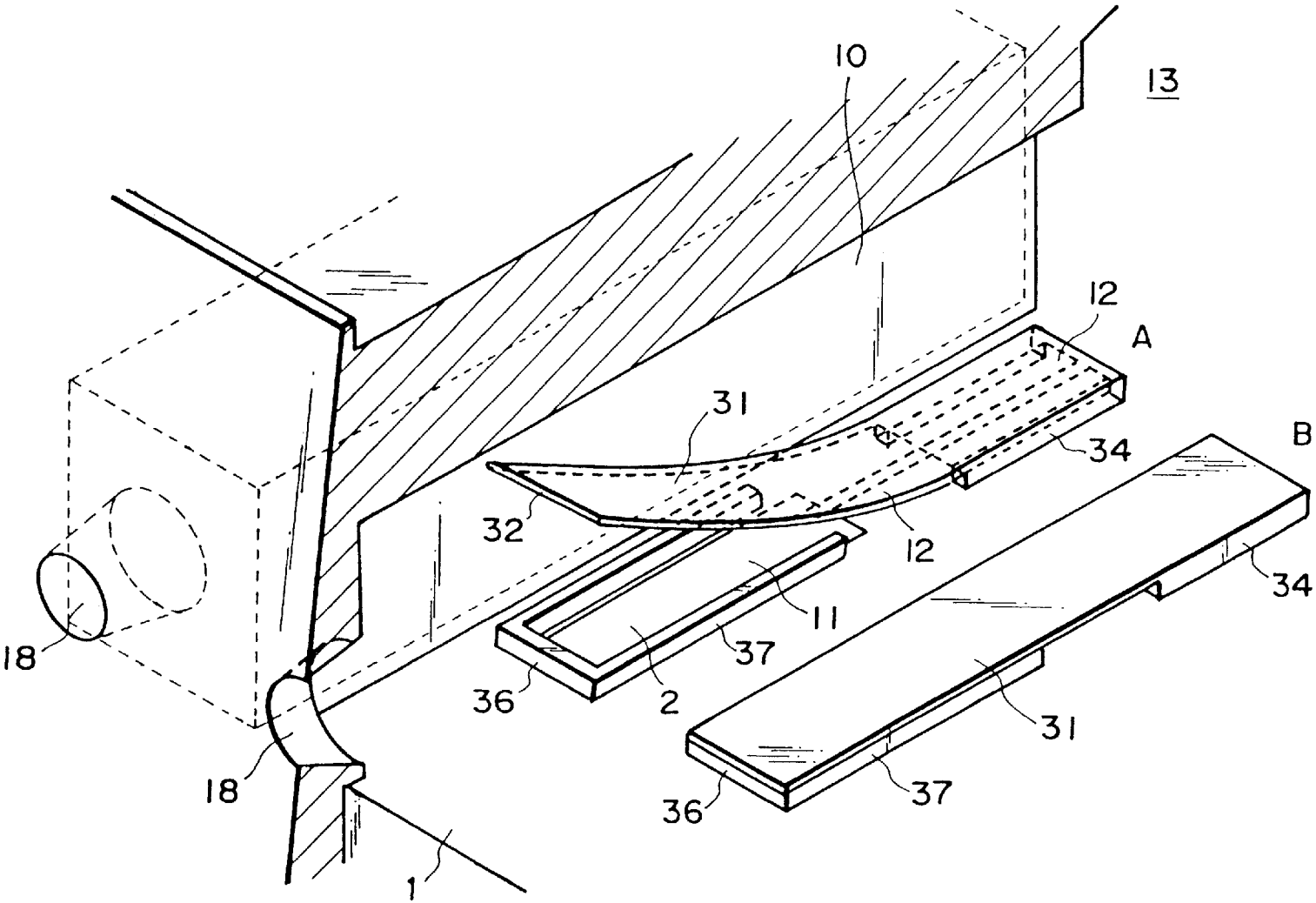
FIG. 6 is a partly broken perspective view of a liquid ejecting head according to a second embodiment of the present invention.

FIG. 6 shows a second embodiment. In FIG. 6, A shows a displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 2 and FIG. 6, and the foundation 34 has a width smaller than the liquid flow path 10 to supply the liquid to the liquid supply passage 12. The configuration of the foundation 34 is not limited to this structure, but may be anyone if smooth refilling is accomplished.

In this example, the clearance between the movable member 31 and the heat generating element 2 is 15 $\mu$m approx., but it may be different if the pressure produced by the bubble is sufficiently transmitted to the movable member.

Figure 7:
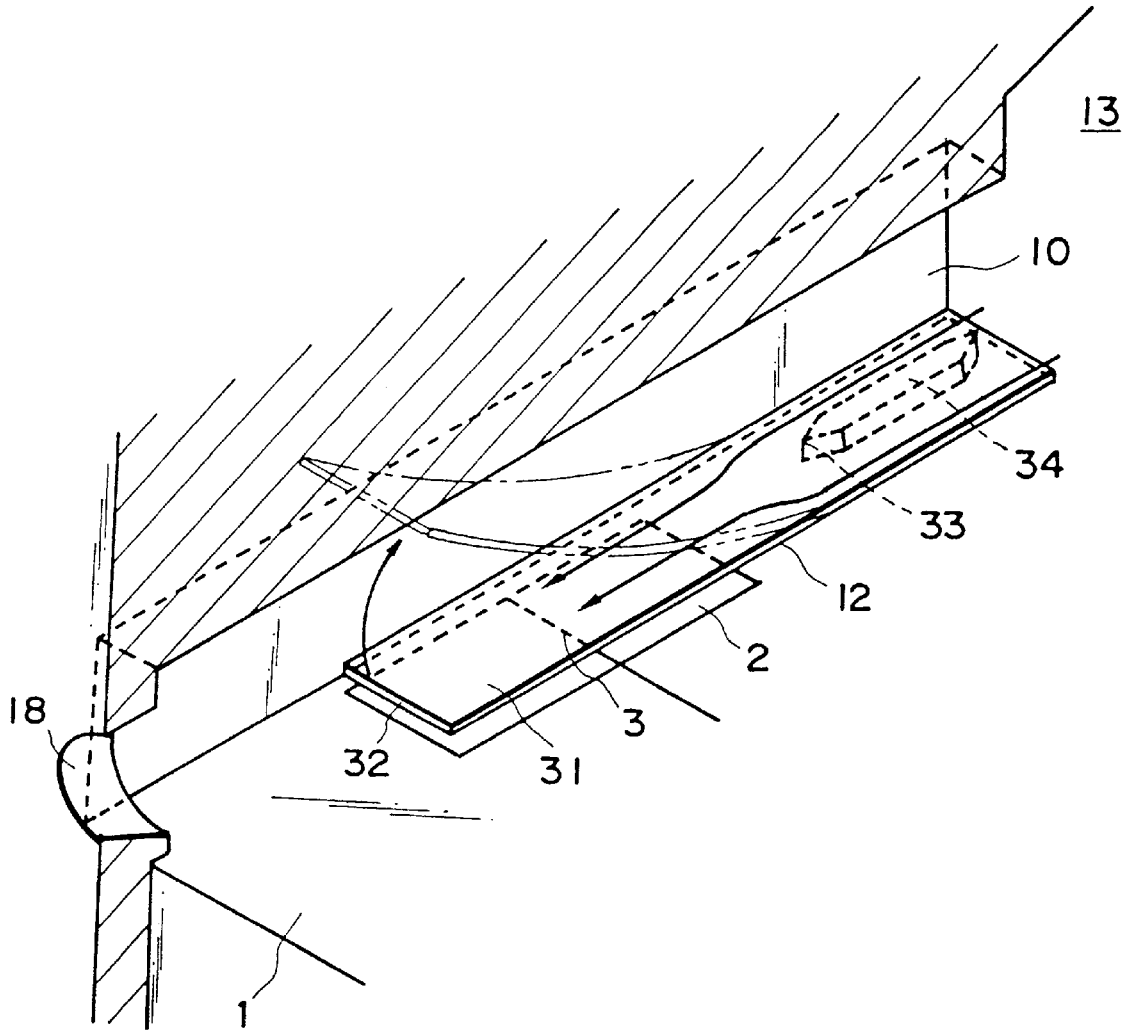
FIG. 7 is a partly broken perspective view of a liquid ejecting head according to a third embodiment of the present invention.

FIG. 7 shows one of the fundamental aspects of the present invention. FIG. 7 shows a positional relation among a bubble generation region, bubble and the movable member in one liquid flow path to further describe the liquid ejecting method and the refilling method according to an aspect of the present invention.

In the above described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, the projection (hatched portion) functioning as a barrier provided on the heat generating element substrate 1 of FIG. 2 is not provided in this embodiment. The free end region and opposite lateral end regions of the movable member do not substantially seal the bubble generation region relative to the ejection outlet region, but it opens the bubble generation region to the ejection outlet region, in this embodiment.

In this embodiment, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

The structure of this embodiment is simple, and therefore, the manufacturing is easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third midification, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

Figure 8:
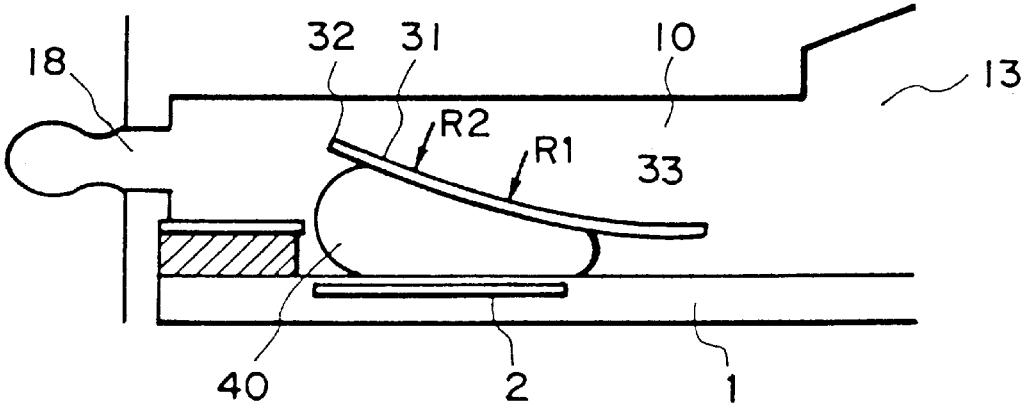
FIG. 8 is a sectional view of a liquid ejecting head according to a fourth embodiment of the present invention.

In the following embodiment, the ejection force for the liquid by the mechanical displacement is further improved. FIG. 8 is a cross-sectional view of this embodiment. In FIG. 8, the movable member is extended such that the position of the free end of the movable member 31 is positioned further downstream of the heat generating element. By this, the displacing speed of the movable member at the free end position is further increased, so that the generation of the ejection pressure by the displacement of the movable member is further improved.

In addition, the free end is closer to the ejection outlet side than in the foregoing embodiment, and therefore, the growth of the bubble can be concentrated toward the stabilized direction, thus assuring the better ejection.

In response to the growth speed of the bubble at the central portion of the pressure of the bubble, the movable member 31 displaces at a displacing speed R1. the free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 7, the edge is vertical to the liquid flow, by which the pressure of the bubble and the mechanical function of the movable member are more efficiently contributable to the ejection.

Figure 9A:
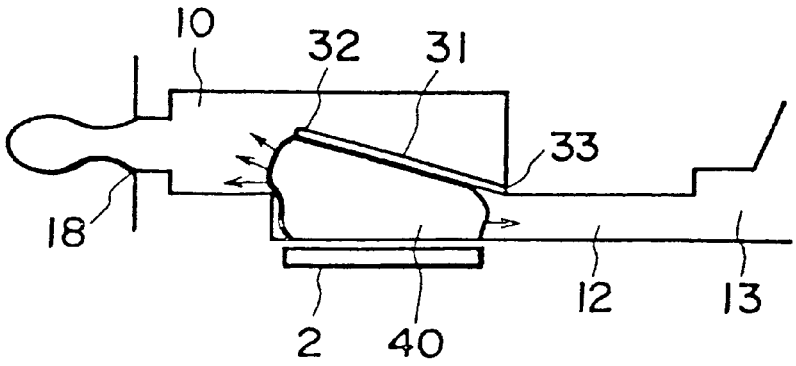
FIG. 9 is a schematic sectional view of a liquid ejecting head according to a fifth embodiment of the present invention.
Figure 9B:
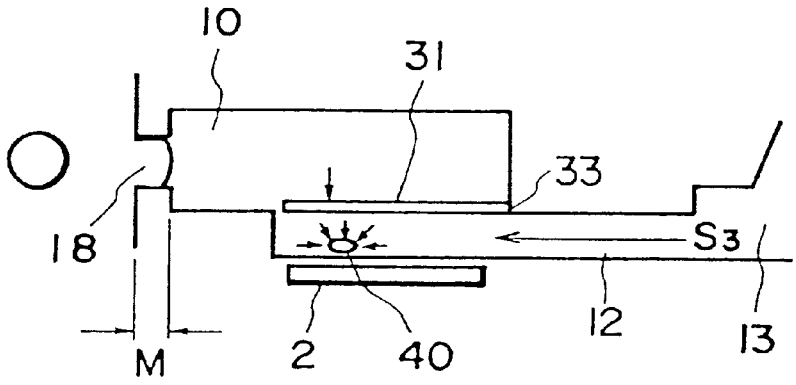
Figure 9C:
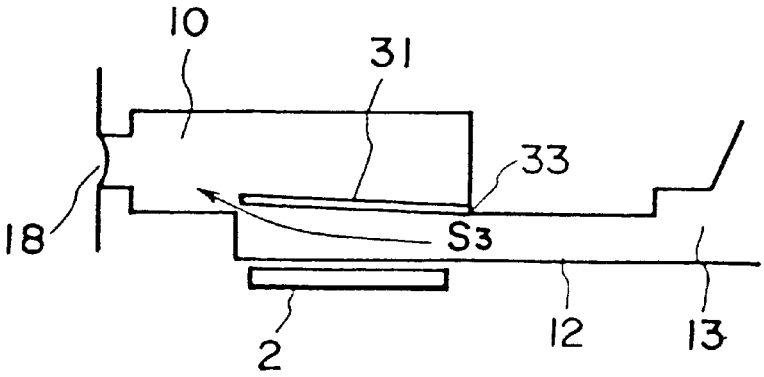

FIGS. 9, (a), (b) and (c) illustrate a fifth embodiment of ejection method of the present invention.

As is different from the foregoing embodiment, the region in direct communication with the ejection outlet is not in communication with the liquid chamber side, by which the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 9, (a) shows a state in which the bubble generation is caused by the heat generating element 2, and FIG. 9, (b) shows the state in which the bubble is going to contract. At this time, the returning of the movable member 31 to the initial position and the liquid supply by $S_3$ are effected.

In FIG. 9, (c), the small retraction M of the meniscus upon the returning to the initial position of the movable member, is being compensated for by the refilling by the capillary force in the neighborhood of the ejection outlet 18.

The description will be made as to another example.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 10:
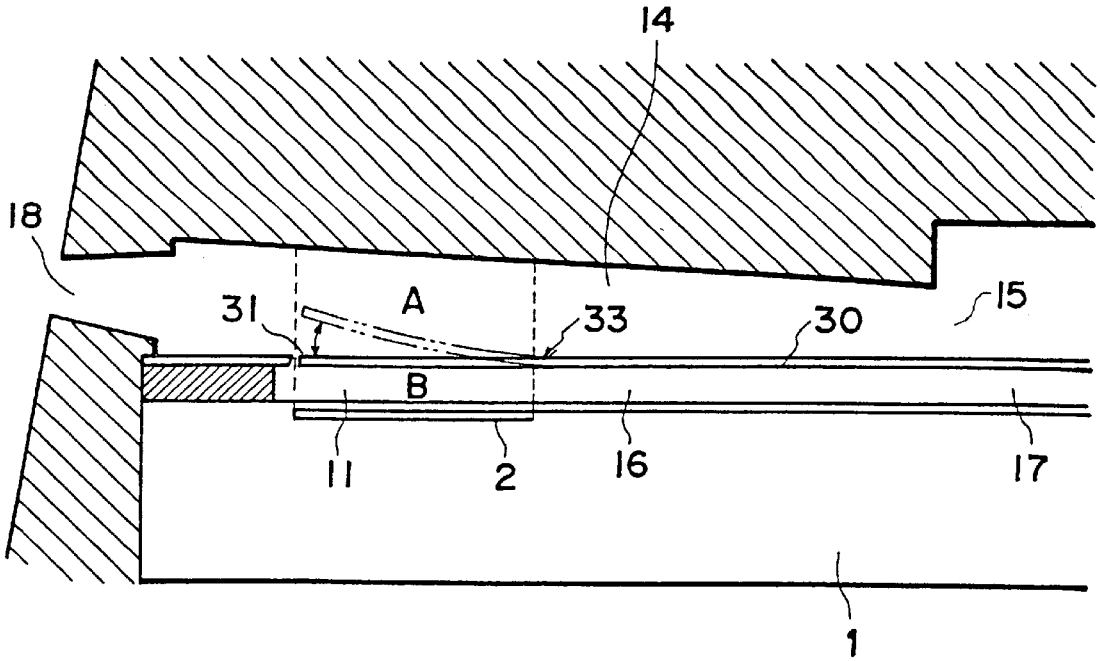
FIG. 10 is a sectional view of a liquid ejecting head (2 flow path) according to a sixth embodiment of the present invention.

FIG. 10 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 10), is in the form of a cantilever movable member 31, formed by slits 35, having a fulcrum 33 at the common liquid chamber (15, 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 11, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 12A:
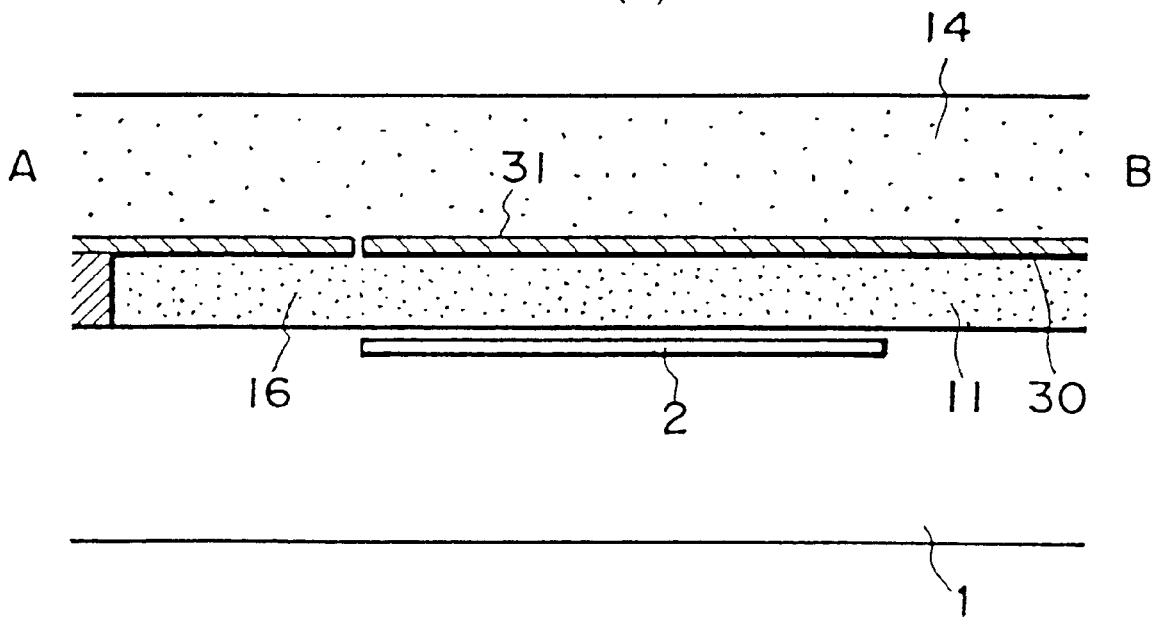
FIG. 12 illustrates an operation of a movable member.
Figure 12B:
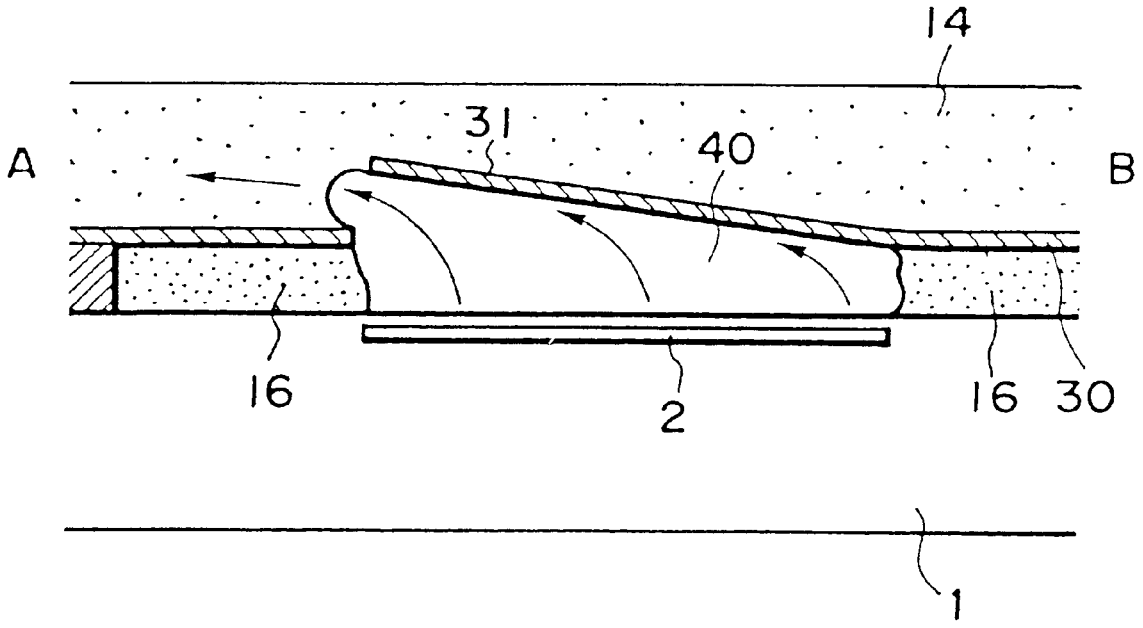

Referring to FIG. 12, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 12, (a) toward the first liquid flow path side as indicated in FIG. 12, (b) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 12, (a), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). By doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

<Liquid Flow Path Ceiling Configuration>

Figure 13:
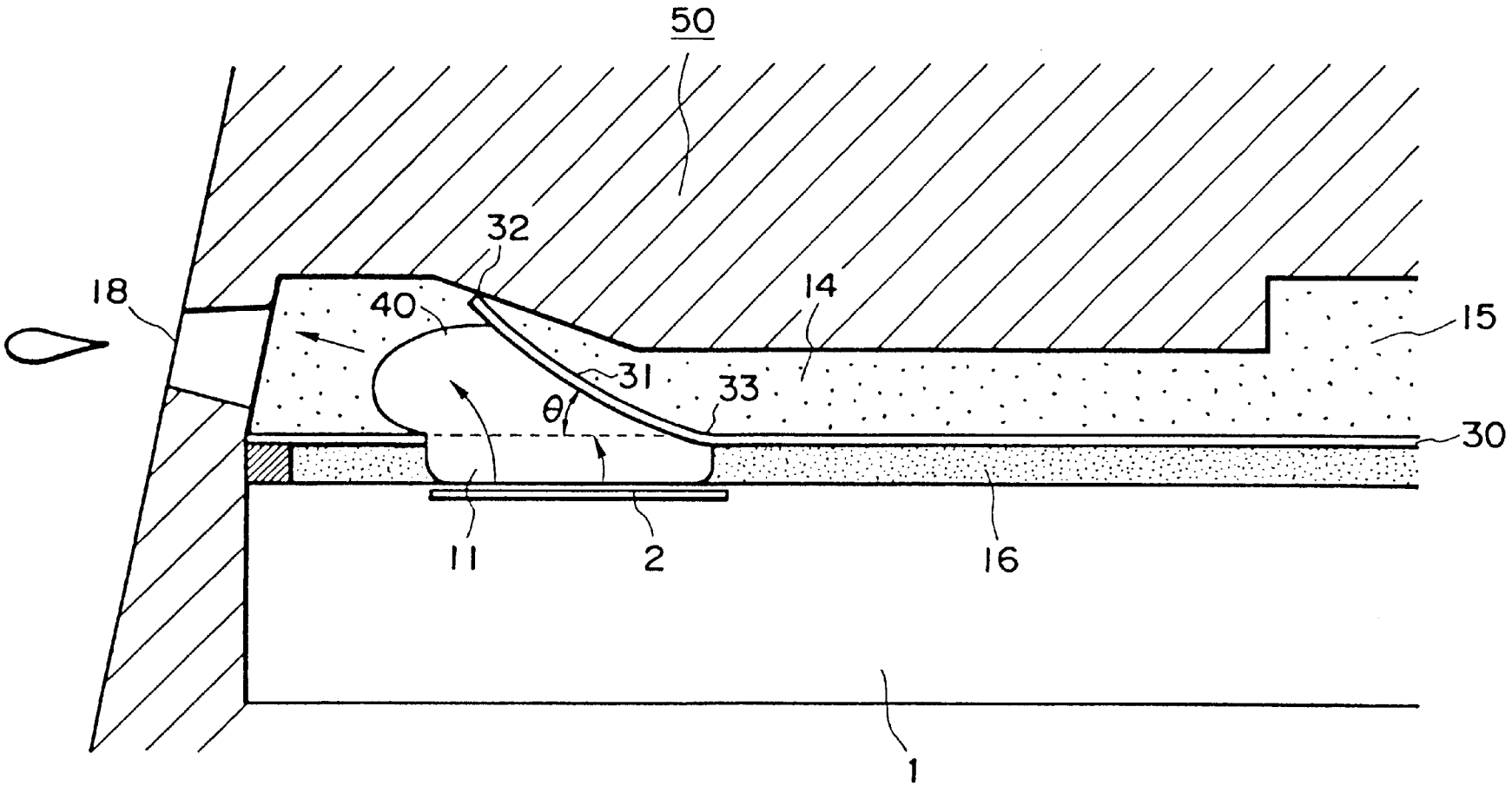
FIG. 13 illustrates a structure of a movable member and a first liquid flow path.

FIG. 13 is a sectional view taken along the length of the flow path of the liquid ejecting head according to the embodiment. Grooves for constituting the first liquid flow paths 14 (or liquid flow paths 10 in FIG. 1) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

<Positional Relation Between Second Liquid Flow Path and Movable Member>

Figure 14A:
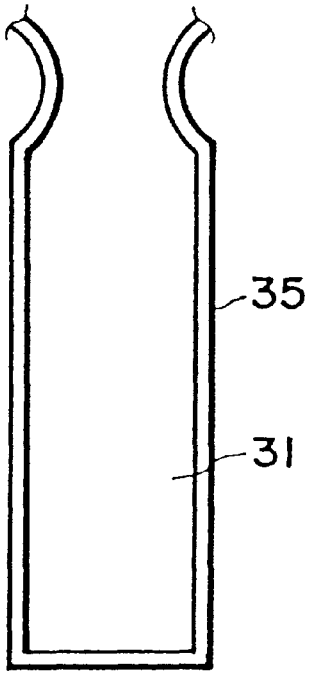
FIG. 14 illustrates a structure of a movable member liquid flow path.
Figure 14B:
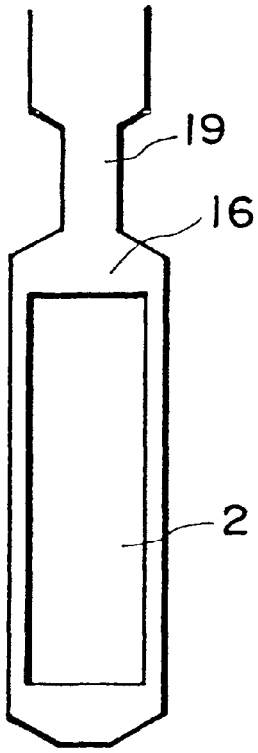
Figure 14C:
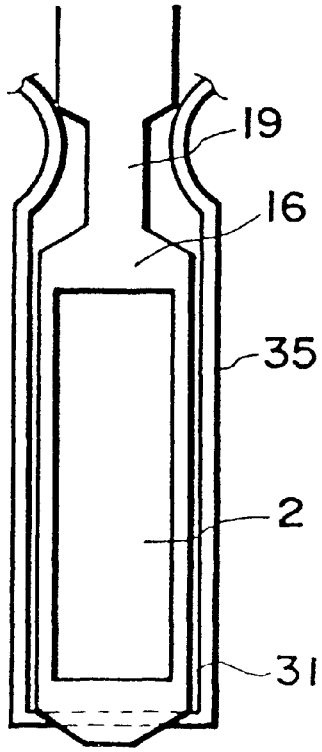

FIG. 14 is an illustration of a positional relation between the above-described movable member 31 and second liquid flow path 16, and (a) is a view of the movable member 31 position of the partition wall 30 as seen from the above, and (b) is a view of the second liquid flow path 16 seen from the above without partition wall 30. FIG. 14, (c) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several μm-ten and several μm, so that the release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 14, (c), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 12, (b) and FIG. 13, a part of the bubble generated in the bubble generation region of the second liquid flow path 4 with the displacement of the movable member 6 to the first liquid flow path 14 side, extends into the first liquid flow path 14 side. by selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several μm–30 μm, for example. In this example, the height is 15 μm.

<Movable Member and Partition Wall>

Figure 15A:
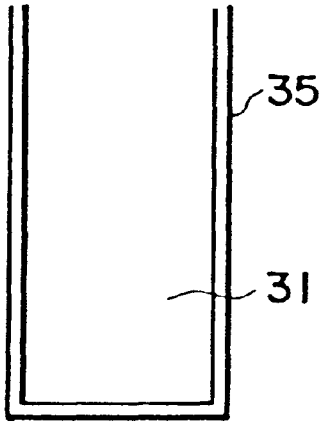
FIG. 15 illustrates another configuration of a movable member.
Figure 15B:
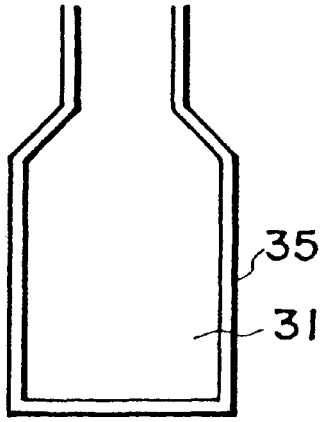
Figure 15C:
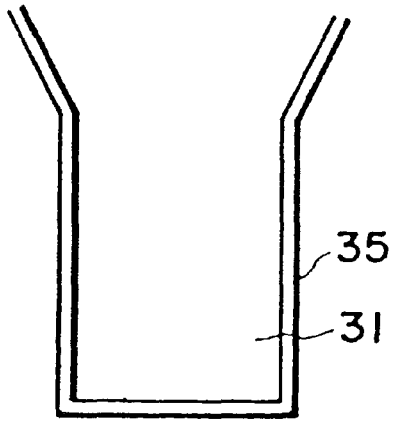
Figure 18:
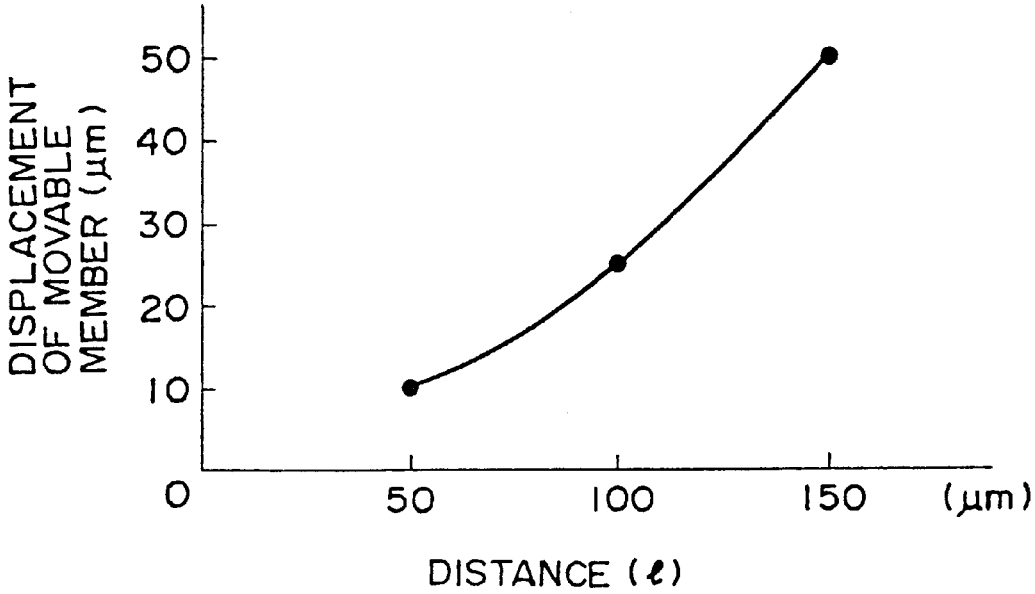
FIG. 18 shows a relation between a distance from an edge of a heat generating element to a fulcrum and a displacement of the movable member.

FIG. 15 shows another example of the movable member 31, wherein reference numeral 35 designates a slit formed in the partition wall, and the slit is effective to provide the movable member 31. In FIG. 15, (a), the movable member has a rectangular configuration, and in (b), it is narrower in the fulcrum side to permit increased mobility of the movable member, and in (c), it has a wider fulcrum side to enhance the durability of the movable member. The configuration narrowed and arcuated at the fulcrum side is desirable as shown in FIG. 14, (a), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower fro the bubble generation liquid and 20 CPS or lower for the ejection liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 12, 13 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

In the case that the bubble generation liquid and the ejection liquid are used as different function liquids, the movable member functions substantially as a partition or separation member between the liquids. When the movable member moves with the generation of the bubble, a small quantity of the bubble generation liquid may be introduced into the ejection liquid (mixture). Generally, in the ink jet recording, the coloring material content of the ejection liquid is 3% to 5% approx., and therefore, no significant density change results if the percentage of the bubble generation liquid mixed into the ejected droplet is not more than 20%. Therefore, the present invention covers the case where the mixture ratio of the bubble generation liquid of not more than 20%.

In the above-described structure, the mixing ratio of the bubble generation liquid was at most 15% even when the viscosity was changed. When the viscosity of the bubble generation liquid was not more than 5 cP, the mixing ratio was approx. 10% at the maximum, although it was dependent on the driving frequency.

When the viscosity of the ejection liquid is not more than 20 cP, the liquid mixing can be reduced (to not more than 5%, for example).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that the ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of kogation on the heat generating element, that is, the non-bubble-generation area S extends in the marginal area of the heat generating element. It is understood that the marginal approx. 4 $\mu$m width is not contributable to the bubble generation.

In order to effectively use the bubble generation pressure, it is preferable that the movable range of the movable member covers the effective bubble generating region of the heat generating element, namely, the inside area beyond the marginal approx. 4 $\mu$m width. In this embodiment, the effective bubble generating region is approx. 4$\mu$ and inside thereof, but this is different if the heat generating element and forming method is different.

FIG. 17 is a schematic view as seen from the top, wherein the use is made with a heat generating element 2 of 58×150 $\mu$m, and with a movable member 301, FIG. 17, (a) and a movable member 302, FIG. 17, (b) which have different total area.

The dimension of the movable member 301 is 53×145 $\mu$m, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 $\mu$m, and is larger than the area of the heat generating element 2 (the width dimension is the same, but the-dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid: Aqueous solution of ethanol (40%)

Ejection ink: dye ink

Voltage: 20.2 V

Frequency: 3 kHz

The results of the experiments show that the movable member 301 was damaged at the fulcrum when $1\times10^7$ pulses were applied. The movable member 302 was not damaged even after $3\times10^8$ pulses were applied. Additionally, the ejection amount relative to the supplied energy and the kinetic energy determined by the ejection speed, are improved by approx. 1.5–2.5 times.

From the results, it is understood that a movable member having an area larger than that of the heat generating element and disposed to cover the portion right above the effective bubble generating region of the heat generating element, is preferable from the standpoint of durability and ejection efficiency.

Figure 19:
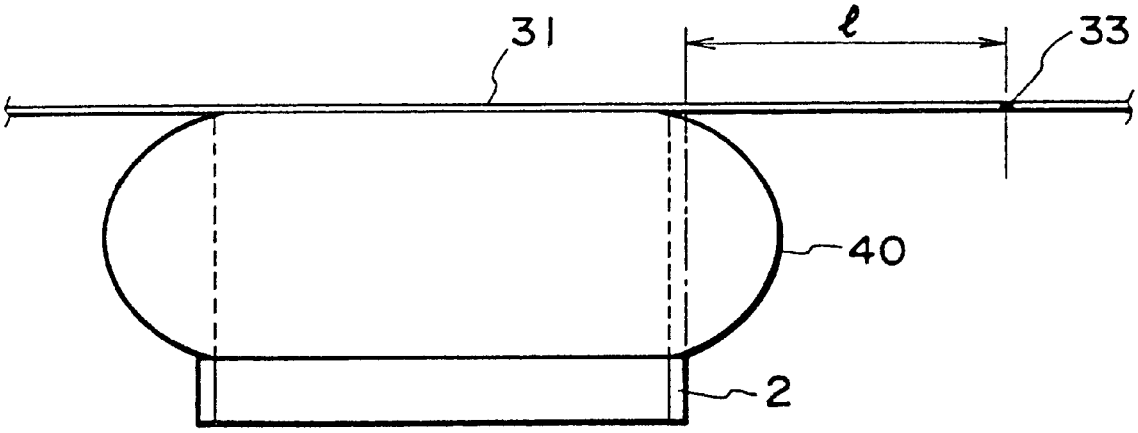
FIG. 19 illustrates a positional relation between a heat generating element and a movable member.
Figure 20A:
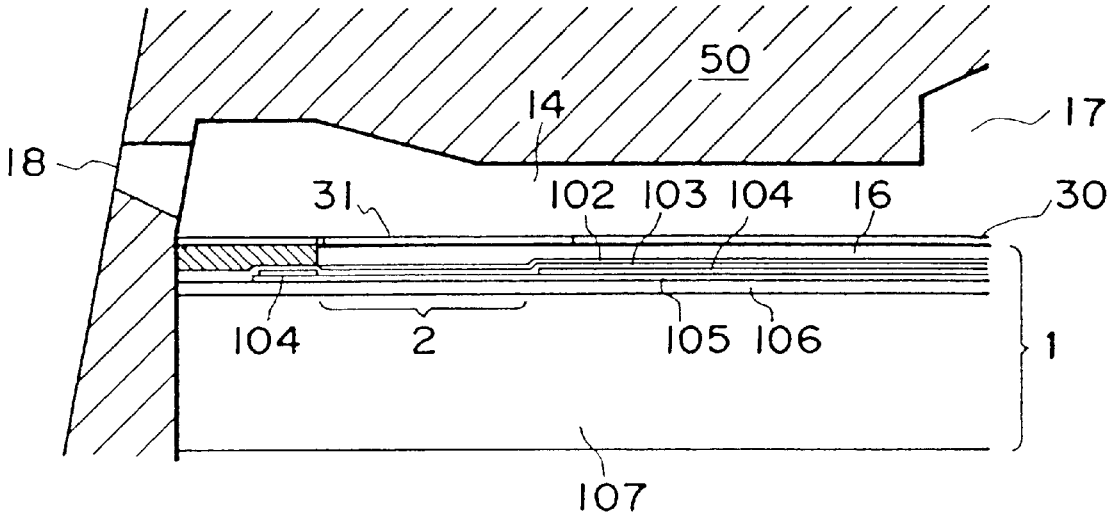
FIG. 20 is a longitudinal sectional view of a liquid ejecting head of the present invention.
Figure 20B:
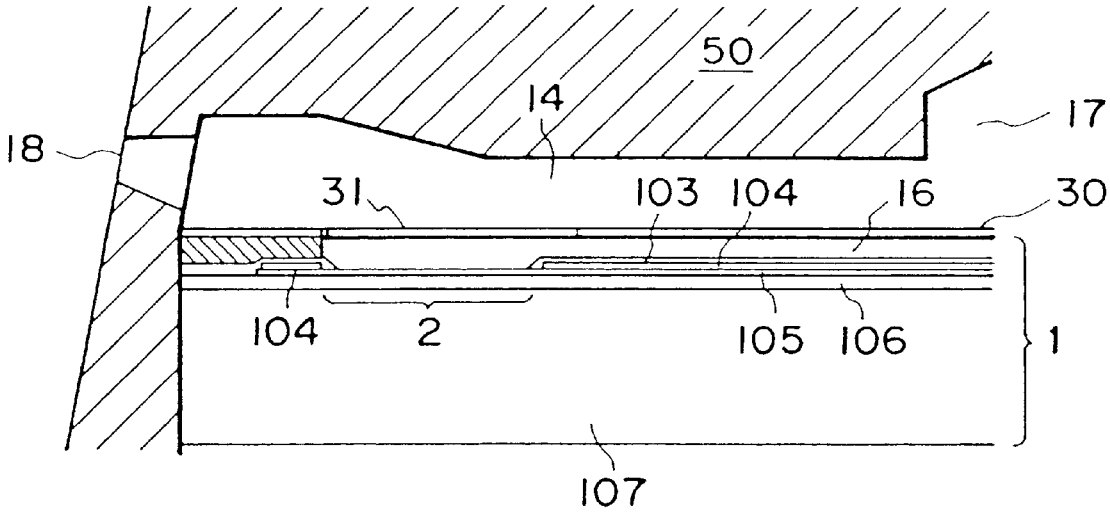

FIG. 19 shows a relation between a distance between the edge of the heat generating element and the fulcrum of the movable member and the displacement of the movable member. FIG. 20 is a section view, as seen from the side, which shows a positional relation between the heat generating element 2 and the movable member 31. The heat generating element 2 has a dimension of $40\times10^5$ $\mu$m. It will be understood that the displacement increases with increase with the distance of 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on.

When the fulcrum of the movable member is right above the effective bubble generating region of the heat generating element, the bubble generation pressure is directly applied to the fulcrum in addition to the stress due to the displacement of the movable member, and therefore, the durability of the movable member lowers. The experiments by the inventors have revealed that when the fulcrum is provided right above the effective bubble generating region, the movable wall is damaged after application of $1\times10^6$ pulses, that is, the durability is lower. Therefore, by disposing the fulcrum of the movable member outside the right above position of the effective bubble generating region of the heat generating element, a movable member of a configuration and/or a material not providing very high durability can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

<Element Substrate>

The description will be made as to a structure of the element substrate provided with the heat generating element for heating the liquid.

FIG. 20 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

Figure 11:
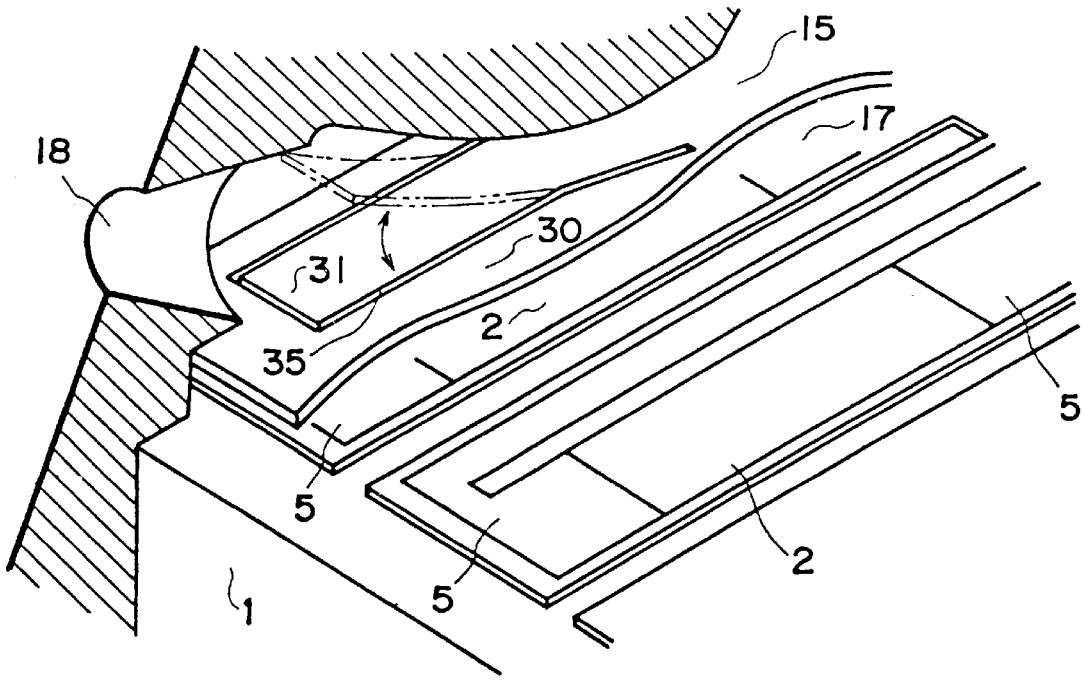
FIG. 11 is a partly broken perspective view of a liquid ejecting head according to a sixth embodiment of the present invention.

The element substrate 1 has, as shown in FIG. 11, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 4, (b). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 21:
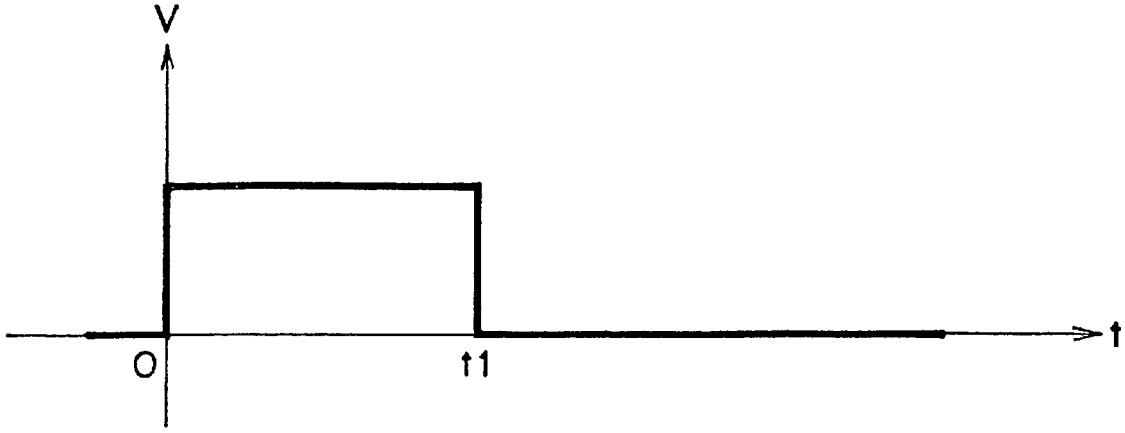
FIG. 21 is a schematic view showing a configuration of a driving pulse.

In order to eject the liquid by driving the heat generation portion of the electrothermal transducer on the above-described element substrate 1, the resistance layer 105 is supplied through the wiring electrode 104 with rectangular pulses as shown in FIG. 21 to cause instantaneous heat generation in the resistance layer 105 between the wiring electrode. In the case of the heads of the foregoing embodiments, the applied energy has a voltage of 24 V, a pulse width of 7 psec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Head Structure of 2 Flow Path Structure>

The description will be made as to a structure of the liquid ejecting head with which different liquids are separately accommodated in first and second common liquid chamber, and the number of parts can be reduces so that the manufacturing cost can be reduced.

Figure 22:
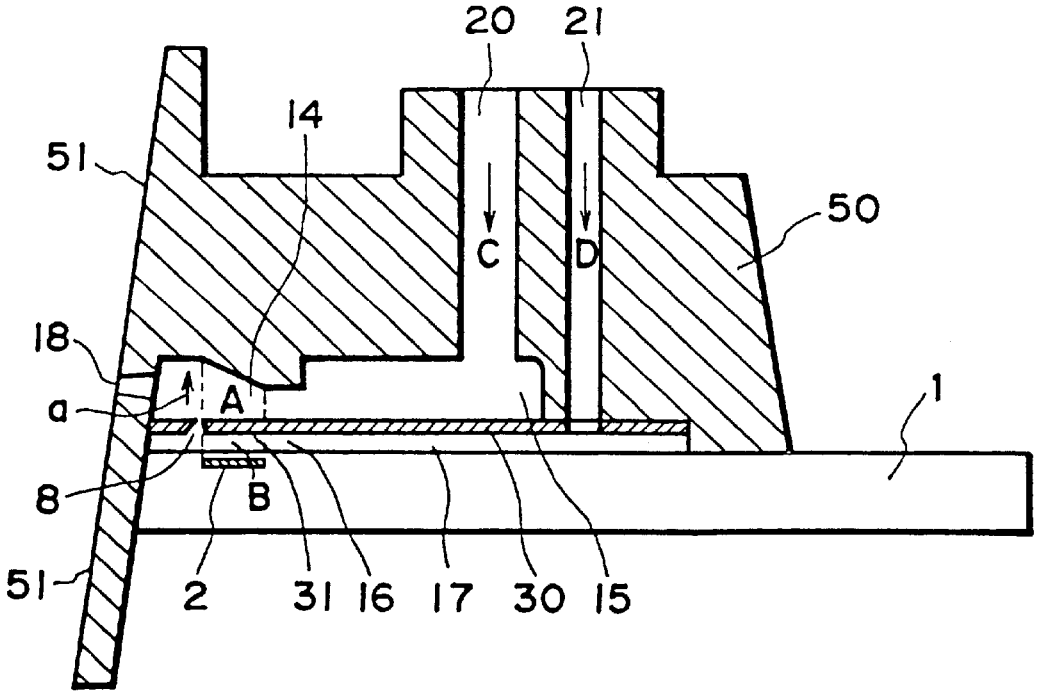
FIG. 22 is a sectional view illustrating a supply passage of a liquid ejecting head of the present invention.

FIG. 22 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 22, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 21.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 23:
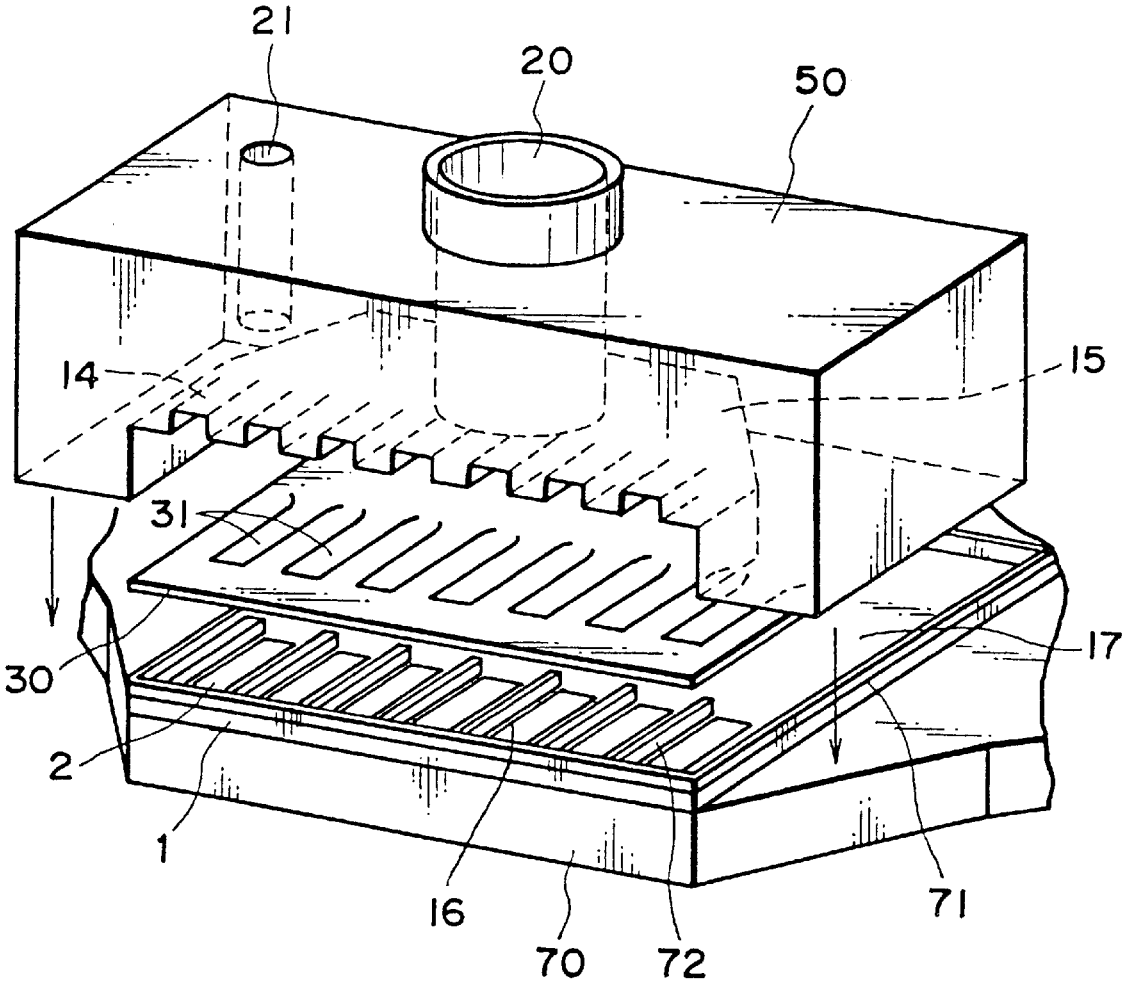
FIG. 23 is an exploded perspective view of a liquid ejecting head of the present invention.
Figure 24A:
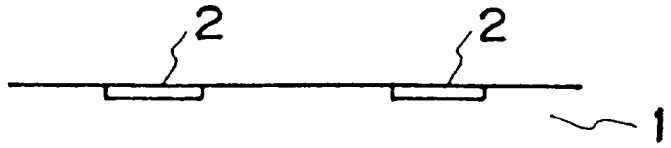
FIG. 24 is shows a diagram illustrating a manufacturing method of a liquid ejecting head in accordance with the liquid ejection principle of the present invention.
Figure 24B:
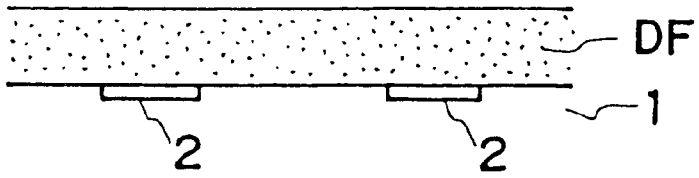
Figure 24C:
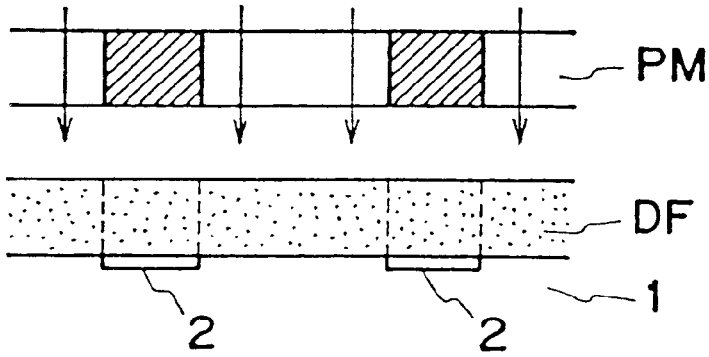
Figure 24D:
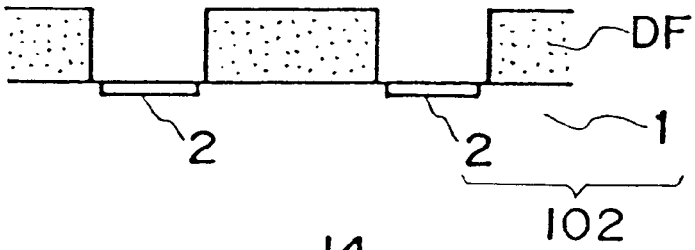
Figure 24E:
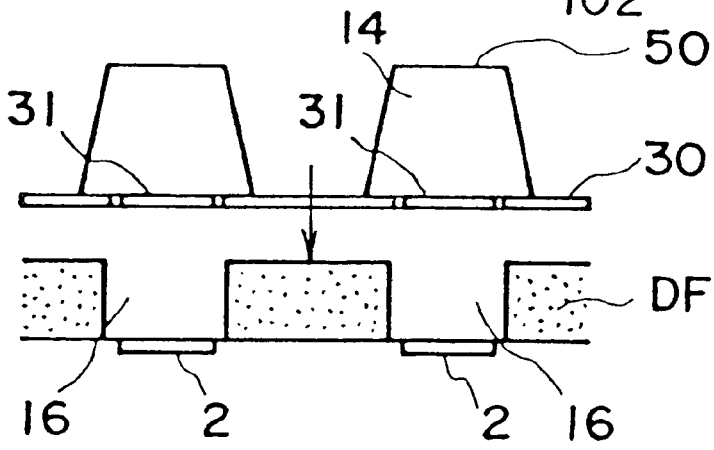
Figure 25A:
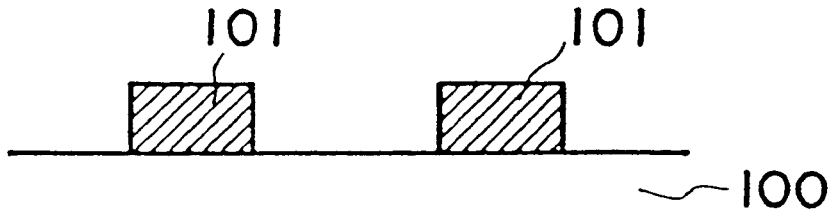
FIG. 25 is an illustration of a manufacturing method of a liquid ejecting head in accordance with the liquid ejection principle of the present invention.
Figure 25B:
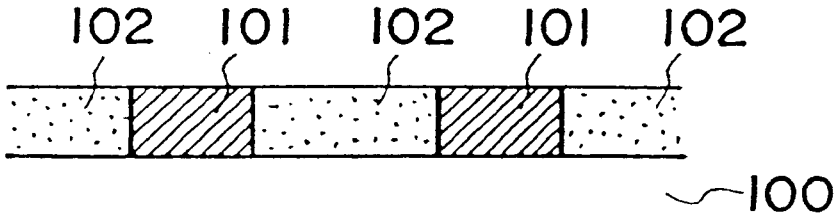
Figure 25C:
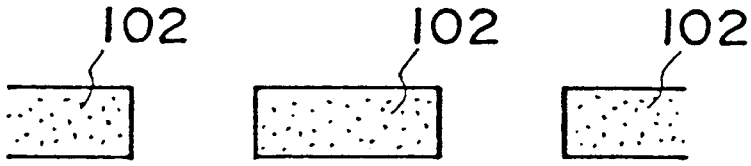
Figure 25D:
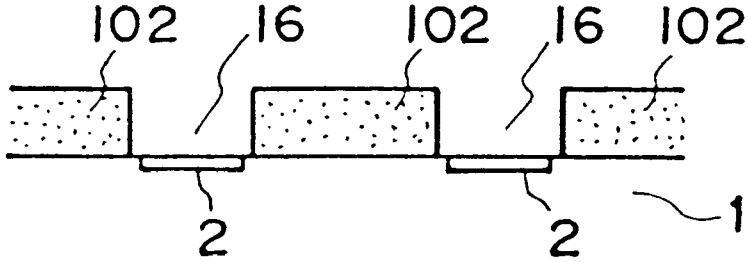
Figure 26A:
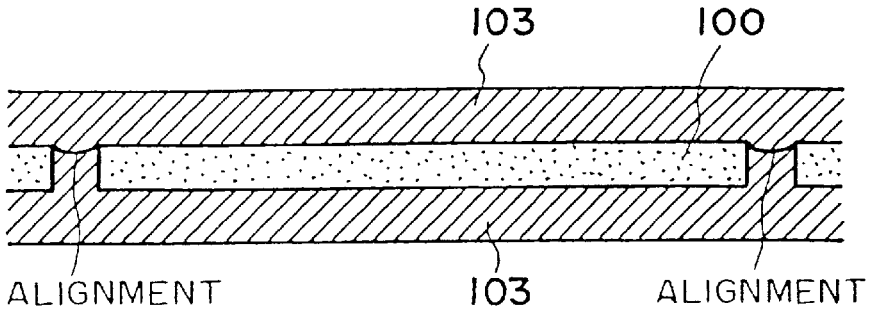
FIG. 26 is an illustration of a manufacturing method of a liquid ejecting head in accordance with the liquid ejection principle of the present invention.
Figure 26B:
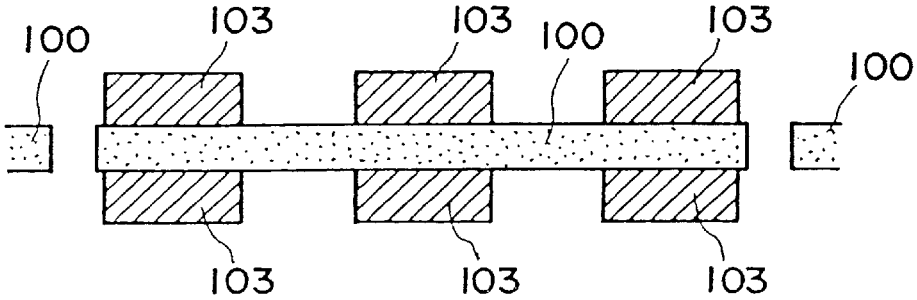
Figure 26C:
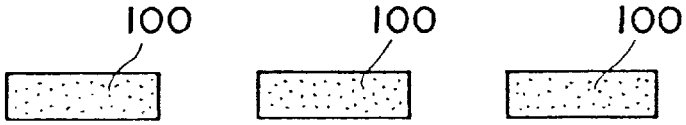
Figure 26D:
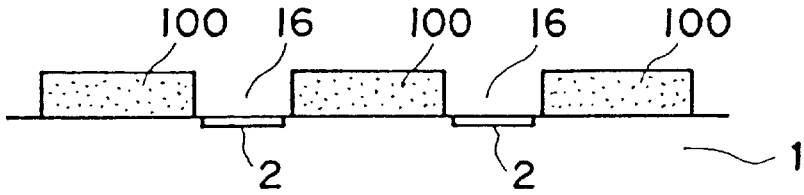

The second common liquid chamber 17 may be formed by dividing the grooved by a separation wall 30. As for the method of forming this, as shown in FIG. 23 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

<Ejection Liquid and Bubble Generation Liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n-n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded.

| Dye ink viscosity of 2cp: | |
|---|---|
| (C.I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

| Bubble generation liquid 1: | |
|---|---|
| Ethanol | 40 wt. % |
| Water | 60 wt. % |
| Bubble generation liquid 2: | |
| Water | 100 wt. % |

-continued

| | |
|---|---|
| Bubble generation liquid 3: | |
| Isopropyl alcoholic | 10 wt. % |
| Water | 90 wt. % |
| Ejection liquid 1: | |
| (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Manufacturing of Liquid Ejecting Head>

The description will be made as to the manufacturing step of the liquid ejecting head according to the present invention.

In the case of the liquid ejecting head as shown in FIG. 2, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substrate1 with the grooves and movable members aligned with each other.

The description will be made as to a manufacturing step for the liquid ejecting head having the two-flow-path structure as shown in FIG. 10 and FIG. 23.

Generally, walls for the second liquid flow paths 16 are formed on the element substrate1, and separation walls 30 are mounted thereon, and then, a grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

FIGS. 24, (a)–(e), is a schematic sectional view for illustrating a manufacturing method for the liquid ejecting head according to a first manufacturing embodiment of the present invention.

In this embodiment, as shown in FIG. 24, (a), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. Then, liquid comprising a silane coupling agent, for example, (A189, available from NIPPON UNICA) diluted by ethyl alcoholic to 1 weight % is applied on the improved surface by spin coating.

Subsequently, the surface is cleaned, and as shown in FIG. 24, (b), an ultraviolet radiation photosensitive resin film (dry film Ordyl SY-318 available from Tokyo Ohka Kogyo Co., Ltd.) DF is laminated on the substrate1 having the thus improved surface.

Then, as shown in FIG. 24, (c), a photo-mask PM is placed on the dry film DF, and the portions of the dry film DF which are to remain as the second flow passage wall is illuminated with the ultraviolet radiation through the photo-mask PM. The exposure process was carried out using MPA-600, available from, CANON KABUSHIKI KAISHA), and the exposure amount was approx. 600 $mJ/cm^2$.

Then, as shown in FIG. 24, (d), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) for approx. 90 sec, and it is exposed to ultraviolet radiation for 2 hours at 150° C. with the dose of 100 $mJ/cm_2$ to completely cure the exposed portions.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 by adhesive material (SE4400 available from Toray), FIG. 19. Then, the printed board 71 connected to the aluminum base plate 70 beforehand is connected with the heater board 1 by aluminum wire (not shown) having a diameter of 0.05 mm.

As shown in FIG. 24, (e), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater board 1 and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, massproduction at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. It is cured, and such portions going to be the second liquid flow paths are directly removed by eximer laser.

FIGS. 26, (a)–(d), is a schematic sectional view for illustration of a manufacturing method of the liquid ejecting head according to a second embodiment of the present invention.

In this embodiment, as shown in FIG. 26, (a), a resist 101 having a thickness of 15 $\mu$m is patterned in the shape of the second liquid flow path on the SUS substrate 100.

Then, as shown in FIG. 25, (b), the SUS substrate 20 is coated with 15 $\mu$m thick of nickel layer 102 on the SUS substrate 100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 100 already patterned is connected to the cathode, and the temperature of the plating solution is 50° C., and the current temperature is 5 A/cm$^2$.

Then, as shown in FIG. 25, (c), the SUS substrate 100 having been subjected to the plating is subjected then to ultrasonic vibration to remove the nickel layer 102 portions from the SUS substrate 100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 104 mounted thereto, and the printed board 7 and the aluminum wire (not shown) are connected to establish the electrical wiring. On such a heater board 1, the second liquid flow path provided through the foregoing process is fixed, as shown in FIG. 25, (d). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN), and with an ultraviolet radiation projecting device operated with the exposure amount of 100 mJ/cm$^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

FIGS. 25, (a)–(d), is a schematic sectional view for illustrating a manufacturing method of the liquid ejecting head according to a third embodiment of the present invention.

In this embodiment, as shown in FIG. 25, (a), the resist 31 is applied on both of the sides of the SUS substrate 100 having a thickness of 15 $\mu$m and having an alignment hole or mark 100*a*. The resist used was PMERP-AR900 available from Tokyo Ohka Kogyo Co., Ltd.

Thereafter, as shown in (b), the exposure operation was carried out in alignment with the alignment hole 100*a* of the element substrate 100, using an exposure device (MPA-600 available from CANON KABUSHIKI KAISHA, JAPAN) to remove the portions of the resist 103 which are going to be the second liquid flow path. The exposure amount was 800 mJ/cm$^2$.

Subsequently, as shown in (c), the SUS substrate 100 having the patterned resist 103 on both sides, is dipped in etching liquid (aqueous solution of ferric chloride or cuprous chloride) to etch the portions exposed through the resist 103, and the resist is removed.

Then, as shown in (d), similarly to the foregoing embodiment of the manufacturing method, the SUS substrate 100 having been subjected to the etching is positioned and fixed on the heater board1, thus assembling the liquid ejecting head having the second liquid flow paths 4.

According to the manufacturing method of this embodiment, the second liquid flow paths 4 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, massproduction is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

<Liquid Ejection Head Cartridge>

The description will be made as to a liquid ejection head cartridge having the liquid ejecting head of the foregoing example.

Figure 27:
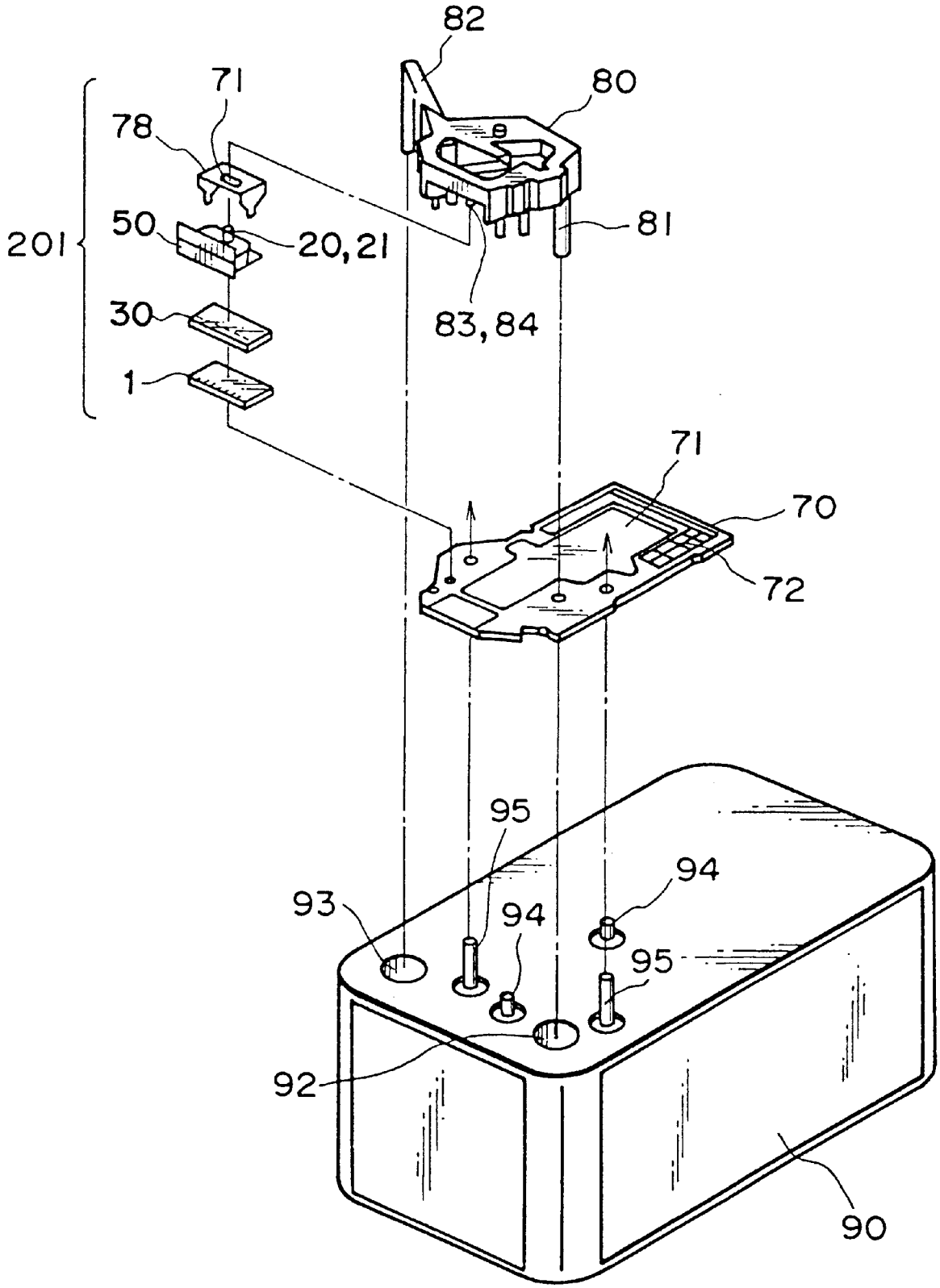
FIG. 27 is an exploded perspective view of a liquid ejection head cartridge.

FIG. 27 is a schematic exploded perspective view of a liquid ejection head cartridge including the above-described liquid ejecting head, and the liquid ejection head cartridge comprises generally a liquid ejecting head portion 201 and a liquid container 80.

The liquid ejecting head portion 201 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 84 of the connecting member from the ejection liquid supply passage 92 of the liquid container, and is supplied to a first common liquid chamber through the ejection liquid supply passages 83, 71 and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members. In such a liquid ejection head cartridge, even if the bubble generation liquid and the ejection liquid are different liquids, the liquids are supplied in good order. in the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and the liquid container may be integral with each other or separate from each other.

Embodiment 1 (Liquid Ejecting Apparatus)

Figure 28:
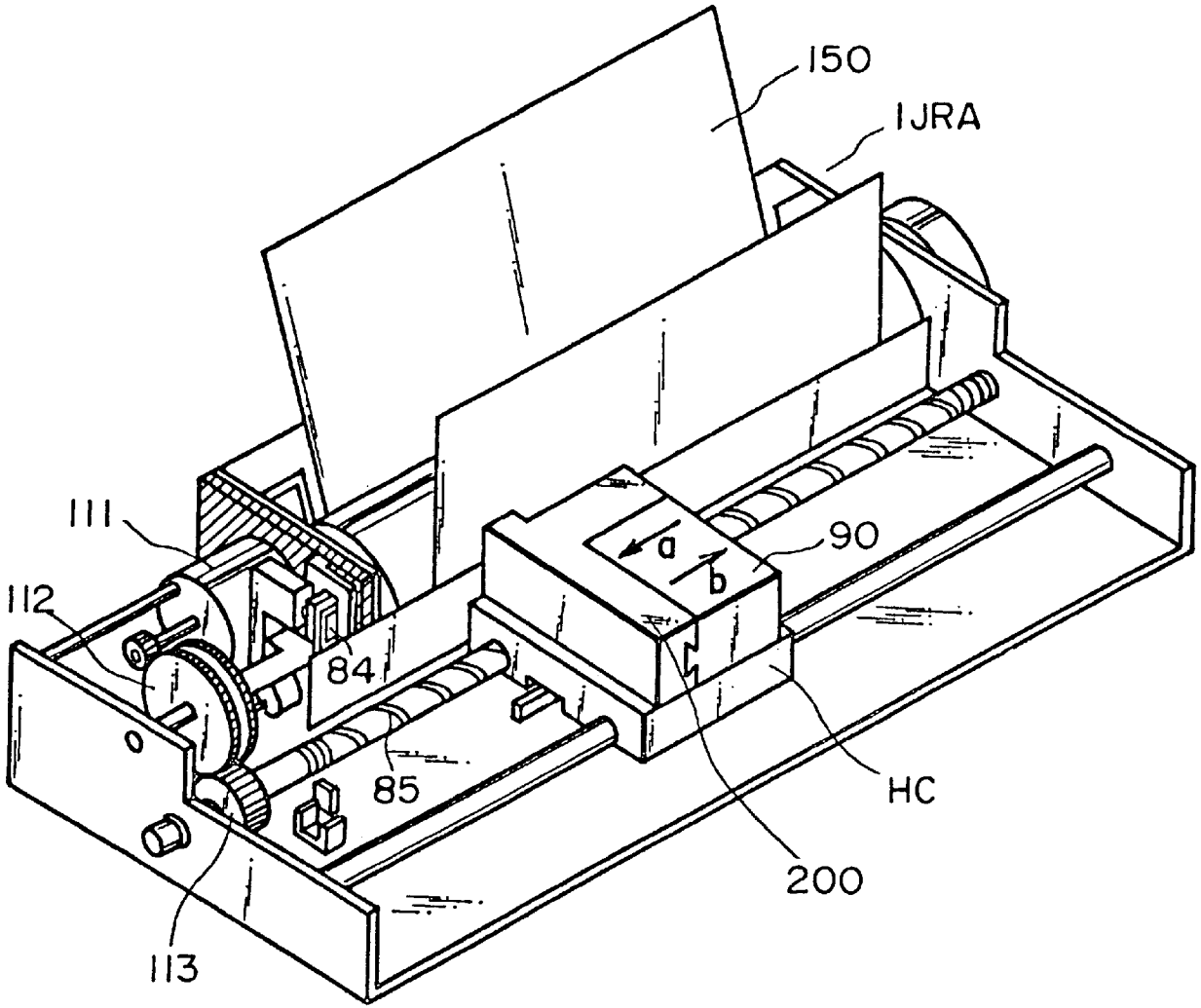
FIG. 28 is a schematic illustration of a liquid ejecting apparatus according to a first embodiment of the present invention.

FIG. 28 schematically show a structure of a liquid ejecting apparatus having the above-described liquid ejecting head 201. In this example, the ejection liquid is ink. The apparatus is an ink ejection recording apparatus. the liquid ejecting device comprises a carriage HC to which the head cartridge comprising a liquid container portion 90 and liquid ejecting head portion 201 which are detachably connectable with each other, is mountable. the carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head 201 in response to the signal.

The liquid ejecting apparatus of this embodiment comprises a motor 18 1 as a driving source for driving the recording material transporting means and the carriage, gears 18 2, 18 3 for transmitting the power from the driving source to the carriage, and carriage shaft 18 5 and so on. By the recording device and the liquid ejecting method, satisfactory print can be provided on various recording materials. When the liquid ejecting method is carried out for a long term or when the apparatus is left unused for a long term, it would be likely that the ejection outlet portions of the liquid ejecting head may be clogged by viscosity-increased ink, foreign matter or the like. Therefore, a suction recovery operation of the liquid ejecting head is carried out at predetermined timing before the clogging occurs. By the suction recovery operation, mixing of the two-liquids can be avoided even if the head is kept intact for a long term, when it uses ejection liquid and bubble generation liquid.

The suction recovery operation is carried out, after the carriage HC carrying the liquid ejecting head is moved in the direction indicated by arrow a to its home position H. More particularly, it is carried out by covering the front surface of the liquid ejecting head having the ejection outlets with a cap 84 of a suction recovery device which will be described hereinafter.

Embodiment 2

Figure 29:
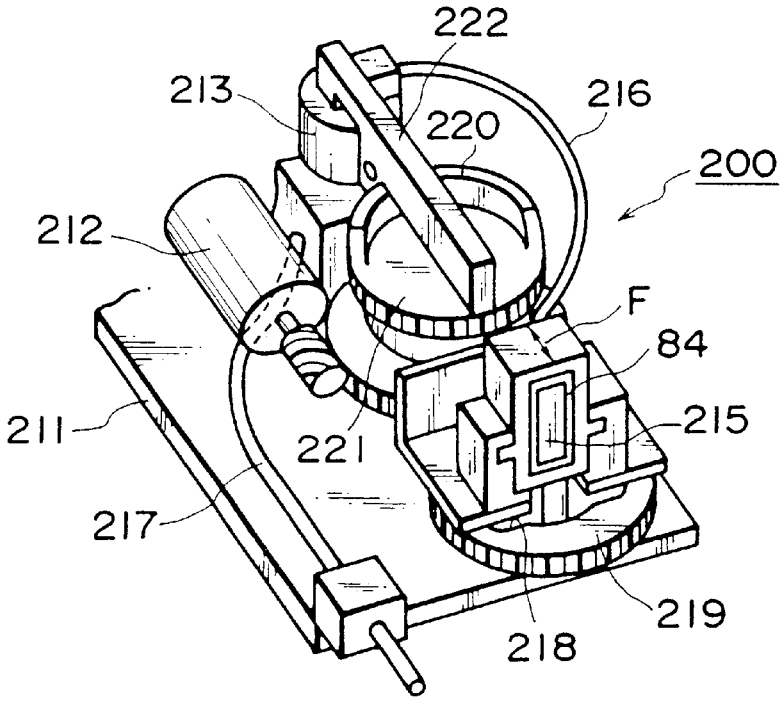
FIG. 29 is a perspective view showing a structure of an ink recovering device mountable to the liquid ejecting apparatus shown in FIG. 28.

FIG. 29 is a schematic perspective view showing an example of a suction recovery device usable with the liquid ejecting apparatus shown in FIG. 28.

Designated by reference numeral 200 is a suction recovery device used in FIG. 29. On a frame 211, there are provided a suction key 213 for producing the suction force and a motor 212 as a driving source for the suction key 213. To the frame 211, a cap 84 for being hermetically press-contacted to the liquid ejecting head, is supported for reciprocation in the directions arrow F in FIG. 29. The front side of the cap 84 (the surface to be press-contacted) is provided with an ink absorbing material 215 of porous material.

An inside of the cap 84 and the suction pump 213, are connected with each other by a suction tube 216, and a residual ink tube 217 is connected to a discharging side of the suction pump 213 to discharge the sucked ink. To the frame 211, there are rotatably mounted a cap driving gear 219 having an inner surface cam 218 for driving the cap 84 to and fro (directions indicated by an arrow F in FIG. 29), and a pump driving gear 221 having an end surface cam 220 for driving the suction pump 213, and the gears 219, 221 are driven through a gear train by a motor 212. A lever 222 is rotatably mounted between the pump driving gear 221 and the suction pump 213. When the pump driving gear 221 is rotated, the lever 222 is swung by the end surface cam 220, and the suction pump 213 is driven by the motion of the lever 222.

The entirety of the suction recovery device thus constructed is movable toward and away from the liquid ejecting head.

The refreshing operation by the ink suction is carried out, wherein the suction pump 213 is driven while the cap 84 is closely contacted to the liquid ejecting head located now at the home position, by which the ink is sucked out through the ejection outlet 18 from the ink supply system.

In the above-described liquid ejecting head, as shown in, FIG. 10, the separation wall 30 separates the liquid flow path 14 for the ejection liquid and the liquid flow path 16 for the bubble generation liquid, and by displacing the movable member 31 of the separation wall 30 into the first liquid flow path 14, the bubble generation liquid is flown into the first liquid flow path 14, and the liquid is discharged through the ejection outlet 18 in fluid communication with the first liquid flow path 14.

The recovery of the ejection power of the head by the liquid discharging from the liquid ejecting head carried out in accordance with the present invention, has the following main effects. First, the liquid in the liquid path in single liquid flow path structure is sucked out, or the liquids in the paths in the two-flow-path structure are simultaneously sucked out, through the ejection outlets, or they are pressurized, so that the viscosity-increased ink, foreign matter or the like which is liable to be deposited at the ejection outlet portion after long non-use period, can be efficiently removed, and the precipitated bubble in the liquid in the first liquid flow path can be efficiently removed. Secondly, in the case of two liquid structure (ejection liquid and the bubble generation liquid), the mixture of the two liquid can be prevented or eliminated quickly and effectively even if the the head are kept intact for a long term.

Embodiments 3 to 14 of suction recovery method and ejection head suitable therefor, and embodiments 15 and 16 of pressurizing recovery method, will be described. The above-described functional effects are provided in these embodiment, and therefore, the functional effects will not repeatedly stated for each of them.

Embodiment 3

Figure 30:
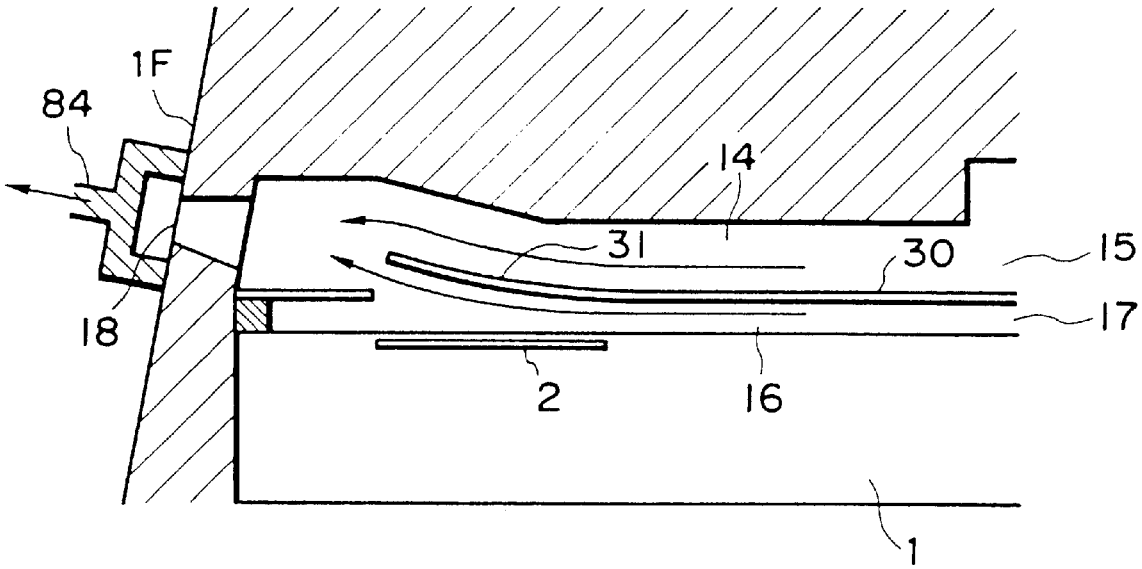
FIG. 30 is a sectional view illustrating a suction recovery method according to an embodiment in a liquid ejecting apparatus according to the present invention.
Figure 31:
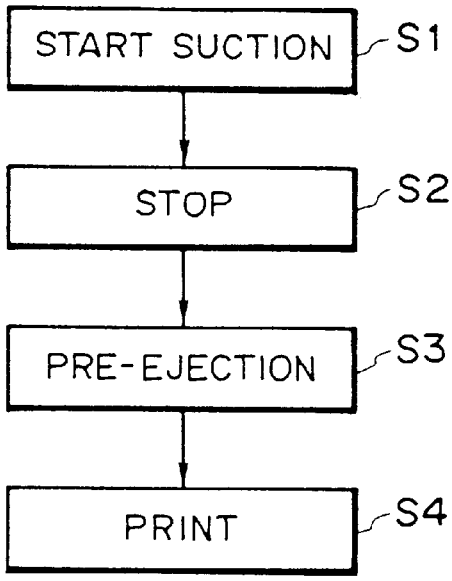
FIG. 31 is a flow chart of a suction recovery process in the embodiment shown in FIG. 30.

Referring to FIGS. 30 and 31, the description will be made as to another example of the suction recovery method.

In this example, one pump suction type ink recovering device is used for the liquid ejecting apparatus having the above-described structure, in the refreshing operation for both of the ejection liquid and the bubble generation liquid, which are simultaneously sucked.

FIG. 30 is a sectional view illustrating flows of the liquids in the case that the two-liquids are simultaneously sucked, and FIG. 31 is a flow chart illustrating the suction recovery method in this example.

As shown in, FIG. 11, the first liquid flow path 14 and the second liquid flow path 16 are in fluid communication with each other only through the slit 35 for forming the movable member 31. Normally, however, the formation of meniscus in the slit 35 is effective to prevent the mixture of the liquids.

Here, the ink recovering device 200 of a pump suction type as shown in FIG. 29, is driven to start the suction operation, while the cap 84 is closely contacted to the front surface of the liquid ejecting head to simultaneously cover the plurality of ejection outlets (S1 in FIG. 31). The suction operation is effected through the ejection outlets 18 in the front surface 1F, and the ejection liquid in the first liquid flow path 14 is sucked out, and the bubble generation liquid in the second liquid flow path 16 is also sucked out by the displacement of the movable member 31 into the first liquid flow path 14 by the suction pressure.

By the simultaneous suctions of the ejection liquid and the bubble generation liquid, the viscosity-increased ink deposited on the neighborhood of the ejection outlets and the precipitated bubble in the second liquid flow path, are simultaneously removed.

When the bubble generation liquid is the one containing less solute content as with pigment or dye, the neighborhood of the ejection outlets are cleaned by the bubble generation liquid by the suction discharging.

By making the same the flow resistances of the first liquid flow path 14 and the second liquid flow path 16 in the suction operation, it is assured that the two liquids are sucked out simultaneously.

Or, the suction amounts of the liquids can be made different using the static head difference. When the static head of the bubble generation liquid is higher than the static head of the ejection liquid at the time of the suction, the meniscus retentivity in the slit 35 is small, and the bubble generation liquid tends to be more sucked out. In this example, the liquid is supplied from the upstream through a tube not shown, and the static head for the suction recovery is changeable by adjusting the tube. By increasing the static head of the bubble generation liquid, the recovery of the second liquid flow path 16 is made easier without changing the refreshing operation using the cap. By this, the bubble removal from the bubble generation liquid is further made easier. It is liable that the bubble generation liquid remains adjacent to the ejection outlet of the first liquid flow path after such a refreshing operation. However, the mixed liquids can be ejected out easily by preliminary ejection effected before the printing operation (S4) after the completion of the suction recovery (S2 in FIG. 31), and then the ejection liquid is refilled toward the ejection outlet 18 so that the first liquid flow path 14 is filled with the ejection liquid.

In this example, the bubble generated in the second liquid flow path 16 can also be sucked out through the ejection outlet 18 at the time of the suction recovery operation, so that stabilized ejections are assured.

Embodiment 4

Figure 32:
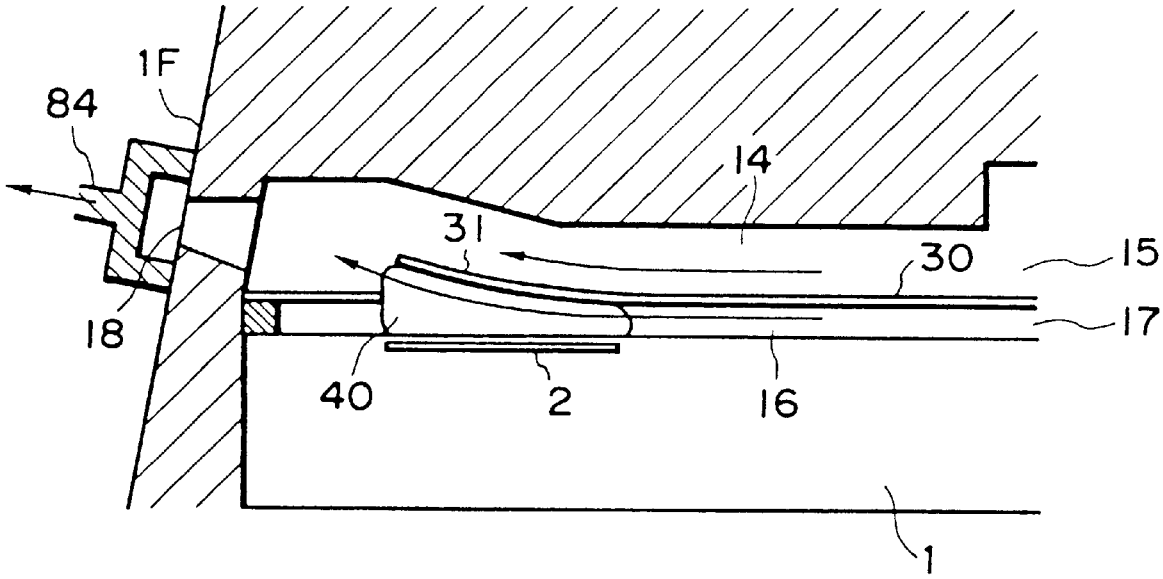
FIG. 32 is a sectional view illustrating a suction recovery method according to another embodiment in the liquid ejecting apparatus of the present invention.

Referring to FIGS. 32 and 33, the description will be made as to another embodiment of the suction recovery method.

In this example, the suction recovery is carried out while the heat generating means is driven to cause the bubble generation in the bubble generation liquid in the second liquid flow path 16 to displace the movable member into the first liquid flow path 14. In this example, similarly to the previous embodiment, both of the liquids are simultaneously sucked out, but the precipitated bubbles are further efficiently removed from the second liquid flow path since the movable member 31 is displaced and then the suction is carried out.

FIG. 32 is a sectional view illustrating the flows of the liquids in the case of the simultaneous displacement of the movable member and the suction recovery, and FIG. 33 is a flow chart illustrating the suction recovery method in this example.

In this example, the suction is effected while such a pulse as is enough for bubble generation is applied to the heat generating element 2 (S11 in FIG. 33) (S1) to effect the recovery operation for the second liquid flow path 16. When the pulse is stopped (S22), the movable member 31 restores the original position upon the collapse of bubble, and the ejection liquid is refilled toward the ejection outlet 18. Thus, the liquid and the bubble 40 are sucked out from the second liquid flow path 16, and the neighborhood of the ejection outlet 18 is filled with the refilled ejection liquid upon the suction completion (S2), thus accomplishing the stabilized ejection.

Embodiment 5

Figure 35:
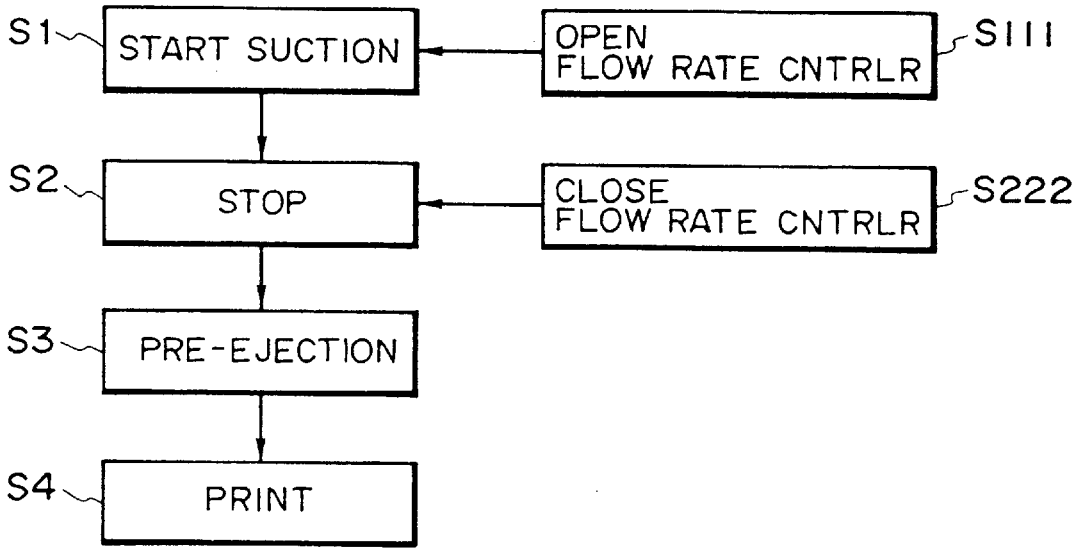
FIG. 35 is a flow chart showing a suction recovery process using the flow rate adjusting means shown in FIG. 34.

Referring to FIGS. 34 and 35, a further embodiment of the suction recovery method according to the present invention, will be described.

FIG. 34, (a) and (b) are top plan views showing an example of flow rate adjusting means, wherein (a) shows it under operation of the flow rate regulation thereof, and (b) shows under a released state.

In this example, a solenoid valve 47 as the flow rate adjusting means is provided in the inner wall of the flow path 46 between a common liquid chamber in fluid communication with the second liquid flow path and a container not shown connected with the common liquid chamber, and the flow rate is controlled by the solenoid valve 47 at the time of the suction recovery operation.

In this example, the solenoid valve 47 in the second liquid flow path is opened at the time of the suction recovery to release the flow rate regulation (S111 in FIG. 35), and suction is started. By the opening of the electromagnetic valve 47, the flow rate in the flow path 46 is increased, so that the bubble generation liquid becomes unable to maintain the meniscus which is effective to prevent the liquid mixing through the slit 35 around the movable member 31. Then, the movable member 35 is moved into the first liquid flow path 14 to permit discharge of the bubble generation liquid from the second liquid flow path. Thereafter, the solenoid valve 47 is closed, so that the flow rate is regulated (S222), and the suction is stopped (S2).

In this example, too, it is liable that the bubble generation liquid remains adjacent to the ejection outlet of the first liquid flow path after such a refreshing operation. However, the mixed liquids can be ejected out easily by preliminary ejection (S3) effected before the printing operation (S4) after the completion of the suction recovery, and then the ejection liquid is refilled toward the ejection outlet 18 so that the first liquid flow path 14 is filled with the ejection liquid.

In this example, the solenoid valve is opened at the time of the suction recovery operation, so that the discharge of the liquid is positively performed from the second liquid flow path. By opening the solenoid valve at the time of the suction recovery operation, the flow of the liquid in the second liquid flow path is suppressed or stopped to positively discharge the liquid from the first liquid flow path.

In this example, the solenoid valve was used as the flow rate adjusting means, but another means is usable if it is externally operated by electric power to assuredly control the flow rate of the liquid.

Embodiment 6

Figure 36:
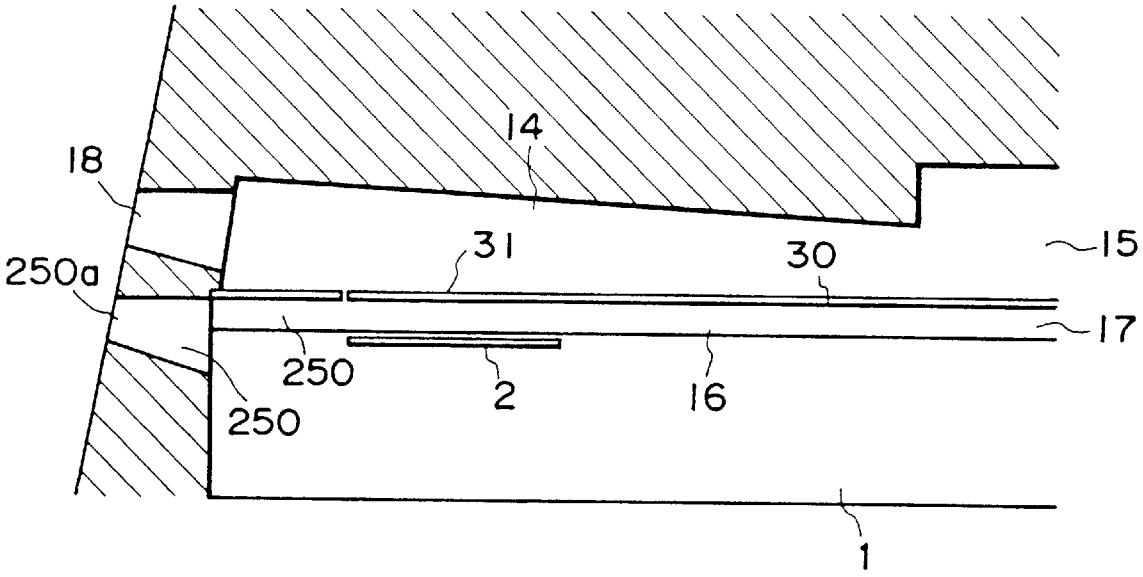
FIG. 36 is a sectional view of an ejection head in embodiment 6.
Figure 37:
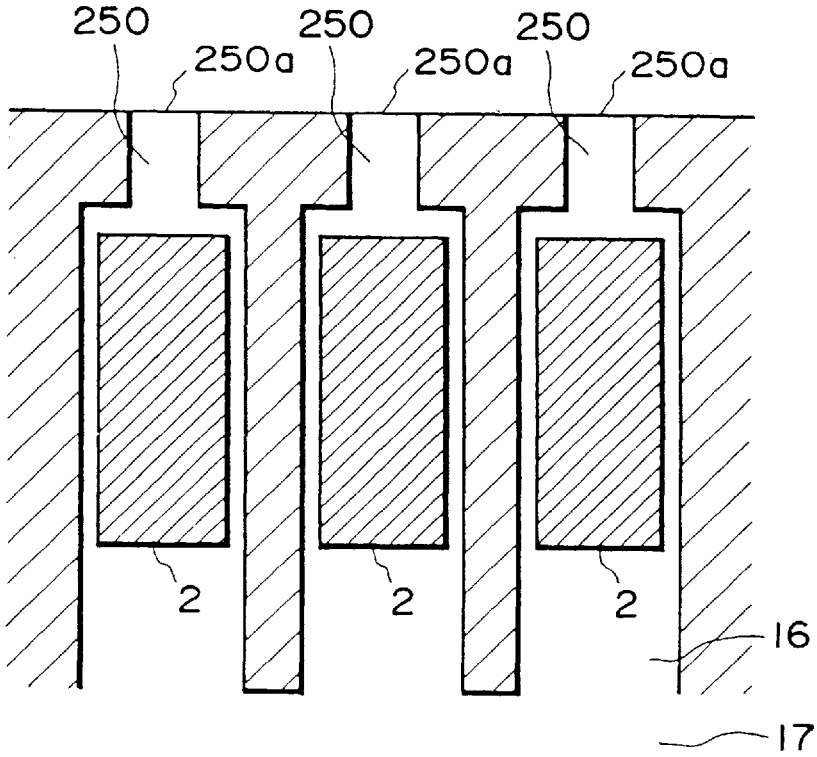
FIG. 37 is a top plan view of a second liquid flow path in embodiment 6.
Figure 38:
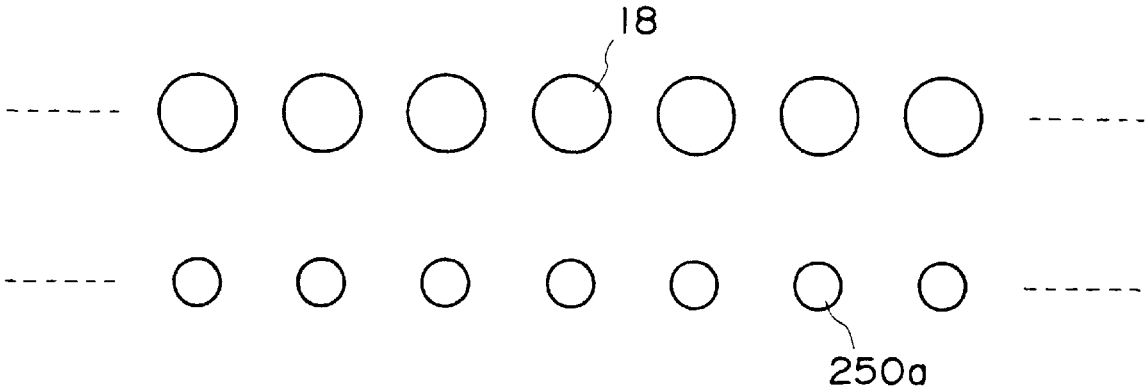
FIG. 38 is a schematic view of a major part of a front part of the head in embodiment 6.

FIG. 36 shows a section of an ejection head in this example 6. As shown in FIG. 36, there is provided a recovery lines 250 for the second liquid flow path, which connects the second liquid flow path 16 to the outside. FIG. 37 shows a structure of the second liquid flow path 16 in this example. The second liquid flow path recovery paths 250 is provided adjacent the ejection outlet 18. An outlets (openings, recovery openings) 250*a* for the recovery path 250 for the second liquid flow path, are provided below the ejection outlets 18 as shown in, FIG. 38. The recovery openings 250*a* are in the same surface as the ejection outlets 18, and are arranged on the line parallel with the line on which the ejection outlets 18 are arranged.

In the ejection head of this example, the bubble in the second liquid flow path 16 can be removed by sucking the liquid through the paths 250 and the recovery openings 250*a*, and the liquid is assuredly refilled to permit stabilized bubble generation.

In addition, since the ejection outlets 18 and the recovery openings 250*a* are in the same surface, the ejection liquid and the bubble generation liquid can be sucked simultaneously, so that the bubbles can be removed both from the first and second liquid flow paths 14 and 16. Therefore, the liquid is assuredly refilled to permit stabilized ejection.

Embodiment 7

Figure 39:
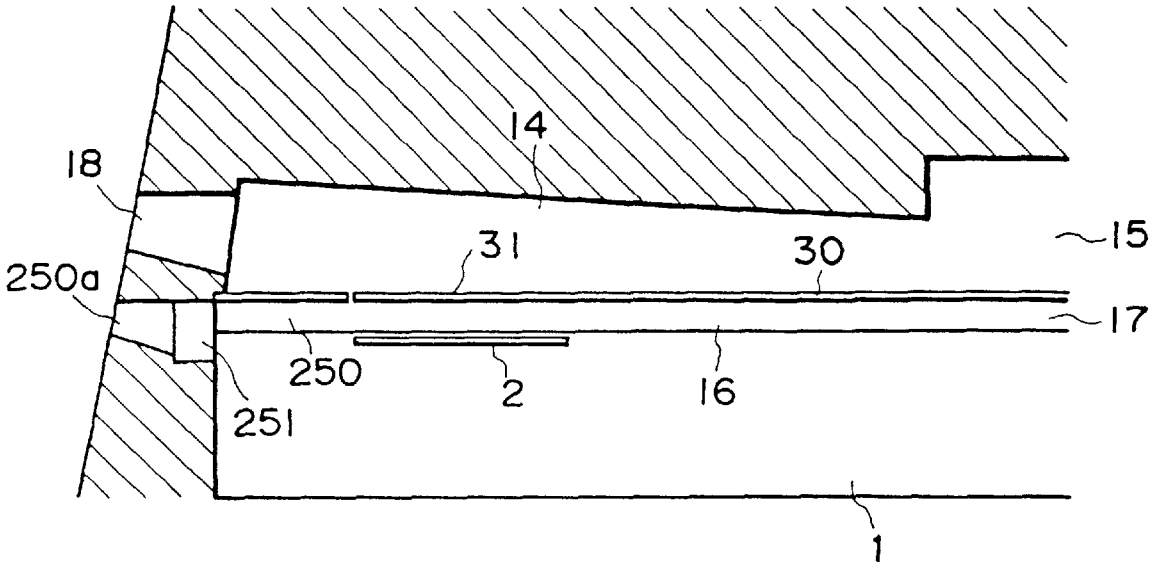
FIG. 39 is a sectional view of an ejection head in embodiment 7.
Figure 40:
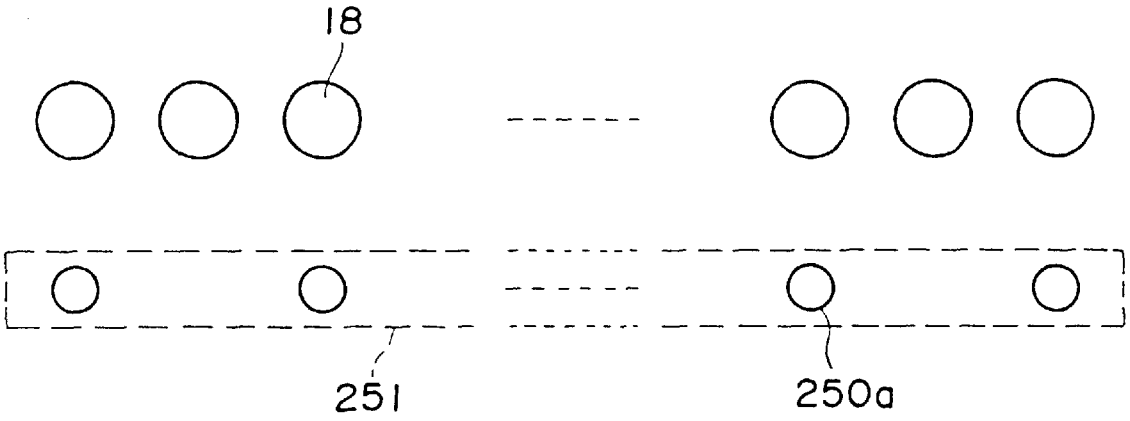
FIG. 40 is a schematic view of a major part of a front part of the head in embodiment 7.

FIG. 39 shows a section of the ejection head in example 7. As shown in FIG. 39, the recovery paths 250 for the second liquid flow path includes fluid communication paths 251. The fluid communication path 251, as shown in FIG. 40, is in the form of a slit along the array of the ejection outlets 18. The number of the recovery openings 250*a* is one half the number of the ejection outlets 18, but the fluid communication paths 251 in the form of slits, permit the bubbles to be removed from all of the second liquid flow paths 16 when the liquid is sucked through the recovery openings 250*a*. By simultaneously sucking the ejection outlets 18 and the recovery openings 250*a*, the bubbles can be removed from the first and second liquid flow paths 14 and 16.

Embodiment 8

Figure 41:
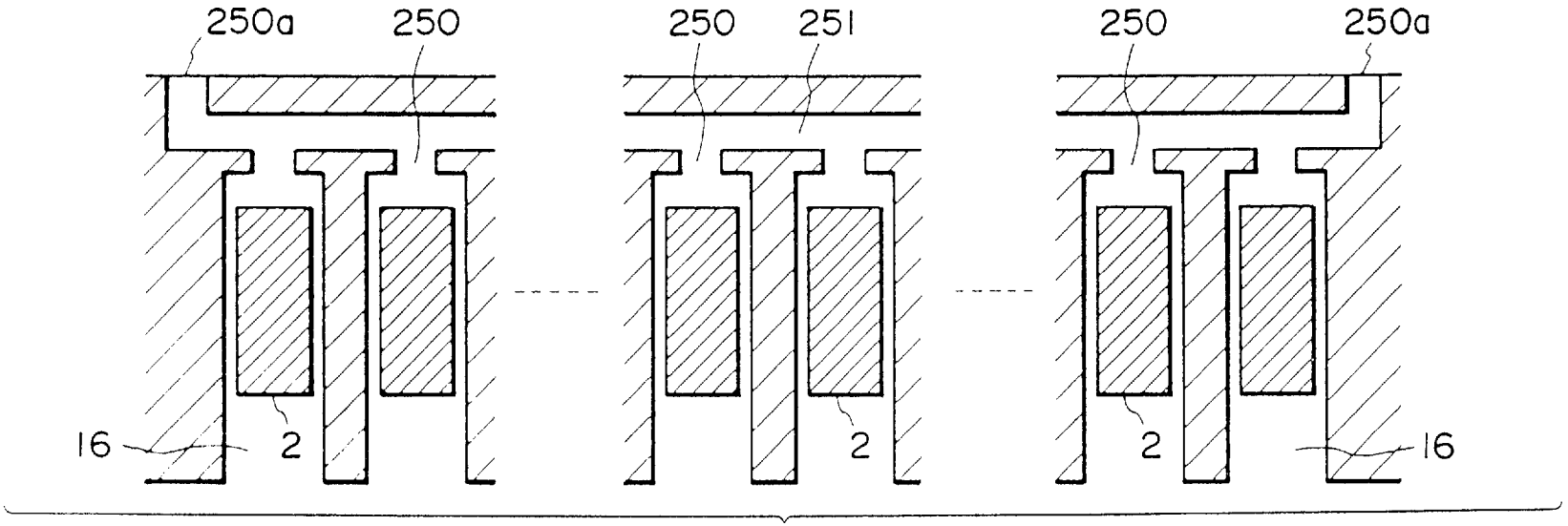
FIG. 41 is a plan view of a second liquid flow path of an ejection head in embodiment 8.
Figure 42:
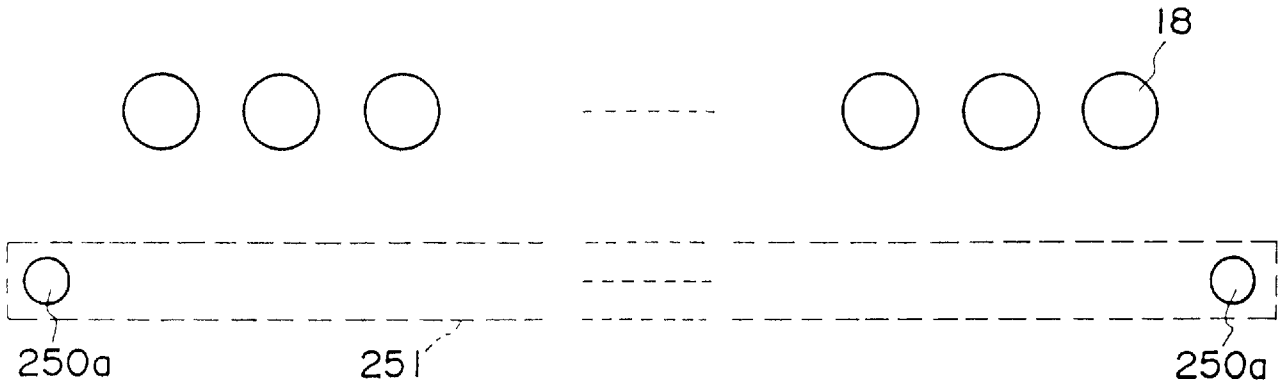
FIG. 42 is a schematic view of a major part of a front part of the head in embodiment 8.

FIGS. 41 and 42 show the structure of the second liquid flow path 16 of an ejection head in embodiment 8. The second liquid flow path recovery line 250 is in fluid communication with all of the second liquid flow paths 16 through the fluid communication paths 251, and the recovery openings 250*a* are formed at ends of the fluid communication paths 251. Although the number of the recovery openings 250*a* is 2, the bubble can be removed from all of the second liquid flow paths 16 by sucking the recovery openings 250*a* since it in fluid communication with all of the second liquid flow paths 16. By simultaneously sucking the ejection outlets 18 and the recovery openings 250*a*, the bubbles can be removed from the first and second liquid flow paths 14 and 16.

Embodiment 9

Figure 43:
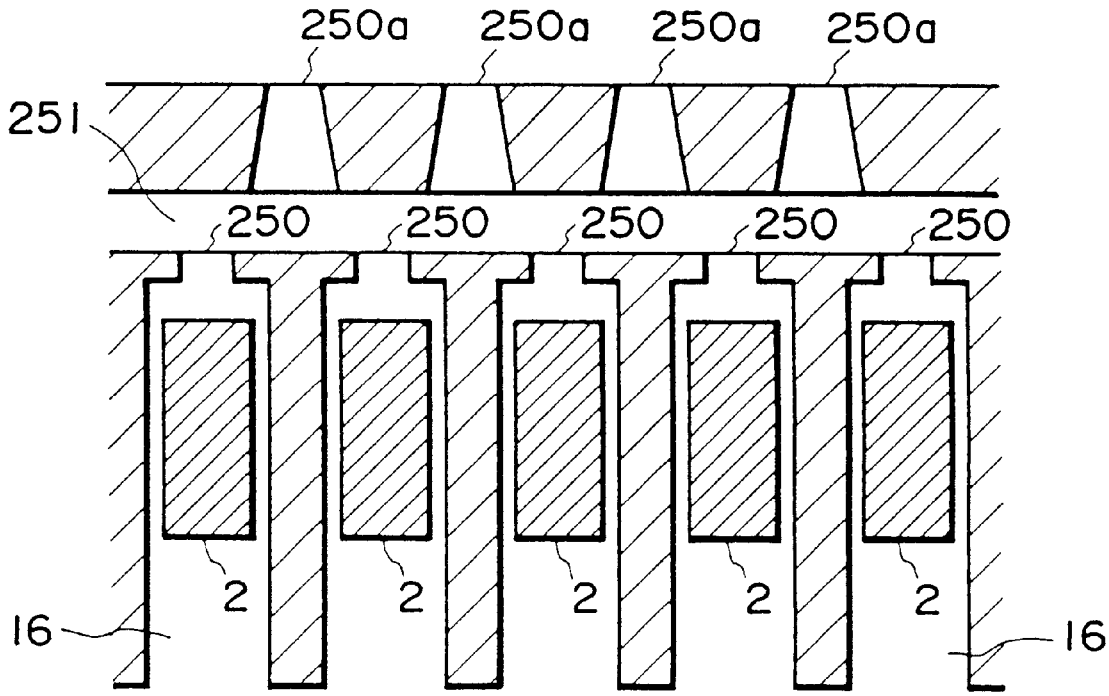
FIG. 43 is a plan view of a second liquid flow path of an ejection head in embodiment 9.
Figure 44:
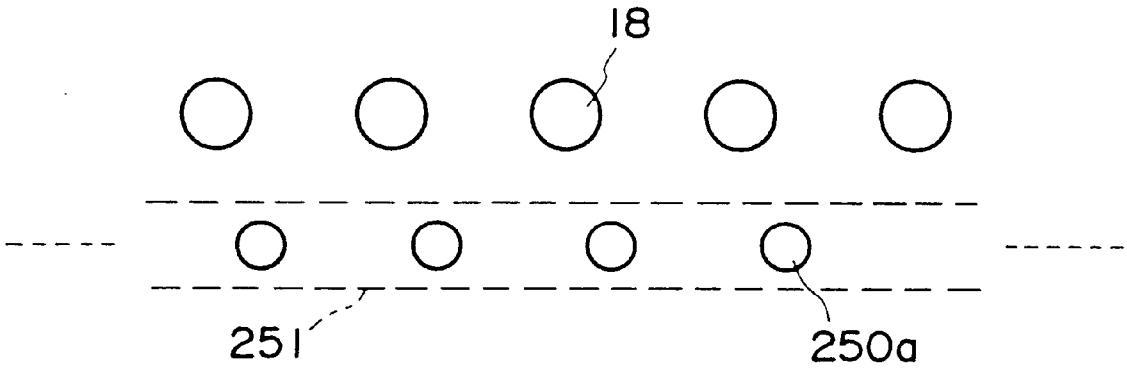
FIG. 44 is a schematic view of a major part of a front part of the head in embodiment 9.

FIG. 43 shows a second liquid flow path 16 and second liquid flow path recovery lines 250 in an ejection head of embodiment 9. The second liquid flow path 16 has second liquid flow path recovery lines 250 in fluid communication with outside through communication hole 251. As shown in FIG. 44, in the ejection head of this example, the ejection outlets 18 and recovery openings 250*a* are deviated by half pitch. By this arrangement of the recovery openings 250*a*, deviation is provided also between the heat generating elements 2 and the recovery openings 250*a*, so that the power provided by the bubble generation is not easily transmitted to the recovery openings 250*a*, and therefore, it is transmitted more to the movable member 31. Therefore, the ejection efficiency is improved to accomplish satisfactory ejections.

By sucking through the recovery opening 250*a* of the path 250 for the second liquid flow path, the bubble can be removed from the second liquid flow path 16 to assure the refilling of the liquid and stabilize the bubble generation.

By simultaneously sucking the ejection outlets 18 and the recovery openings 250*a*, the bubbles can be removed from the first and second liquid flow paths 14 and 16.

Embodiment 10

Figure 45:
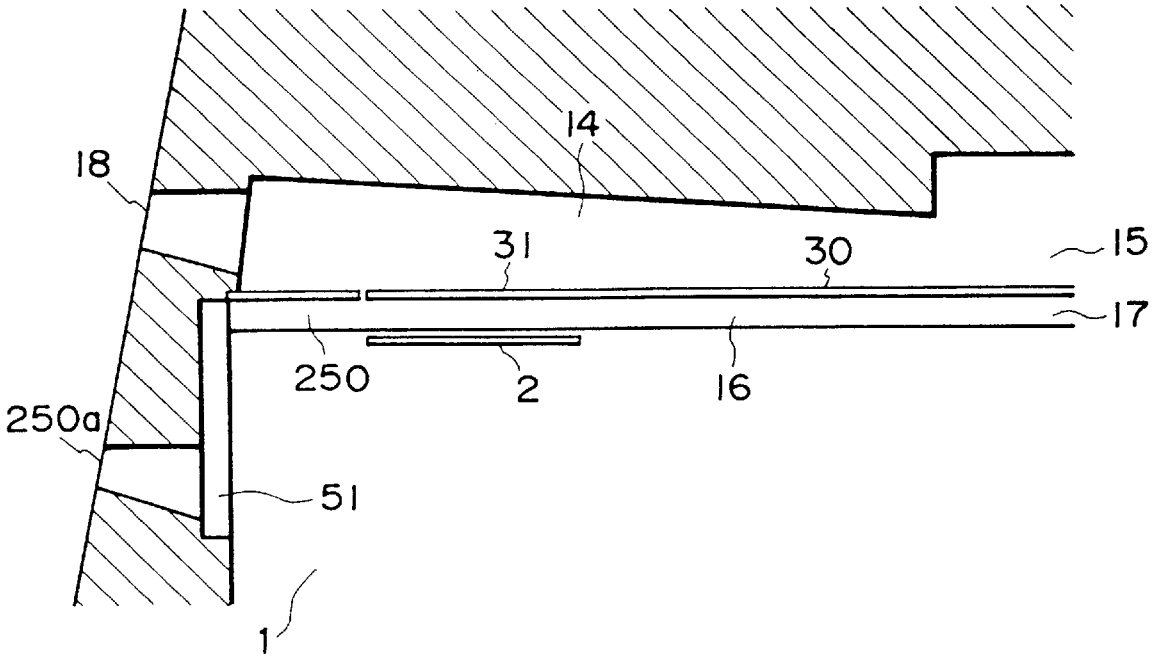
FIG. 45 is a sectional view of an ejection head in embodiment 10.

FIG. 45 is a sectional view of an ejection head according to embodiment 10. As shown in FIG. 45, the communication hole 251 has a larger width, as compared with the head having the structure shown in FIG. 39. By doing so, the bubble generation power from the heat generating element 2 can be transmitted more to the recovery opening 18, thus improving the ejection efficiency, similarly to embodiment 9.

Figure 46:
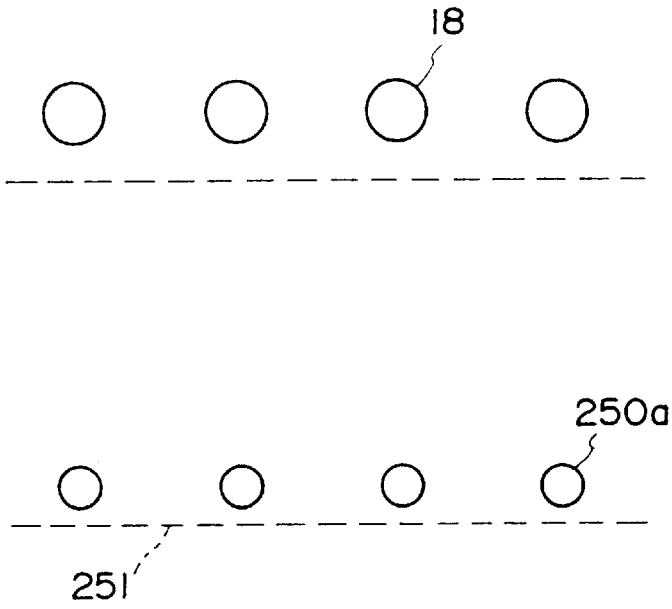
FIG. 46 is a schematic view of a major part of a front part of the head in embodiment 10.

In the ejection head in this embodiment, the positions of the ejection outlet 18 and the positions of the recovery openings 250*a* are remote as shown in FIG. 46. By doing so, mixing of the liquids in the first and second liquid flow paths 14 by way of the ejection outlets 18 and the recovery openings 250*a* can be avoided.

By sucking through the recovery opening 250*a* of the path 250 for the second liquid flow path, the bubble can be removed from the second liquid flow path 16 to assure the refilling of the liquid and stabilize the bubble generation.

By simultaneously sucking the ejection outlets 18 and the recovery openings 250*a*, the precipitated bubbles can be removed from the first and second liquid flow paths 14 and 16.

Embodiment 11

Embodiment 11 and subsequent embodiments 12, 13 and 14 are related to configurations of the suction caps and the suction process.

Figure 47:
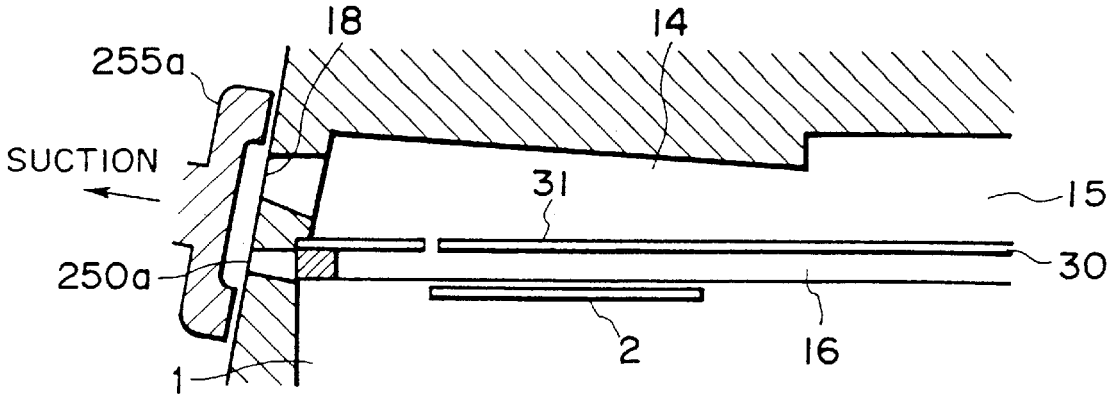
FIG. 47 is a sectional view of a recording head in embodiment 11.
Figure 48:
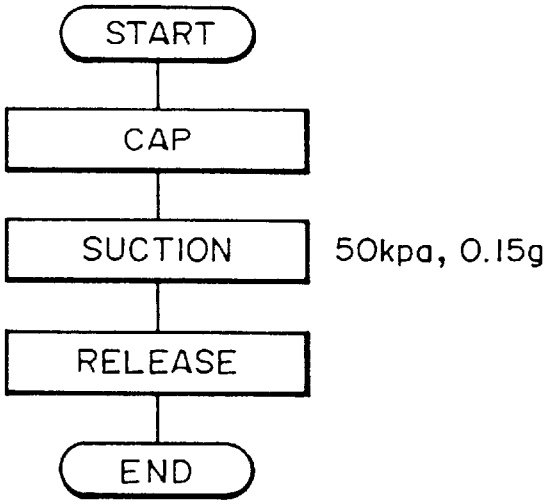
FIG. 48 is a flow chart showing suction recovery process in embodiment 11.

In embodiment 11, as shown in FIG. 47, the use is made with a suction cap 255*a* for simultaneously capping the ejection outlets 18 and the recovery openings 250*a*. In this example 11, as shown in FIG. 48, 0.15 g of the liquid is sucked at 50 kpa after the capping.

Embodiment 12

Figure 49:
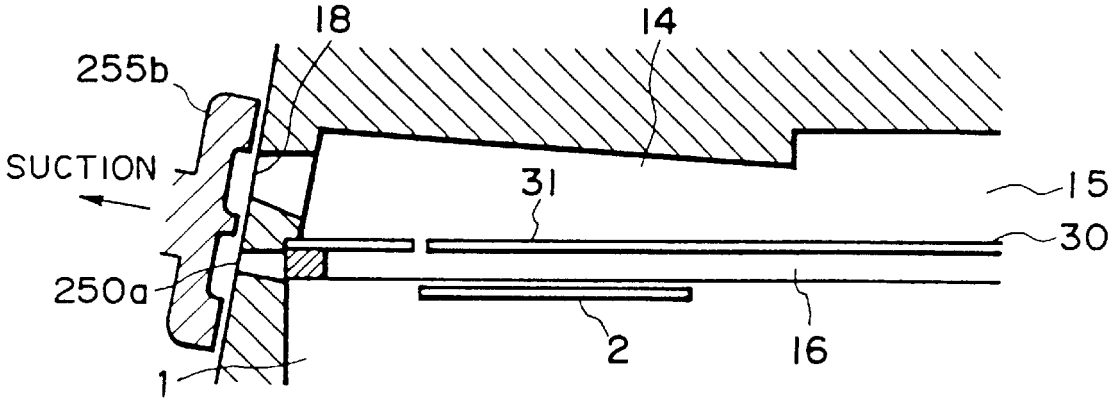
FIG. 49 is a sectional view of a recording head in embodiment 12.

In embodiment 12, the use is made with a suction cap 255*b* for capping the ejection outlet 18 and recovery openings 250*a*, separately, as shown in FIG. 49. By this separation type, the mixing of the liquids in the first and second liquid flow paths 14. and 16 by way of the ejection outlet 18 surface, can be prevented.

Embodiment 13

Figure 50:
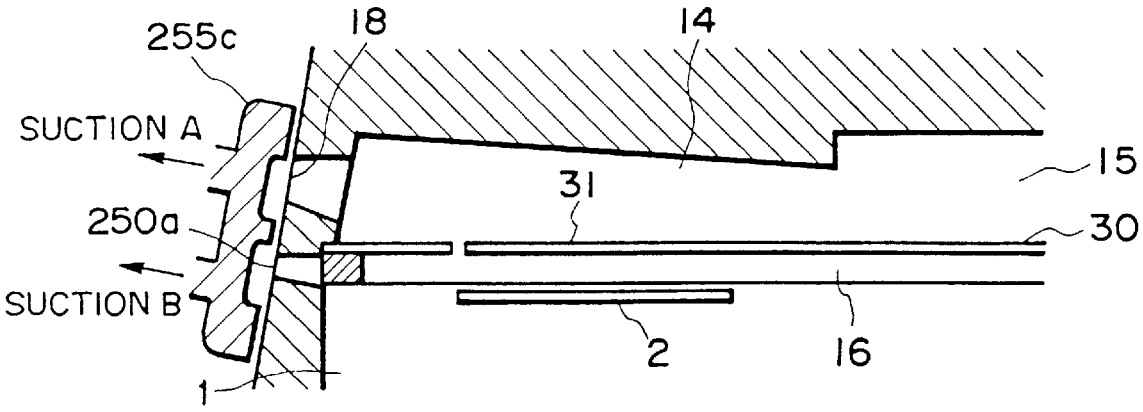
FIG. 50 is a sectional view of a recording head in embodiment 13.
Figure 51:
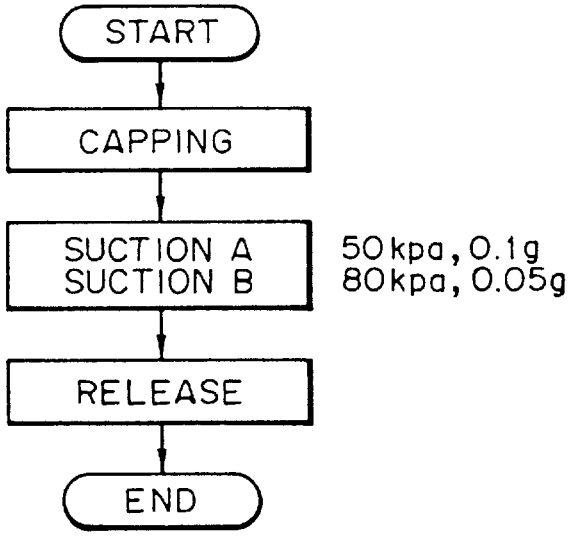
FIG. 51 is a flow chart showing suction recovery process in embodiment 13.

In this embodiment, as shown in FIG. 50, the ejection outlets 18 and the recovery openings 250*a* are separated, and two suction paths are provided. A suction cap 255*c* is used which can suck the ejection liquid and the bubble generation liquid separately. By the suction using the suction cap 255*c*, the recovery suction pressure and the suction amount from the ejection outlets 18 and the recovery openings 250*a* can be changed independently. The flow of the suction operation in this case, is shown in FIG. 51. When this suction method is carried out, the suction pressure for suction B for the ejection liquid is higher than that for suction A for the bubble generation liquid as shown in FIG. 51, since the second liquid flow path 16 has a smaller cross-sectional area than the first liquid flow path 14, and therefore, the flow resistance is larger in the second liquid flow path 16 than the first liquid flow path 14 in the head using the movable member of the present invention.

Embodiment 14

Figure 52:
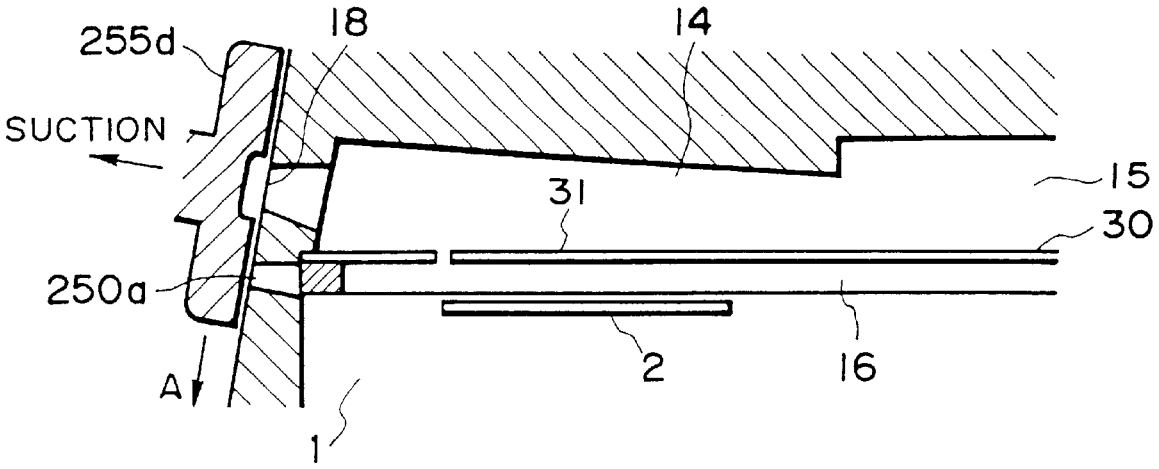
FIG. 52 is a sectional view of a recording head in embodiment 14.
Figure 53:
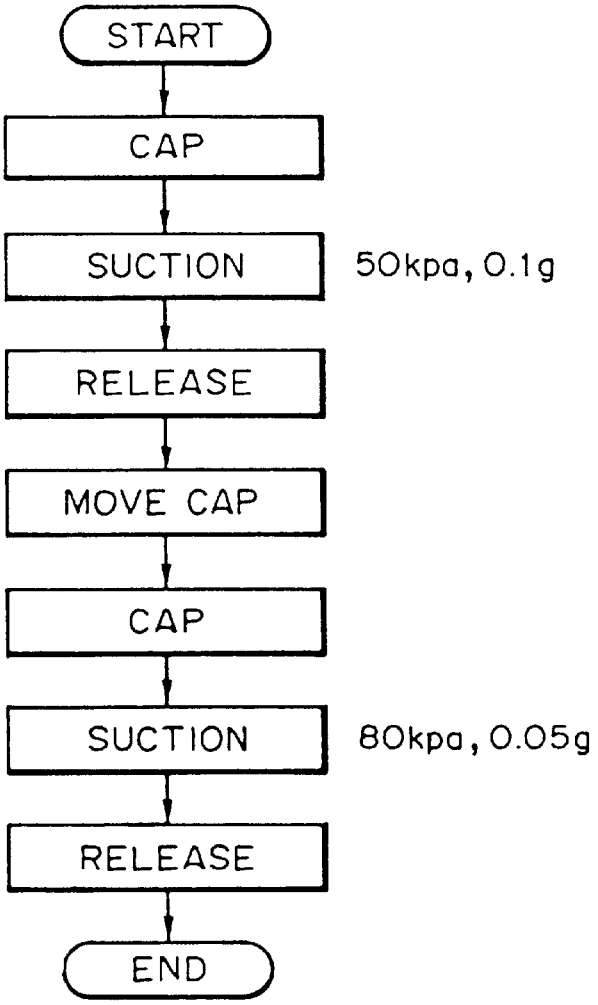
FIG. 53 is a flow chart showing suction recovery process in embodiment 14.

In this embodiment, as shown in FIG. 52, the suction cap 255*d* has such a configuration and size that the suction opening thereof can cover either the ejection outlets 18 or the recovery openings 250*a*. The suction cap 255*d* first caps the head while closing the recovery openings 250*a*, and the suction recovery is carried out for the first liquid flow path 14 through the ejection outlet 18. Subsequently, the suction cap 255*d* is moved in the direction of arrow A, and the head is capped while the ejection outlets 18 are closed, and the recovery operation is carried out for the second liquid flow path 16 through the recovery openings 250*a*. At this time, as shown in FIG. 53, the suction pressure and the suction amount for the ejection outlet 18 and the recovery opening 250*a* can be independently changed.

In embodiment 14, the suction operations are carried out in the order of the ejection outlet 18 and then the recovery opening 250*a*, but the order may be reverse.

Embodiment 15

In this embodiment, the suction recovery operations are carried out sequentially using the suction cap for the ejection outlets and the suction cap for the recovery openings (unshown). Since the caps are separate, more complicated operations are possible, and suctions for the ejection outlets 18 and for the recovery openings 250*a* may be simultaneous or may be sequential with short or long delay. The numbers of the suction operations may differ from each other.

Embodiment 16

In this example 16 and Embodiment 33, the above-described suction caps are not used, but the liquid flow paths are pressed to effect the recovery of the ejection power.

Figure 54:
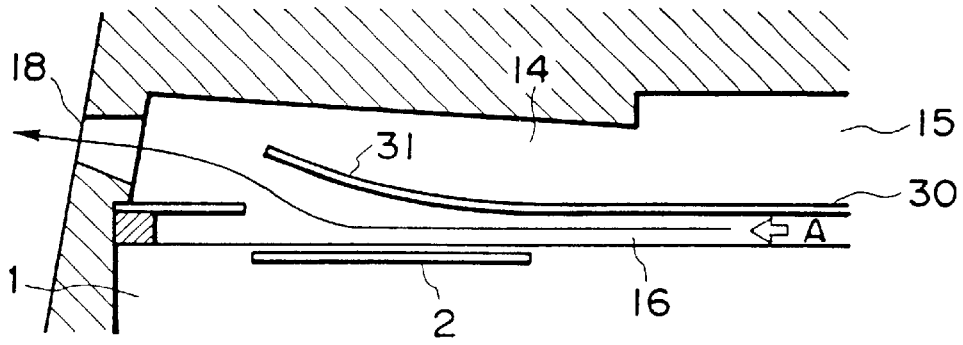
FIG. 54 is a sectional view of a recording head showing a suction recovery process in embodiment 16.
Figure 55:
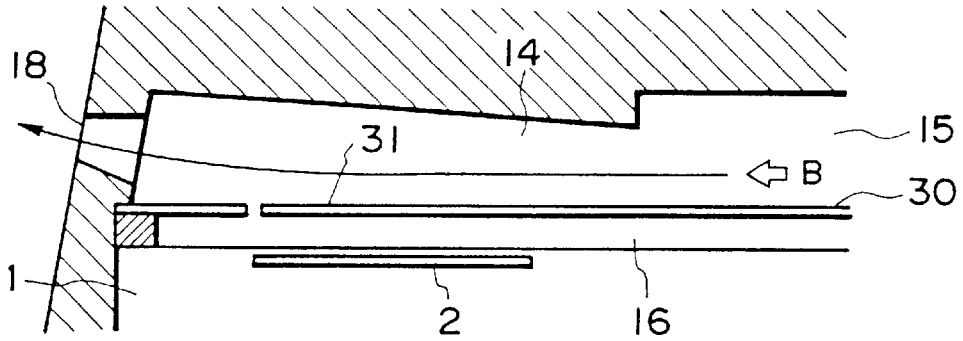
FIG. 55 is a sectional view of a recording head showing a suction recovery process in embodiment 16.

In this embodiment, the ejection head of the structure shown in FIG. 10, is used. In the ejection head of the structure shown in FIG. 10, the second liquid flow path 16 is pressurized, as shown in FIG. 54. By this pressure, the liquid (bubble generation liquid) in the second liquid flow path 16 raises the movable member 31, and is discharged through the ejection outlets 18. Subsequently, as shown in FIG. 55, the first liquid flow path 14 is pressurized. By this pressure, the liquid (ejection liquid) in the first liquid flow path 14 is discharged through the ejection outlet 18. By the sequential operation using the pressurization, the bubble can be removed from the first and second liquid flow paths 14 and 16, so that the liquid is assuredly refilled to accomplish the stabilized bubble generation.

Embodiment 17

Figure 56:
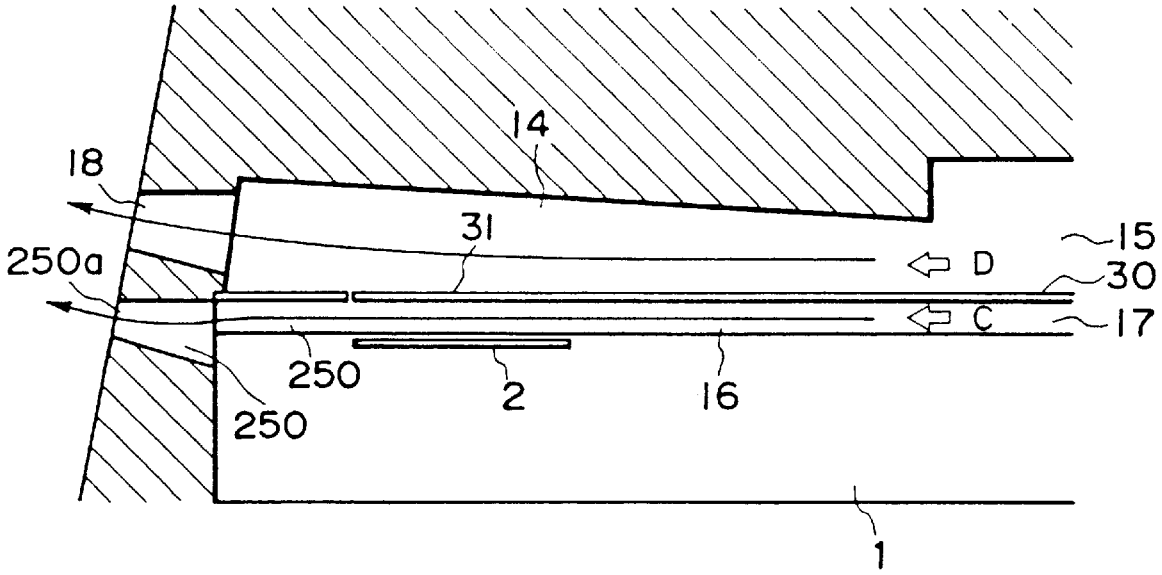
FIG. 56 is a sectional view of a recording head showing a suction recovery process in embodiment 17.

In this embodiment, the ejection head is provided with an above-described recovery path 250 for the second liquid flow path as shown in FIG. 36, for example. In the ejection head, as shown in FIG. 56, the first liquid flow path 14 is pressurized (C), and the second liquid flow path 16 is pressurized (D). The pressure C is higher than pressure D, since the flow passage diameter of the first liquid flow path 14 is normally larger than the flow passage diameter of the second liquid flow path 16. By this, the liquid in the first liquid flow path 14 is discharged through the ejection outlets 18, and the liquid in the second liquid flow path 16 is discharged through the recovery openings 250*a* of the recovery path 250 for the second liquid flow path. Therefore, the bubble can be removed from the first second liquid flow paths 14 and 16 to assure the refilling of the liquid and stabilize the bubble generation.

Figure 57:
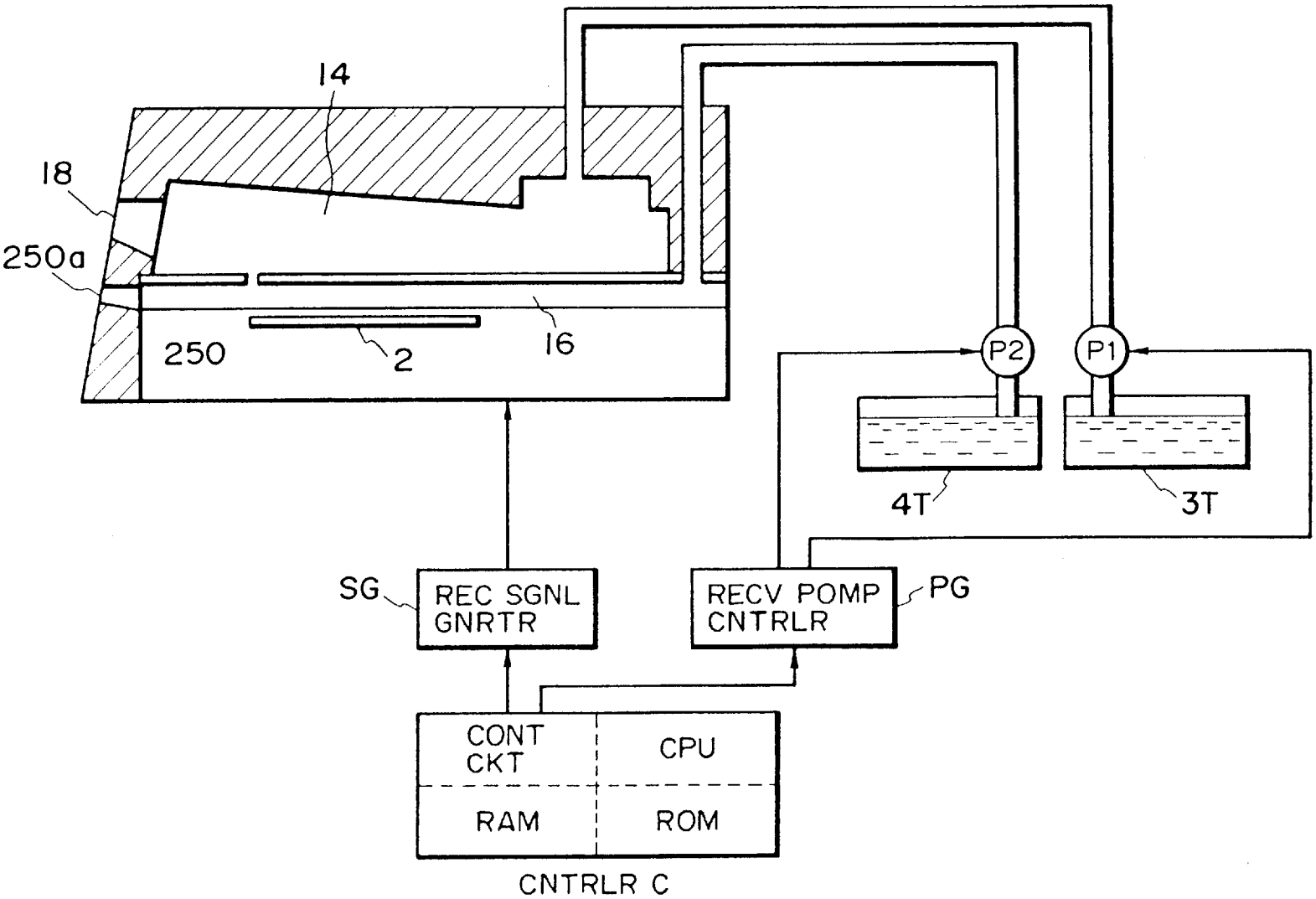
FIG. 57 is a block diagram showing a control system of the entirety of the device according to the present invention.

As shown in FIG. 57, a recovery pump P1 for the first liquid flow path is provided between the first liquid flow path 14 and a first ink container 3T, and a recovery pump P2 for the second liquid flow path is provided between the second liquid flow path 16 and a second ink container 4T. The control means C for the control of the entirety of the device, comprises CPU, such as a micro-processor, ROM for storing various data or control program for the CPU, and RAM usable as a work area and temporary memory for data data. In accordance with the control signals produced from the control means C, the recording head and the recovery pumps P1 and P2 for the first and second liquid flow paths are driven under the control thereof through a recording signal generating device SG and a circuit pump driving control circuit PG Embodiment 18

Figure 58:
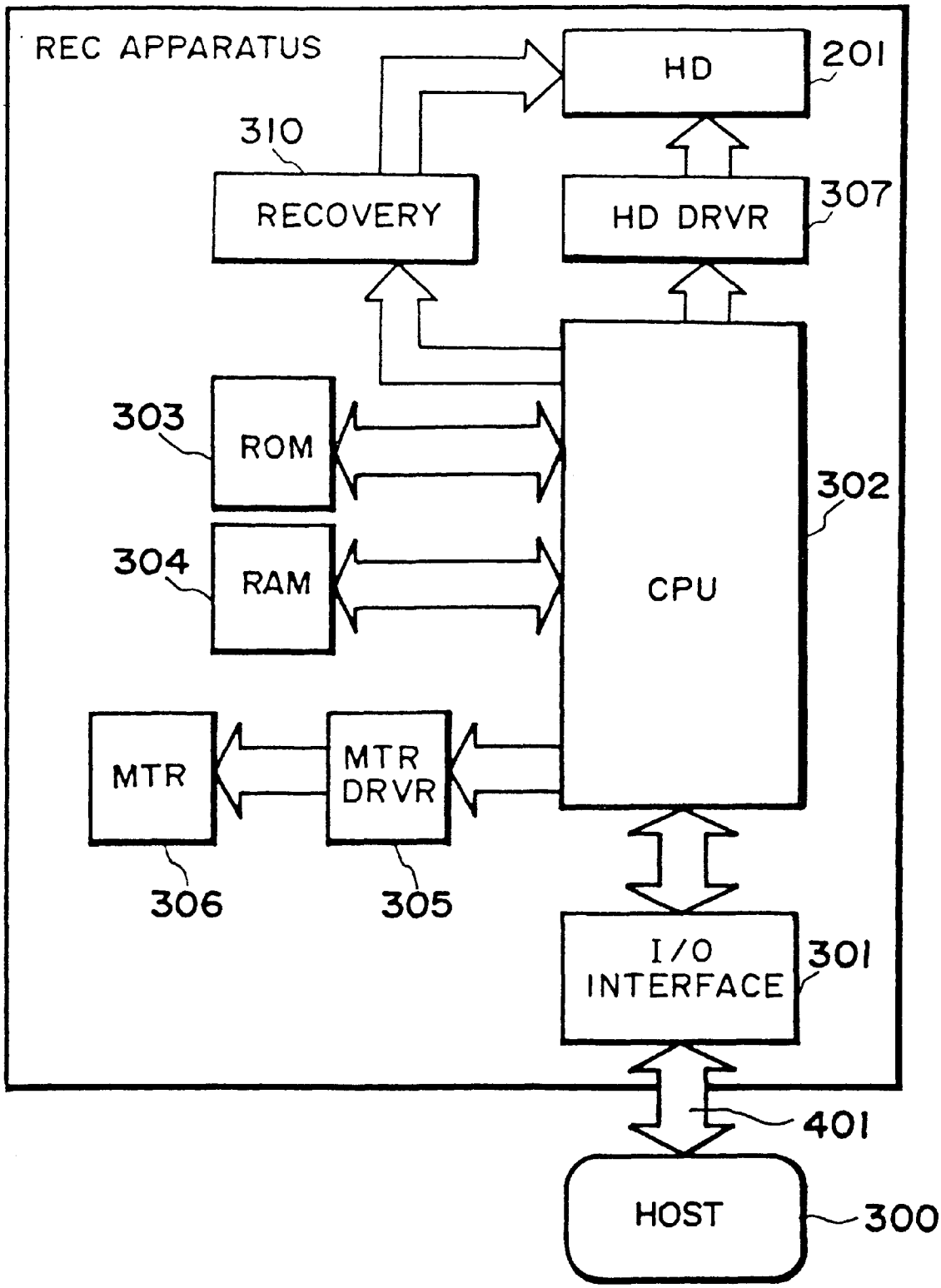
FIG. 58 is a block diagram of a recording device according to the present invention.

FIG. 58 is a block diagram of the entirety of the device for carrying out ink ejection recording using the liquid ejecting head and the liquid ejecting method of the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

When the ejection power refreshing operation is required as after rest of the head, the CPU302 supplies refreshing operation instructions to the recovering device 310 including the suction recovery device 200. The recovering device 310 having received the ejection power recovery instructions, carries out the series of operations for the recovery of the ejection power of the head on the basis of suction or pressurizing recovery sequence.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Embodiment 19

Next, an exemplary ink jet recording system will be described, which records images on recording medium, using, as the recording head, the liquid ejection head in accordance with the present invention.

Figure 59:
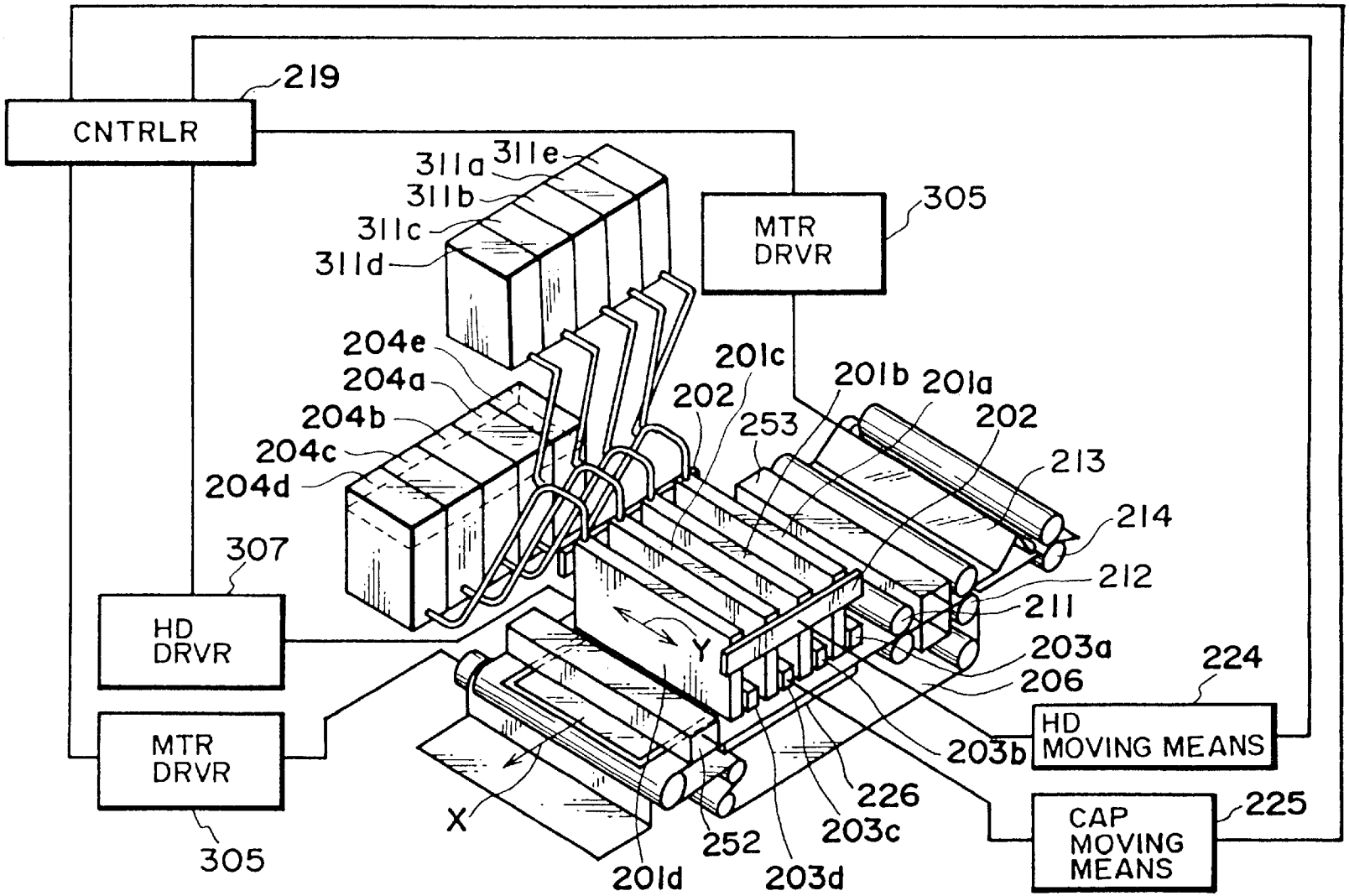
FIG. 59 is an illustration of a liquid ejection recording system.

FIG. 59 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 1204*a*, 1204*b*, 1205*c* or 1204*d*. A reference numeral 1204*e* designates a bubble generation liquid container from which the bubble generation liquid is delivered to each head.

Between the container and the each head, the tube is provided with pressurizing recovering device 311*e*, 311*a*, 311*b*, 311*c*, or 311*d*, as shown in the Figure. The driving means for the pressurizing recovering device is a pressurizing pump, and when the recovery for the ejection power of the head is necessary, the CPU302 shown in FIG. 58 produces pressurizing recovery instructions, and the series of operations for the recovery of the ejection power of the head is carried out on the basis of the predetermined pressurizing recovery sequence.

Below each head, there is a head cap 203*a*–203*d* having ink absorption member such as sponge, which covers the ejection outlets of each head when the recording operation is not effected to protect the head.

Designated by reference numeral 206 is a conveyer belt constituting feeding means for feeding a recording material as has been described. The conveyer belt 206 extends along a predetermined path using various rollers, and is driven by a driving roller connected with the motor driver 305.

The ink jet recording system in this embodiment comprises a pre-printing processing apparatus 1251 and a post-printing processing apparatus 1252, which are disposed on the upstream and downstream sides, respectively, of the ink jet recording apparatus, along the recording medium conveyance path. These processing apparatuses 1251 and 1252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it, may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head Kit>

Figure 60:
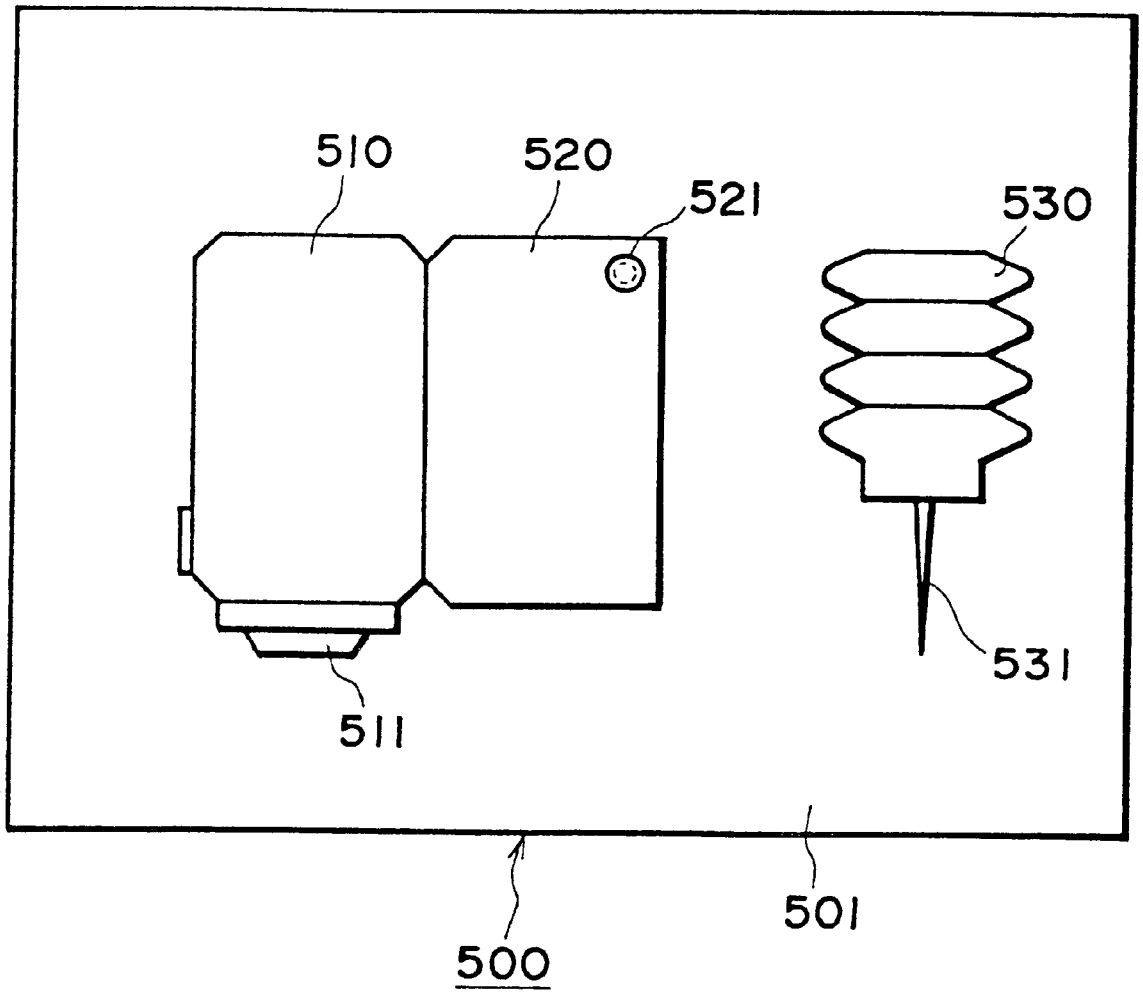
FIG. 60 is a schematic view of a head kit.
Figure 61A:
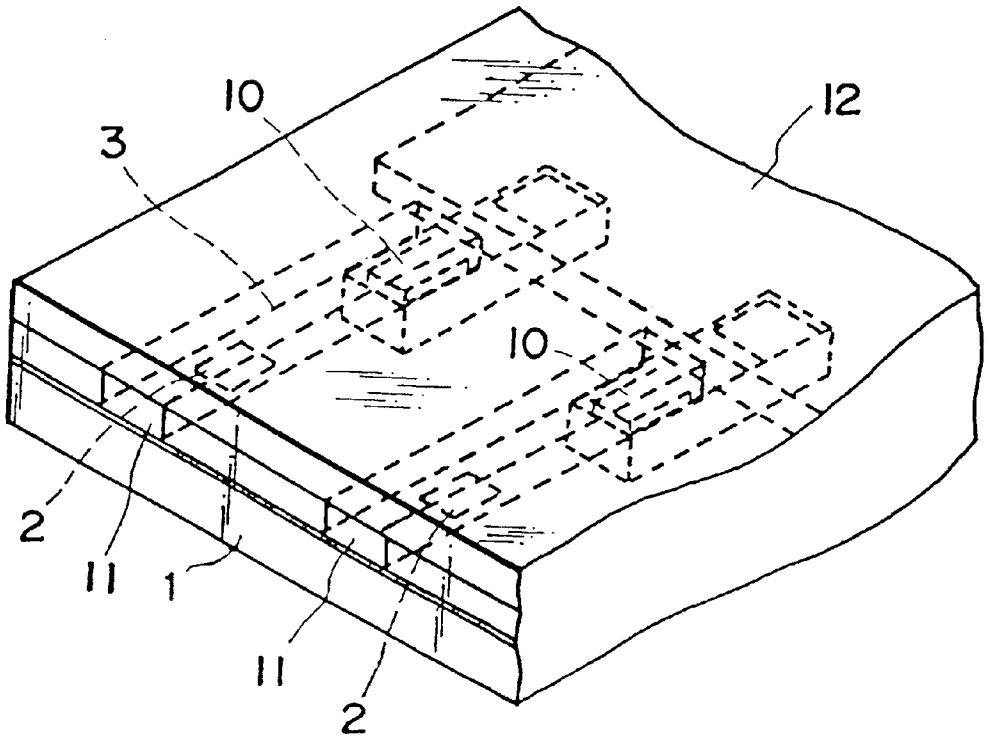
FIG. 61 is an illustration of a liquid flow passage structure of a conventional liquid ejecting head.
Figure 61B:
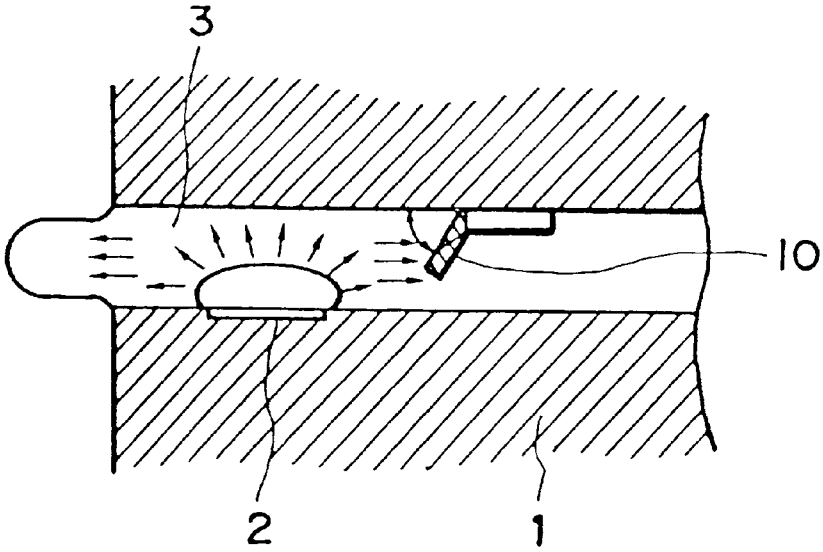

A head kit usable for the liquid ejecting head of the present invention will be described. FIG. 60 is a schematic view of a head kit according to an embodiment of the present invention. It comprises a head 510 according to the present invention having an ink ejection portion 511 for ejecting the ink, an ink container 520 (liquid container) separable or non-separable relative to the head, ink filling means for containing the ink for filling into the ink container, and a kit container 501 containing all of them.

When the ink is used up, a part of an inserting portion (injection needle or the like) 531 of the ink filling means is inserted into an air vent 521 of the ink container or into a hole or the like formed in a wall of the ink container or in a connecting portion relative to the head, and the ink in the ink filling means is filled into the ink container.

Thus, the liquid ejecting head of the present invention, ink container, ink filling means or the like, are accommodated in the kit container, so that when the ink is used up, the ink can be filled into the ink container without difficulty.

In the head kit of this embodiment, the ink filling means is contained, but the head kit may not have the ink filling means, and instead, the kit container 510 may contain a full ink container detachably mountable to the head as well as the head.

In FIG. 60, there is shown only ink filling means for filling the ink to the ink container, but the kit container may also contain bubble generation liquid filling means for filling the bubble generation liquid into the bubble generation liquid container as well as the ink container.

The liquid in the liquid path in single liquid flow path structure is sucked out, or the liquids in the paths in the two-flow-path structure are simultaneously sucked out, through the ejection outlets, or they are pressurized, so that the viscosity-increased ink, foreign matter or the like which is liable to be deposited at the ejection outlet portion after long non-use period, can be efficiently removed, and the precipitated bubble in the liquid in the first liquid flow path can be efficiently removed.

With the structure of the bubble generating portion side liquid flow path having a path open to the outside, the liquids in the two paths isolated by the movable member are efficiently discharged by the suction means or pressing means. With this structure, the number, amount, order, and the timing of the discharge for the liquids in both of the flow paths are selectable.

In addition, by increasing the flow rate by opening the flow rate adjusting means upon the suction operation through the ejection outlet, the removal of the viscosity-increased ink or the like can be further efficient.

Adjustment of the suction amount of each liquid using the static head difference between the liquid, or suction under the condition that the flow resistances of the liquids are the same, are effective to increase the efficiency of the removal of the viscosity-increased ink or the like. Suction while the movable member takes the position in the first liquid flow path, is very effective.

When the liquid ejecting method, and the head using the movable member, the ejection efficiency can be increased.

The ejection failure can be avoided even after long term non-use under low temperature and low humidity conditions, and even if the ejection failure occurs, the normal state is restored by small scale refreshing process such as preliminary ejection or suction recovery. According to the present invention, the time required for the recovery can be reduced, and the loss of the liquid by the recovery operation is reduced, so that the running cost can be reduced.

According to an aspect of the present invention wherein the refilling property is improved, the responsivity, stabilized growth of the bubble, and the stabilization of the droplet are accomplished under the condition of the continuous ejection, so that the high speed recording and high image quality recording are accomplished by the high speed liquid ejection.

Additionally, by selecting as the bubble generation liquid a liquid with which the deposition such as burnt deposit does not remain on the surface of the heat generating element even upon the heat application or with which the bubble generation is easy, the choice of the ejection liquid is big. For example, a high viscosity liquid with which bubble generation is not easy or a liquid with which the burnt deposit is easy to produced, have been unable to be ejected in a conventional bubble jet ejection method, but they can be ejected according to the present invention.

The bubble generation is stabilized to assure the proper ejections.

The ejection liquid and the bubble generation liquid may be separated, and the ejection liquid is ejected by the pressure produced in the bubble generation liquid.

Furthermore, a liquid which is easy influenced by heat can be ejected without adverse influence.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head comprising:

an ejection outlet for ejecting liquid;

a liquid path having a heat generating element for generating a bubble in the liquid by application of heat to the liquid, and a supply passage for supplying the liquid to the heat generating element from upstream side thereof;

a movable member, disposed faced to said heat generating element and having a free end adjacent said ejection outlet, for directing a pressure produced by generation of the bubble, toward said ejection outlet, on the basis of the pressure produced by the generation of the bubble; and an opening, in fluid communication with said supply passage, for discharging the liquids, wherein said movable member has a fulcrum and a free end disposed downstream of the fulcrum.

2. A liquid ejection head comprising:

an ejection outlet for ejecting liquid;

a heat generating element for generating a bubble in the liquid by application of heat to the liquid;

a movable member, disposed faced to said heat generating element and having a free end adjacent said ejection outlet, for directing a pressure produced by generation of the bubble, toward said ejection outlet;

a supply passage for supplying the liquid to said heat generating element from an upstream thereof along a surface of said movable member adjacent said heat generating element;

an opening, in fluid communication with said supply passage, for discharging the liquid, wherein the heat generating element is provided faced to said movable member, and said bubble generating region is formed between said movable member and said heat generating element.

3. A liquid ejection head according to claim 1 or 2, wherein said opening is formed in the same surface having said ejection outlet.

4. A liquid ejection head according to claim 1 or 2, wherein a plurality of said ejection outlets are provided, and a plurality of said openings are provided, wherein the number of said openings is smaller than the number of said ejection outlets.

5. A liquid ejection head according to claim 4, wherein said openings are arranged at intervals at which said ejection outlets are arranged.

6. A liquid ejection head according to claim 1 or 2, wherein said openings are arranged in the same direction as said ejection outlets.

7. A liquid ejection head according to claim 1 or 2, wherein a downstream portion of the bubble grows toward downstream by said movable member.

8. A liquid ejection head according to claim 1 or 2, wherein a free end of said movable member is disposed downstream of an area center of said heat generating element.

9. A liquid ejection head according to claim 1 or 2, wherein said bubble is generated by film boiling of the liquid by the heat generated by said heat generating element.

10. A liquid ejection head according to claim 1 or 2, wherein said movable member is flat.

11. A liquid ejection head according to claim 1 or 2, wherein all of an effective bubble generation region of said heat generating element is faced to said movable member.

12. A liquid ejection head according to claim 1 or 2, wherein all surface of said heat generating element is faced to said movable member.

13. A liquid ejection head according to claim 1 or 2, wherein a total area of said movable member is larger than a total area of said heat generating element.

14. A liquid ejection head according to claim 1 or 2, wherein a fulcrum of said movable member is disposed deviated from right above said heat generating element.

15. A liquid ejection head according to claim 1 or 2, wherein a free end of said movable member extends substantially transverse to liquid flow path having said heat generating element.

16. A liquid ejection head according to claim 1 or 2, wherein said free end of said movable member is disposed closer to said ejection outlet than said heat generating element.

17. A liquid ejection head according to claim 1 or 2, wherein said heat generating element is an electrothermal transducer having a heat generating resistor generating heat upon receipt of electric signal.

18. A liquid ejection head according to claim 17, wherein said electrothermal transducer has a protecting film on said heat generating resistor.

19. A liquid ejection head comprising:

a first liquid flow path in fluid communication with an ejection outlet;

a second liquid flow path having bubble generation region for generating the bubble in the liquid by applying heat to the liquid;

a movable member, disposed between said first liquid flow path and said bubble generating region and having a free end adjacent said ejection outlet, for directing a pressure produced by generation of the bubble, toward said ejection outlet of said first liquid flow path, by movement of the free end into said first liquid flow path on the basis of pressure produced by generation of the bubble the bubble generating region;

an opening, in fluid communication with said supply passage, for discharging the liquid.

20. A liquid ejection head comprising:

a plurality of ejection outlet for ejecting liquid;

a plurality of grooves for constituting a plurality of first liquid flow paths in direct fluid communication with associated ones of said ejection outlets;

a recess for constituting a first common liquid chamber for supplying the liquid to said first liquid flow paths; wherein said grooves and said recess are formed in a grooved member;

an element substrate having a plurality of heat generating elements for generating the bubble in the liquid by applying heat to the liquid; and a partition wall disposed between said grooved member and said element substrate and forming a part of walls of second liquid flow paths corresponding to said heat generating elements, and a movable member movable into said first liquid flow paths by pressure produced by the generation of the bubble, said movable member being faced to said heat generating element; and an opening, in fluid communication with said supply passage, for discharging the liquid.

21. A liquid ejection head according to claim 20, further comprising flow rate adjusting means, disposed between said first common liquid chamber in fluid communication with said second liquid path and a container for containing the liquid to be supplied to said first common liquid chamber, for adjusting a flow rate of the liquid.

22. A liquid ejection head according to claim 21, wherein said adjusting mean includes a solenoid valve.

23. A liquid ejection head according to claim 21, wherein said adjusting means is disposed in said second liquid flow path, and adjusts a flow rate through said second liquid flow path.

24. A liquid ejection head according to claim 20, further comprising a first common liquid chamber for supplying first liquid to a plurality of said first liquid paths, and a second common liquid chamber for supplying second liquid to a plurality of said second liquid flow paths.

25. A liquid ejection head according to claim 20, wherein the liquid in said second liquid flow path is at least lower in viscosity, higher in bubble generation property, higher in thermal stability than the liquid in said first liquid flow path.

26. A liquid ejection head according to claim 20, wherein said movable member constitutes a part of a separation wall between said first liquid flow path and second liquid flow path.

27. A liquid ejection head according to claim 26, wherein said grooved member is provided with a first introduction path for introducing the liquid into said first common liquid chamber, and a second introduction path for introducing the liquid into said second common liquid chamber.

28. A liquid ejection head according to claim 27, wherein said grooved member is provided with a plurality of such said second introduction paths.

29. A liquid ejection head according to claim 27, wherein a cross-sectional area of said first introduction path and a cross-sectional area of said second introduction path are proportional to supply amounts of the liquids therethrough.

30. A liquid ejection head according to claim 27, wherein said second introduction path supplies the liquid into said second common liquid chamber through the separation wall.

31. A liquid ejection head according to claim 26, wherein said separation wall is of metal material.

32. A liquid ejection head according to claim 31, wherein the metal material is nickel or gold.

33. A liquid ejection head according to claim 26, wherein said separation wall is of resin material.

34. A liquid ejection head according to claim 26, wherein said separation wall is of ceramic material.

35. A liquid ejection head according to claim 20, wherein said element substrate is provided with wiring for transmitting an electric signal to an electrothermal transducer, and a function element for selectively supplying an electric signal to said electrothermal transducer.

* * * * *

UNITED STATES PATENT AND TRADEMARK OFFICE

CERTIFICATE OF CORRECTION

PATENT NO. : 6,663,230 B2
DATED : December 16, 2003
INVENTOR(S) : Yoshie Asakawa et al.

It is certified that error appears in the above-identified patent and that said Letters Patent is hereby corrected as shown below:

Drawings,
Figure 16, “HEATEA AREA” should read -- HEATER AREA --.

Column 1,
Line 47, “With such” should read -- Such --.

Column 2,
Line 22, “stick” should read -- sticks --;
Line 34, “make” should read -- made --; and
Line 46, “when it” should read -- when --.

Column 3,
Line 7, "some effect" should read -- same effect --.

Column 4,
Line 24, "bubble the bubble" should read -- bubble in the bubble --.

Column 5,
Line 32, "bubble the bubble" should read -- bubble in the bubble --; and
Line 37, "outlet" should read -- outlets --.

Column 7,
Lines 30 and 47, "the bubble" should read -- in the bubble --;
Line 55, "outlet" should read -- outlets --.

Column 8,
Line 9, "outlet" should read -- outlets --.

Column 10,
Line 15, "is shows" should read -- is --.

Column 13,
Line 31, "of the" should be deleted; and
Line 52, "to to" should read -- to --.

Column 14,
Line 11, "of of" should read -- of --.

Column 17,
Line 62, "side side" should read -- side --.

UNITED STATES PATENT AND TRADEMARK OFFICE

CERTIFICATE OF CORRECTION

PATENT NO. : 6,663,230 B2
DATED : December 16, 2003
INVENTOR(S) : Yoshie Asakawa et al.

It is certified that error appears in the above-identified patent and that said Letters Patent is hereby corrected as shown below:

Column 24,
Line 51, "fro" should read -- for --.

Column 25,
Line 58, "4μ" should read -- 4 μm --.

Column 26,
Line 39, "$40X10^5$μm" should read -- 40x105 μm --; and
Line 58, "the right above" should read -- right above the --.

Column 27,
Line 66, "7 psec" should read -- 7 μsec --.

Column 28,
Line 10, "reduces" should read -- reduced --.

Column 31,
Line 5 "alcoholic" should read -- alcohol --.

Column 32,
Line 8, "alcoholic" should read -- alcohol --.

Column 36,
Line 31, "fro" should read -- from --.

Column 37,
Line 4, "liquid" should read -- liquids --;
Line 5 , "the the" should read -- the --; and
Line 10, "embodiment" should read -- embodiments --.

Column 38,
Line 65, "movable member 35" should read -- movable member 31 --.

Column 42,
Line 26, "data data" should read -- data --.

UNITED STATES PATENT AND TRADEMARK OFFICE

CERTIFICATE OF CORRECTION

PATENT NO. : 6,663,230 B2
DATED : December 16, 2003
INVENTOR(S) : Yoshie Asakawa et al.

It is certified that error appears in the above-identified patent and that said Letters Patent is hereby corrected as shown below:

Column 43,
Line 47, "the each" should read -- each --.

Column 45,
Line 60, "easy" should read -- easily --.

Column 46,
Line 16, "liquids," should read -- liquid, --.

Column 47,
Line 38, "bubble the bubble" should read -- bubble in the bubble --.

Signed and Sealed this

Twenty-fourth Day of August, 2004

JON W. DUDAS
*Director of the United States Patent and Trademark Office*